US008096926B1

(12) United States Patent
Batca

(10) Patent No.: US 8,096,926 B1
(45) Date of Patent: Jan. 17, 2012

(54) MULTI RESISTANCE RATIO EXERCISE APPARATUS

(76) Inventor: Roger Batca, Durham, NC (US)

( * ) Notice: Subject to any disclaimer, the term of this patent is extended or adjusted under 35 U.S.C. 154(b) by 0 days.

(21) Appl. No.: 12/019,174

(22) Filed: Jan. 24, 2008

Related U.S. Application Data

(60) Provisional application No. 60/898,326, filed on Jan. 30, 2007.

(51) Int. Cl.
*A63B 21/062* (2006.01)

(52) U.S. Cl. ..... 482/99; 482/92

(58) Field of Classification Search ..... 482/97, 482/99, 103, 92–94, 100–102, 133, 135–138, 482/126
See application file for complete search history.

(56) References Cited

U.S. PATENT DOCUMENTS

| | | | | | |
|---|---|---|---|---|---|
| 4,145,029 | A * | 3/1979 | Johns | 254/390 |
| 5,050,872 | A * | 9/1991 | Farenholtz | 482/133 |
| 5,328,428 | A * | 7/1994 | Huang | 482/98 |
| 6,238,323 | B1 * | 5/2001 | Simonson | 482/103 |
| 7,632,221 | B1 * | 12/2009 | Kolander | 482/94 |
| 2003/0017918 | A1 * | 1/2003 | Webb et al. | 482/94 |
| 2008/0051269 | A1 * | 2/2008 | Lines | 482/99 |

* cited by examiner

*Primary Examiner* — Loan Thanh
*Assistant Examiner* — Shila Jalalzadeh Abyane
(74) *Attorney, Agent, or Firm* — Coats & Bennett, P.L.L.C.

(57) ABSTRACT

A multi resistance ratio exercise apparatus may provide at least one arm assembly which includes multiple flexible connector ends exiting which can be pressed or pulled to perform user defined functional and strength training exercises. A handle assembly may be attached to one or more flexible connector ends. The flexible connector ends may be interconnected with resistance wherein the pressing or pulling of one flexible connector end will provide the user with an alternate ratio of resistance and flexible end travel distance capability than the pressing or pulling of an alternate flexible connector end.

22 Claims, 34 Drawing Sheets

MULTI RESISTANCE RATIO EXERCISE APPARATUS

RELATED APPLICATIONS

This application claims priority to Provisional Patent Application No. 60/898,326 filed Jan. 30, 2007 which is incorporated herein by reference.

FIELD OF THE INVENTION

The present invention is directed generally to exercise equipment and, more particularly, an apparatus to perform user defined movements by pulling or pressing one or more handles connected to one or more cable or flexible connector ends.

BACKGROUND

Exercising is well known as a basic need for maintaining a healthy life. A recent trend in fitness is known as functional training. This type of training allows an individual to grasp one or more handles of an exercise machine and press or pull in a motion defined by the user. This motion can reproduce sport specific movements of an athlete or reproduce everyday movements of an individual. User defined movements with resistance will engage numerous stabilizer and major muscles and help an individual achieve total body strength conditioning and overall better health.

Exercise machines called functional trainers have been developed wherein two adjustable arm assemblies can be selectively positioned to accommodate the users preferred point of engagement with a handle or other type of attachment that can be connected to a cable end and be pressed or pulled. Each adjustable arm assembly has one cable end that is interconnected with a weight stack. This cable end typically exits and is routed over at least one pulley at the adjustable arm assembly's distal end. This pulley at the distal end of the adjustable arm assembly is typically pivotally attached to allow the handle to be pressed or pulled in multiple planes. The ability to press or pull in multiple planes and to engage a handle in selectively different starting positions accommodates different sized users with different flexibilities and different training goals.

Typically, one weight stack provides the resistance for these functional trainers. The cable end of the first adjustable arm assembly and the cable end of the second adjustable arm assembly are connected to the weight stack. The two cable ends of some functional trainers are interconnected with the weight stack wherein a 4 to 1 mechanical advantage is provided to the user when one cable end is pressed or pulled. For example, if the functional trainer has a 200 lb weight stack, pressing or pulling one cable end will provide 50 lbs of resistance. This is an advantage because the cable end can be pressed or pulled a long distance before the top of the weight stack will run out of upward travel distance. This allows the user to perform many functional training exercises that require long distance pressing or pulling and light weight resistance. This is a disadvantage if the user wants to perform strength training exercises that require shorter distance pressing or pulling and heavier weight resistance. A functional trainer could be made with a heavier weight stack such as 400 lbs but this would greatly increase the cost of the exercise machine.

The two cable ends of some functional trainers are interconnected with the weight stack wherein a 2 to 1 mechanical advantage is provided to the user when one cable end is pressed or pulled. For example, if the functional trainer has a 200 lb weight stack, pressing or pulling one cable end will provide 100 lbs of resistance. This 2 to 1 mechanical advantage does not allow as much cable end travel as the 4 to 1 mechanical advantage does because of the exercise machine height restrictions of the upward travel of the weight stack. The 2 to 1 ratio is an advantage if the user wants to perform strength training exercises that require shorter distance pressing or pulling and heavier weight resistance. The 2 to 1 ratio is a disadvantage if the user wants to perform some functional training exercises that require long distance pressing or pulling and light weight resistance.

Having a separate exercise machine for lighter weight functional training and a separate exercise machine for heavier weight strength training would be to costly and require too much room to house the equipment. Also, manufacturing an exercise machine that is too tall to allow more cable travel is not practical because of height restrictions. Thus, there is a need for an exercise machine with multi positionable exercise arms that will provide alternate resistance ratios for light weight functional training and heavier weight strength training.

SUMMARY

The present invention is directed to an exercise apparatus that includes at least one multi positionable arm assembly that provides multiple resistance ratios for functional and strength training. The exercise apparatus comprises a frame, a resistance element, at least one multi positionable arm assembly, and a flexible connecting assembly which includes at least two flexible connector ends which exit near the distal end of one multi positionable arm assembly. A handle or other attachment can be connected to one or more of the flexible connector ends for pressing or pulling by the user. The flexible connecting assembly connects the resistance element to the handle or other attachment. In one exemplary embodiment, two multi positionable arm assemblies are pivotally attached to the frame, the resistance element is a weight stack, and the flexible connecting assembly is a cable assembly.

In one embodiment, one multi positionable arm assembly includes two or more cable ends exiting near its distal end wherein each cable end, when pressed or pulled, will provide an alternate resistance ratio to the user. For example, one cable end is interconnected with resistance wherein the pressing or pulling of this cable end will provide a 4 to 1 mechanical advantage to the user. A second cable end is interconnected with resistance wherein pressing or pulling of this cable end will provide a 2 to 1 mechanical advantage to the user. A third cable end is interconnected with resistance wherein pressing or pulling of this cable end will provide a direct 1 to 1 ratio resistance. Additional cable ends could also be included to provide other alternate resistance ratios when pressed or pulled. Also, multiple cable ends can be connected to one handle wherein pressing or pulling of these cable ends will provide yet another alternate ratio of resistance.

In an alternate embodiment, one multi positionable arm assembly includes two or more cable ends exiting near its distal end wherein each cable end, when pressed or pulled, will provide the same resistance ratio to the user. For example, one cable end is interconnected with resistance wherein the pressing or pulling of this cable end will provide a 4 to 1 mechanical advantage to the user. A second cable end is interconnected with resistance wherein pressing or pulling of this cable end will also provide a 4 to 1 mechanical advantage to the user. A user could connect both of these cable ends to one handle and obtain a 2 to 1 mechanical advantage. Additional cable ends can also be added which are connected to resistance wherein the pressing or pulling of one individual cable end provides the same resistance ratio as any of the other cable ends which exit the multi positionable arm assembly.

In another alternate embodiment, one multi positionable arm assembly includes at least two cable ends exiting near its distal end wherein each cable end, when pressed or pulled, will provide the same resistance ratio to the user. This multi positionable arm assembly also includes at least one other cable end exiting near its distal end wherein this cable end will provide an alternate resistance ratio when pressed or pulled. Multiple cable ends can be connected to one handle to provide alternate resistance ratios when pressed or pulled.

In another aspect of the invention, two or more cable ends exit a multi positionable arm assembly near its distal end through one pivotally connected swivel pulley assembly. The swivel pulley assembly includes at least one pulley for each respective cable end and preceding portion to partially wrap around as it exits the multi positionable arm assembly during exercise. The swiveling pulley assembly pivots and aligns into the direction the cable end or ends are being pressed or pulled.

In an alternate embodiment, the above mentioned embodiments can be made with a rigid arm wherein it is not multi positional. The above mentioned embodiments can also be made without a rigid arm wherein the above mentioned cable ends exit swivel pulley assemblies pivotally attached to the frame. The above mentioned embodiments can also be made without swivel pulley assemblies wherein the above mentioned cable ends exit the frame on fixed pulleys. Other aspects of the invention will become apparent in the detailed description.

DETAILED DESCRIPTION

Figure 1:
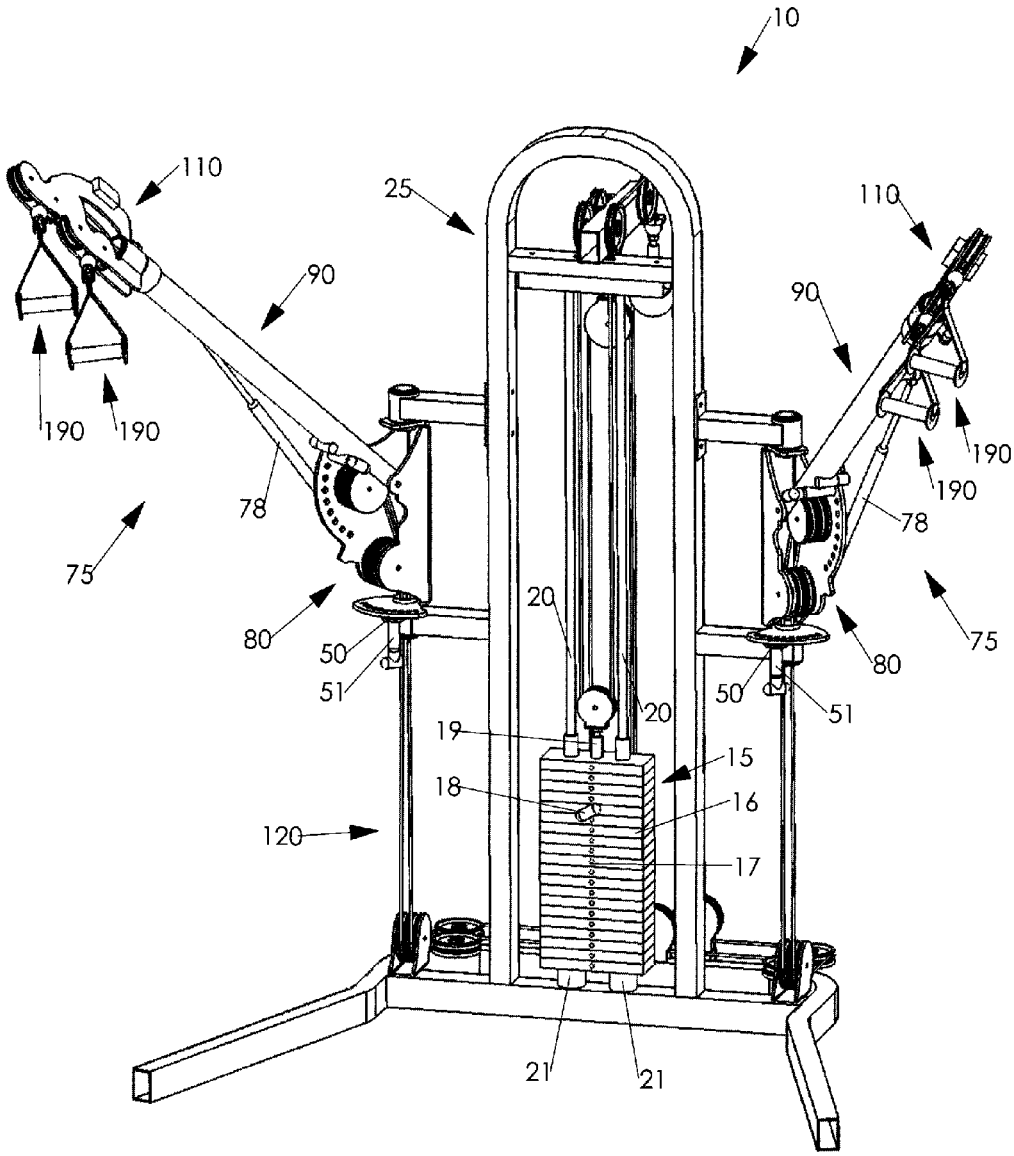
FIG. 1 is a perspective view illustrating an exemplary multi resistance ratio exercise apparatus according to the present invention from the front left side.
Figure 1:
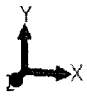

The embodiments illustrated in the drawings is for an exercise apparatus which comprises at least one multi positionable arm assembly which includes at least two flexible connector ends exiting near its distal end. A handle assembly can be connected to one or more of the flexible connector ends. Each flexible connector end may be interconnected with resistance wherein the pressing or pulling of a respective end will provide an alternate ratio of resistance to the user. The user can press or pull the desired flexible connector end or ends based on whether they need lighter resistance and more flexible connector travel for functional training movements or heavier resistance and less flexible connector travel for strength training movements.

Referring now to the drawings, one exemplary and five alternate embodiments of a multi resistance ratio exercise apparatus according to the present invention will be described and indicated generally by the numerals 10, 210, 410, 610, 810, and 1010. Each above mentioned embodiment comprises a resistance element and will be described and indicated generally by the numeral 15. A multi resistance ratio exercise apparatus 10, 210, 410, 610, 810, and 1010 also comprises a frame 25, 225, 425, 625, 825, 1025, at least one multi positionable arm assembly 75, 275, 475, 675, 875, 1075, and a flexible connecting assembly 120, 320, 520, 720, 920,1120 interconnecting at least one handle assembly 190, 195 to the resistance element 15.

The resistance element 15 provides resistance to the force applied when one or more flexible connector ends are pressed or pulled. A weight stack 15 will be described as providing the resistance in the exemplary and alternate embodiments of the multi resistance ratio exercise apparatus 10, 210, 410, 610, 810, and 1010. As illustrated in FIG. 1, the weight stack 15 includes a number of individual weight plates 16 that can be selectively added to and removed from the load picked up by the user to provide variable amounts of resistance. Guide rods 20 extend through apertures in each of the plates 16 and through bumpers 21 which the weight stack 15 rests on. The plates 16 slide vertically along the guide rods 20 as the user exercises. A lifting rod 19 includes a series of apertures (not shown) that align with corresponding apertures 17 in the weight plates 16. The user selects the desired number of plates 16 to be lifted by inserting a pin 18 through the aperture 17 in a selected plate 16 and engages the pin 18 with the aperture in the lifting rod 19. Those skilled in the art will appreciate that other resistance devices, such as electronic resistance devices, magnetic breaks, hydraulic cylinders, elastic bands, free weights or pneumatic resistance may also be used to practice the present invention.

The flexible connecting assembly 120, 320, 520, 720, 920, 1120 interconnects the weight stack 15 with at least one handle assembly 190, 195. A cable assembly 120, 320, 520, 720, 920, 1120 will be described as interconnecting the weight stack 15 with at least one handle assembly 190, 195 in the exemplary and alternate embodiments of the multi resistance ratio exercise apparatus 10, 210, 410, 610, 810, 1010. Those skilled in the art will appreciate that other flexible connecting assemblies such as belts, chains, cords, or rope may be used to practice the present invention. Also, those skilled in the art will appreciate that there are many different cable end assemblies that can be used to provide a rest position for a cable end as well as attachment means for a handle assembly.

Figure 2:
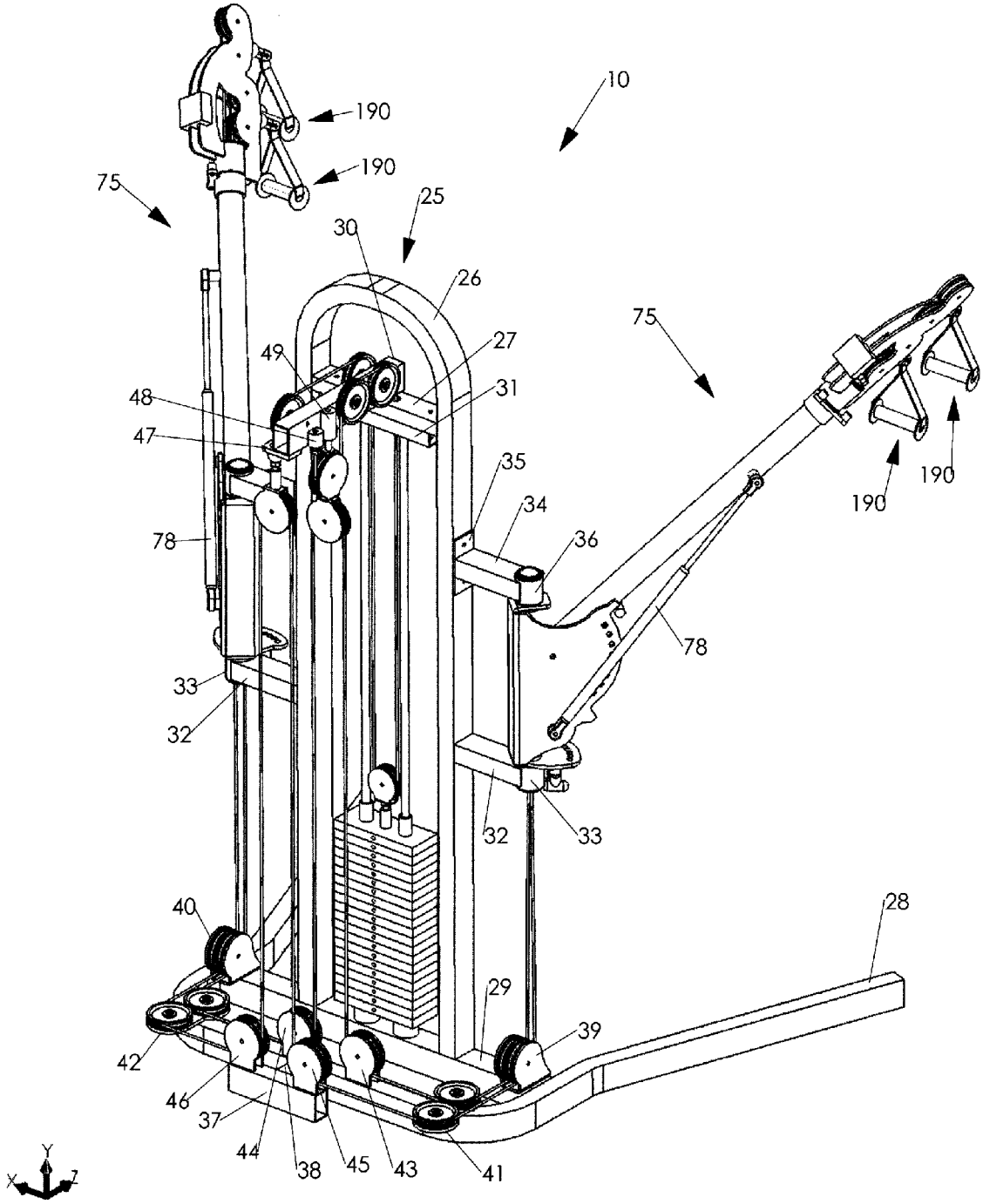
FIG. 2 is a perspective view illustrating an exemplary multi resistance ratio exercise apparatus according to the present invention from the back right side.
Figure 4:
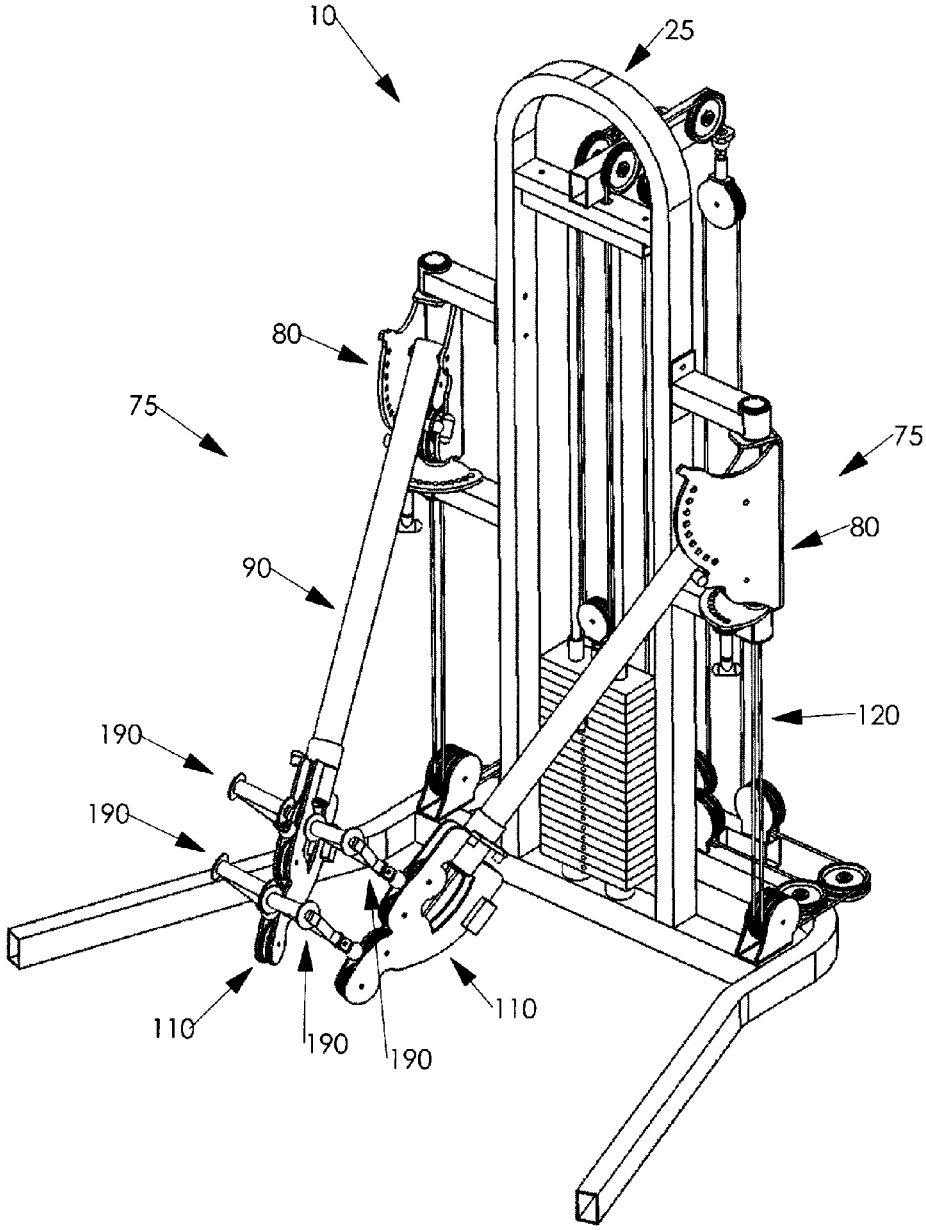
FIG. 4 is a perspective view illustrating an exemplary multi resistance ratio exercise apparatus with two multi positionable arm assemblies adjusted to a lowered and inner position according to the present invention from the front left side.
Figure 4:
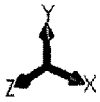

FIGS. 1, 2, and 4 illustrate an exemplary multi resistance ratio exercise apparatus 10 which comprises a weight stack 15 to provide resistance, a frame 25 to provide structural support and stability, two multi positionable arm assemblies 75, cable assembly 120, and handle assemblies 190. FIG. 1 illustrates multi resistance ratio exercise apparatus 10 from the front wherein both multi positionable arm assemblies 75 are adjusted to an upper and outer position. FIG. 2 illustrates multi resistance ratio exercise apparatus 10 from the back wherein both multi positionable arm assemblies 75 are adjusted to an upper and outer position. FIG. 4 illustrates multi resistance ratio exercise apparatus 10 from the front wherein both multi positionable arm assemblies 75 are adjusted to a lower and inner position.

The frame 25 may have a variety of configurations depending on the specific application. In one embodiment, as shown in FIGS. 1, 2, and 4, the frame 25 includes a weight stack cage 26, which houses the weight stack 15, and sits on cage bottom 29, which secures the bottom of guide rods 20. Frame bottom 28 attaches to cage bottom 29 and provides stability to multi resistance ratio exercise apparatus 10. Cross member 27 is attached to near the top of weight stack cage 26 and secures guide rod tube 31 which secures the tops of guide rods 20. Respective side tubes 32 and respective bushing tubes 33 are attached to the outsides of weight stack cage 26 and provide a bottom resting and pivot point for respective multi positionable arm assemblies 75. Respective locking pin brackets 50 are attached to the front of respective side tubes 32 and secure respective locking pins 51 which secure respective multi positionable arm assemblies 75 into the desired position. This adjustment will be discussed in more detail later. Respective upper side tubes 34 along with respective end plates 35 and respective bushing tubes 36 are secured to the outsides of weight stack cage 26 and provide an upper attachment and pivot point for respective multi positionable arm assemblies 75.

Figure 3:
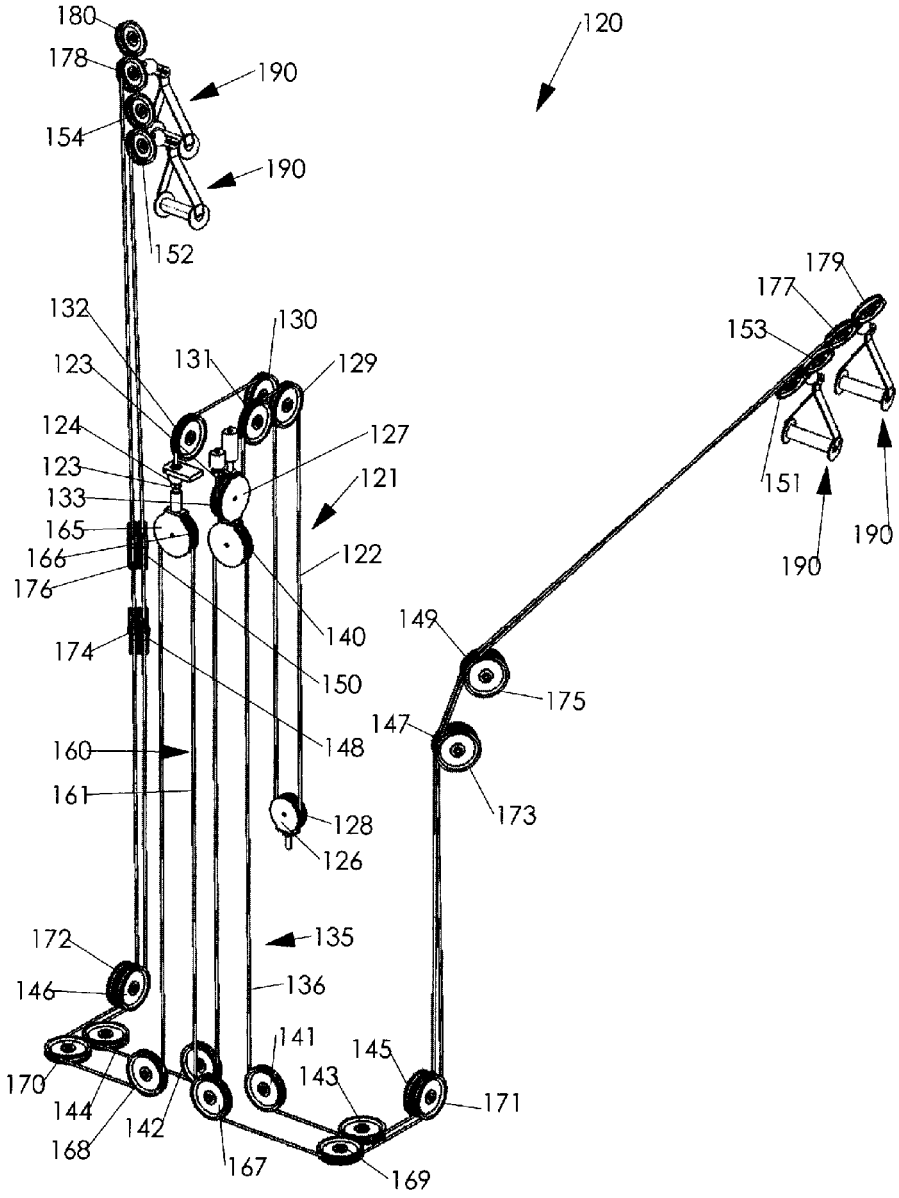
FIG. 3 is a perspective view illustrating the cable and pulley system of an exemplary multi resistance ratio exercise apparatus according to the present invention from the back right side.

The frame 25 further includes extension tube 38 and cross tube 37 which are attached to the back of frame bottom 28. As illustrated in FIGS. 2 and 3, pulley plates 45 and 46 are attached on top of cross tube 37 and secure pulleys 167 and 168. Pulley plates 43 and 44 are attached on top of frame bottom 28 and secure pulleys 141 and 142. Pulley horizontal plates 41 and 42 also are attached on top of frame bottom 28 and secure pulleys 143, 169, 144, and 170. Pulley brackets 39 and 40 are attached on top of cage bottom 29 and secure pulleys 145, 171, 146, and 172.

The frame 25 further includes frame top tube 30 which is attached on top of cross member 27 and secures pulleys 129, 130, 131, and 132. Leveler lockout 49 is attached to the side of frame top tube 30 and prevents double free floater 127 from upwards travel. Cable retainer 48 is attached to the side of frame top tube 30 and secures one end of cable assembly 121. Stop member plate 47 is attached underneath frame top tube 30 and prevents stop member 124 from upwards travel.

Figure 6:
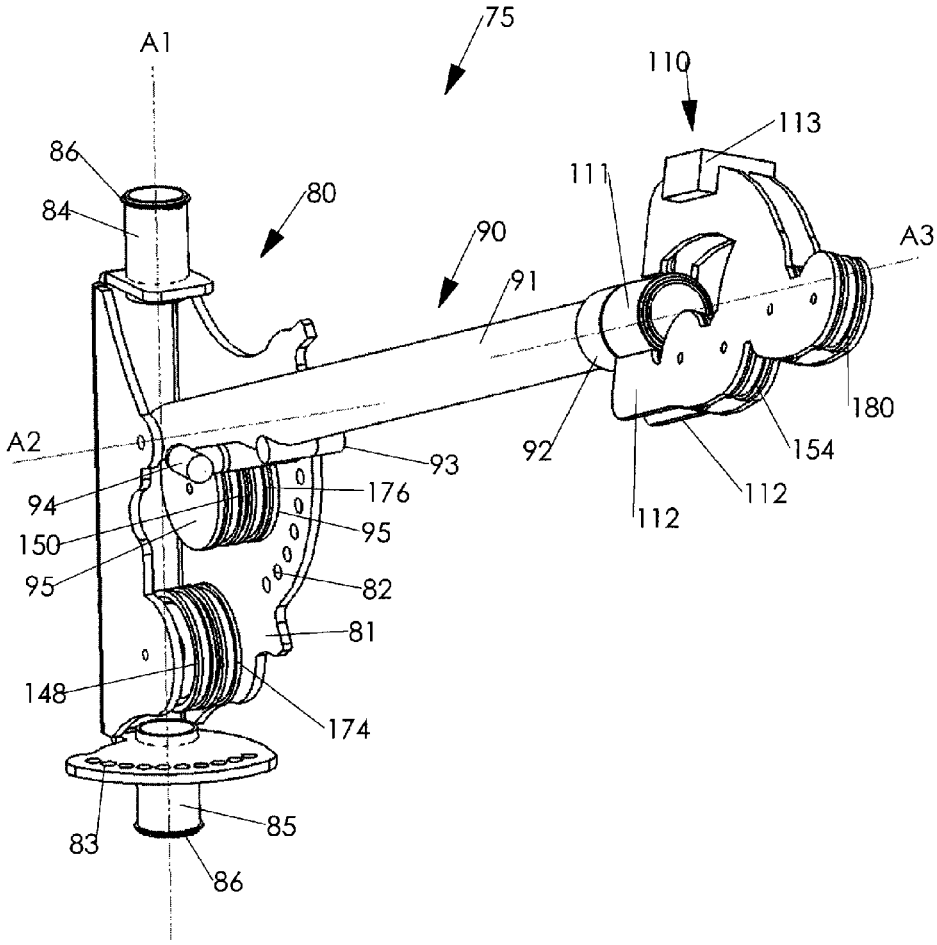
FIG. 6 is a perspective view illustrating an exemplary multi positionable arm assembly according to the present invention from the front right side.
Figure 6:
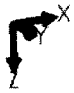
Figure 7:
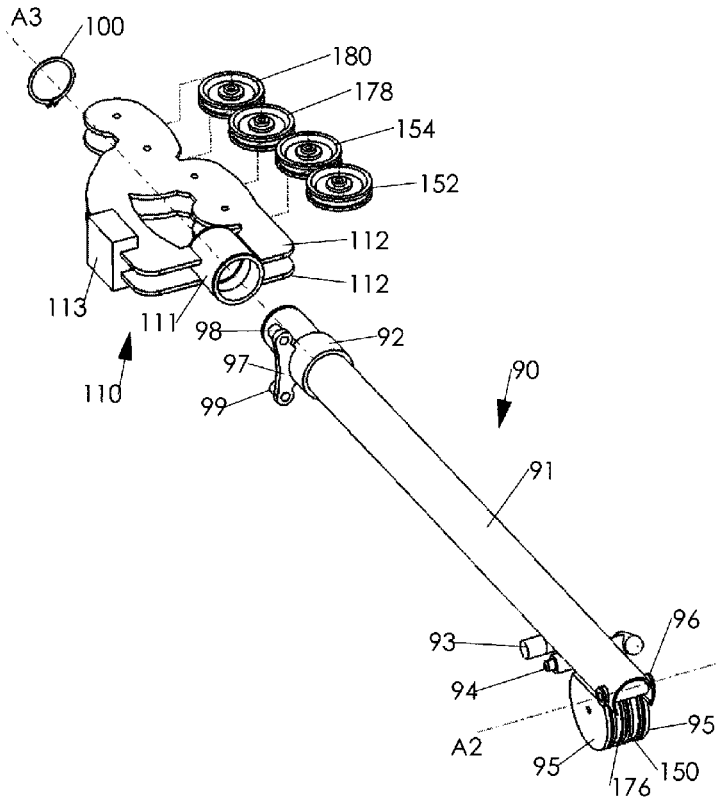
FIG. 7 is an exploded perspective view illustrating an exemplary arm extension assembly and swivel pulley assembly according to the present invention.
Figure 7:
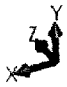

In the exemplary embodiment, the multi resistance ratio exercise apparatus 10 comprises two multi positional arm assemblies 75. The present invention could be made with only one multi positional arm assembly 75 or even three or more. In one embodiment, as shown in FIGS. 6 and 7, a respective multi positional arm assembly 75 comprises a swivel mount assembly 80, an arm extension assembly 90, and a swivel pulley assembly 110.

A respective swivel mount assembly 80 is pivotally attached to the frame 25 and is rotatable about an axis labeled A1. A respective swivel mount assembly 80 comprises bracket 81 which has apertures 82 formed therein as well as apertures 83 formed therein. Pivot sleeves 84 and 85 are attached to respective ends of bracket 81 and pivotally attach swivel mount assembly 80 to respective bushing tubes 33 and 36 of frame 25. Retaining rings 86 secure swivel mount assembly 80 to frame 25. Respective swivel mount assemblies 80 secure respective pulleys 148, 174, 147, and 173. Swivel mount assemblies 80 also provide a pivot point, with an axis of rotation labeled A2, for the arm extension assemblies 90.

A respective arm extension assembly 90 comprises extension tube 91 wherein bushing tube 96, with an axis of rotation labeled A2, is attached near one end and provides the pivot point for mounting onto the swivel mount assembly 80. Arm extension assemblies 90 also include pulley plates 95, which are attached near a respective bushing tube 96, and also secure respective pulleys 150,176, 149, and 175. A respective arm extension assembly 90 further includes locking pin 94 which is attached to extension tube 91 near pulley plates 95 and secures arm extension assembly 90 into the desired position when engaged with one of the apertures 82 in swivel mount assembly 80. Bumper 93 is attached to extension tube 91 near locking pin 94 and engages bracket 81 of swivel mount assembly 80 at upper and lower points to prevent over rotation of extension arm assembly 90. Sleeve stop 92 is attached near the other end of extension tube 91 and prevents swivel pulley assembly 110 from sliding down extension tube 91. Bumpers 98 and 99 are attached to bumper plate 97 which is attached to sleeve stop 92. Retaining ring 100 secures the swivel pulley assembly 110 to the arm extension assembly 90. Also, a respective gas assist cylinder 78 is attached to a respective swivel mount assembly 80 on one end and to a respective arm extension assembly 90 on the other end to counter the weight of a respective arm extension assembly 90.

A respective swivel pulley assembly 110 is pivotally attached to a respective arm extension assembly 90 and is rotatable about an axis labeled A3. A respective swivel pulley assembly 110 comprises bushing tube 111 which provides the pivot point for mounting onto extension tube 91. Swivel pulley assemblies 110 also include pulley plates 112, which are attached to respective bushing tubes 111, and also secure respective pulleys 152, 154, 178, 180, 151, 153, 177, and 179. Counter weight 113 is attached to pulley plates 112 and balances the weight of the swivel pulley assembly 110 about axis A3.

Figure 5:
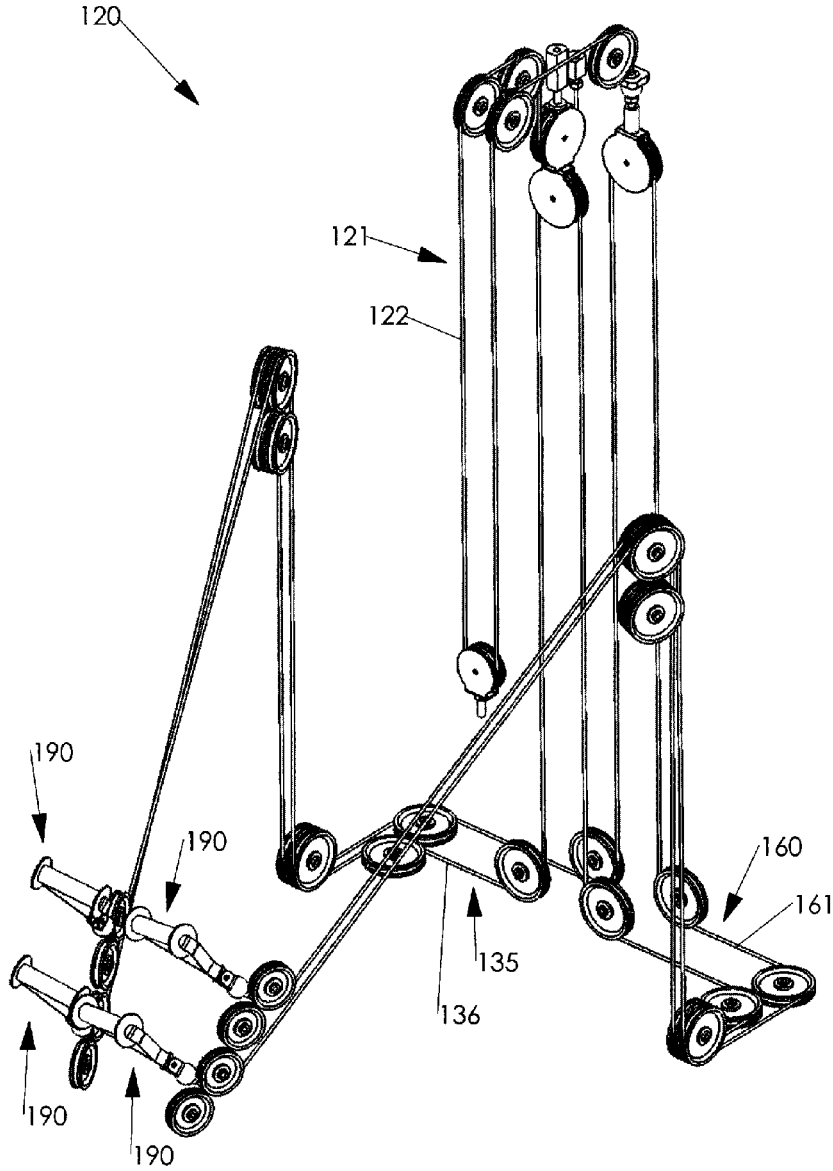
FIG. 5 is a perspective view illustrating the cable and pulley system of an exemplary multi resistance ratio exercise apparatus with two multi positionable arm assemblies adjusted to a lowered and inner position according to the present invention from the front left side.
Figure 5:
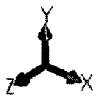

In the exemplary embodiment, as illustrated in FIGS. 3 and 5, cable assembly 120 includes cable assembly 121, cable assembly 135, cable assembly 160, weight stack pulley bracket 126, double pulley free floater 127 and single pulley free floater 165. Cable assembly 121 is directly connected with the weight stack 15 and serves as a main cable sector wherein cable assemblies 135 and 160 can tap into and interconnect with resistance.

Cable assembly 121 comprises cable 122 which includes stop member 124 and cable bolt 123 attached at one end and cable bolt 123 attached at the other end. Cable 122 is routed through stop member plate 47 then over fixed pulleys 132 and 130, then downward and around pulley 128 in weight stack pulley bracket 126. Cable 122 is then routed upwards and over fixed pulleys 129 and 131, then downwards and around pulley 133 in double pulley free floater 127. This end of cable 122 is then retained by cable retainer 48. Stop member plate 47 prohibits upward travel of the other end of cable 122 by bracing against stop member 124.

Cable assembly 135 comprises cable 136 which includes respective cable end assemblies 200 (shown in FIG. 33) attached at respective ends. Generally, the middle section of cable 136 is routed around pulley 140 in double pulley free floater 127. Respective sides of cable 136 are then routed downward and around fixed pulleys 141 and 142, then outward around fixed pulleys 143 and 144. Cable 136 is then routed around fixed pulleys 145 and 146, then upward and over pulleys 147 and 148 in respective swivel mount assembly's 80. Cable 136 is then routed over pulleys 149 and 150 in respective arm extension assembly's 90, then outward and around pulleys 151 and 152 in respective swivel pulley assembly's 110. This is where respective ends of cable assembly 135 exit near a respective distal end of a respective multi positionable arm assembly 75. Respective stop members 201 provide a rest position to respective cable ends of cable 136 when not in use. A respective handle assembly 190 can be attached to one or both ends of cable assembly 135. Pulleys 153 and 154 in respective swivel pulley assembly's 110 serve as guide pulleys when cable assembly 135 is pressed or pulled. When one end of cable assembly 135 is pressed or pulled, double pulley free floater 127 is pulled downward which causes cable assembly 121 to lift weight stack 15 therefore providing a 2 to 1 mechanical advantage to the user. When both ends of cable assembly 135 is pressed or pulled, double pulley free floater 127 is pulled downward which causes cable assembly 121 to lift weight stack 15 therefore providing a 1 to 1 ratio of resistance to the user.

Cable assembly 160 comprises cable 161 which includes respective cable end assemblies 200 (shown in FIG. 33) attached at respective ends. Generally, the middle section of cable 161 is routed around pulley 166 in single pulley free floater 165. Respective sides of cable 161 are then routed downward and around fixed pulleys 167 and 168, then outward around fixed pulleys 169 and 170. Cable 161 is then routed around fixed pulleys 171 and 172, then upward and over pulleys 173 and 174 in respective swivel mount assembly's 80. Cable 161 is then routed over pulleys 175 and 176 in respective arm extension assembly's 90, then outward and around pulleys 177 and 178 in respective swivel pulley assembly's 110. This is where respective ends of cable assembly 160 exit near a respective distal end of a respective multi positionable arm assembly 75. Respective stop members 201 provide a rest position to respective cable ends of cable 161 when not in use. A respective handle assembly 190 can be attached to one or both ends of cable assembly 160. Pulleys 179 and 180 in respective swivel pulley assembly's 110 serve as guide pulleys when cable assembly 160 is pressed or pulled. When one end of cable assembly 160 is pressed or pulled, single pulley free floater 165 is pulled downward which causes cable assembly 121 to lift weight stack 15 therefore providing a 4 to 1 mechanical advantage to the user. When both ends of cable assembly 160 are pressed or pulled, single pulley free floater 165 is pulled downward which causes cable assembly 121 to lift weight stack 15 therefore providing a 2 to 1 mechanical advantage to the user.

Figure 33:
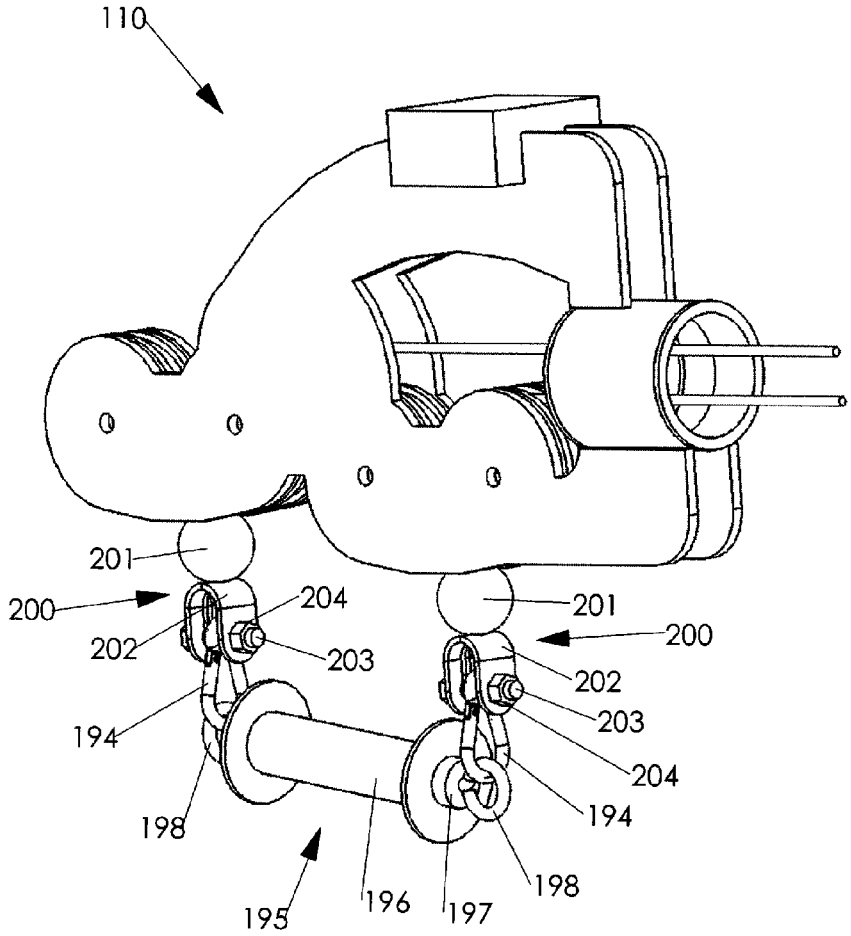
FIG. 33 is a perspective view illustrating one exemplary swivel pulley assembly wherein two cable ends are connected to one alternate handle.
Figure 33:
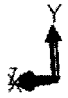

As previously described, the cable end assemblies 200 provide attachment points for handle assemblies 190. As shown in FIG. 33, cable end assembly 200 comprises stop member 201 and strap 202. Shank ball 205 (not shown) is squeezed on respective cable ends and retain stop member 201 and strap 202. Nut 204 secures bolt 203 onto strap 202. Bolt 203 provides an attachment point for handle assembly 190 or any other type of handle assembly.

FIG. 33 also illustrates an alternate handle assembly 195 that can be used to connect more than one cable end to one handle assembly to provide additional ratios of resistance when pressed or pulled. Handle assembly 195 comprises handle 196 which fits over shaft 197. A round hook 198 is secured to each end of shaft 197. A snap hook 194 can be connected to each round hook 198 which can be used to connect handle assembly 195 to multiple cable ends.

To exercise with the multi resistance ratio exercise apparatus 10, the user will rotate the multi positional arm assemblies 75 about axes A1 into the desired width position.

Respective portions of cable assemblies 135 and 160 are routed along side of a respective axis A1 and self align with respective fixed pulleys 145, 171, 146, and 172 of frame 25 and respective moveable pulleys 147, 173, 148, and 174 of swivel mount assemblies 80 when the multi positional arm assemblies 75 are rotated. This will allow the cable assembly 120 to maintain a substantially constant tension. A respective multi positional arm assembly 75 can be secured into position by engaging the desired respective aperture 83 of a respective swivel mount assembly 80 with a respective locking pin 51 of frame 25. The user will then rotate the arm extension assemblies 90 about axes A2 into the desired height position. A point near the perimeter of moveable pulleys 149, 175, 150, and 176 of arm extension assemblies 90 pivots about a respective axis A2 which allows cable assembly 120 to maintain a substantially constant tension when the arm extension assemblies 90 are rotated. A respective arm extension assembly 90 can be secured into position by engaging the desired respective aperture 82 of a respective swivel mount assembly 80 with a respective locking pin 94 of a respective arm extension assembly 90.

The user will then select one or more desired handle assemblies to press or pull and also select the desired resistance. The desired resistance will be selected from the weight stack 15 however the user can alter the ratio of resistance selected by attaching the desired handle assembly to the appropriate cable assembly end or ends. A lower ratio of resistance will allow more cable travel which is typically needed for functional training exercises. A higher ratio of resistance will provide more resistance for strength training movements wherein long cable travel is not required. In this embodiment, if handle assembly 190 is selected, the user can attach one handle assembly 190 to one end of cable assembly 135 and receive a 2 to 1 mechanical advantage when the handle assembly 190 is pressed or pulled. If respective handle assemblies 190 are attached to respective ends of cable assembly 135 and both are pressed or pulled, the user will be exercising with a 1 to 1 ratio of resistance. The user can attach one handle assembly 190 to one end of cable assembly 160 and receive a 4 to 1 mechanical advantage when the handle assembly 190 is pressed or pulled. If respective handle assemblies 190 are attached to respective ends of cable assembly 160 and both are pressed or pulled, the user will be exercising with a 2 to 1 ratio of resistance. If more resistance is desired, the user can select handle assembly 195 and attach it to one end of cable assembly 135 as well as to one end of cable assembly 160 and press or pull both cable assembly ends at the same time with one handle assembly.

While exercising, swivel pulley assemblies 110 will rotate about axes A3 in the direction that the user is pressing or pulling the selected handle assemblies. Respective portions of cable assemblies 135 and 160 are routed along side of a respective axis A3 and self align with respective moveable pulleys 149, 175, 150, and 176 of arm extension assemblies 90 and respective moveable pulleys 151, 177, 152, and 178 of swivel pulley assemblies 110 when the swivel pulley assemblies 110 rotate during exercise. This will allow the cable assembly 120 to maintain a substantially constant tension.

Those skilled in the art will appreciate that modifications to this embodiment can be made without departing from the scope of the invention. An alternate frame configuration could be used. Different ratios of resistance other than those shown can be used. Also, an alternate configuration of cables and pulleys could be used. For example, more cable assemblies could be used to tap into the main cable sector to provide additional cable ends that exit near the distal end of a multi positional arm assembly 75. These cable assembly ends can be made to have alternate, identical, or a combination of ratios of resistance when pressed or pulled. Also, alternate handle assemblies could be used. Also, one or more multi positional arm assemblies 75 could be used. Also, more than one weight stack could be used. For example, each multi positional arm assembly 75 could have its own weight stack. Also, multiple cable ends that exit near the distal end of the same multi positional arm assembly can originate from multiple weight stacks or multiple resistance sources. Also, the arm assemblies could be in a fixed position, therefore not adjustable.

Figure 8:
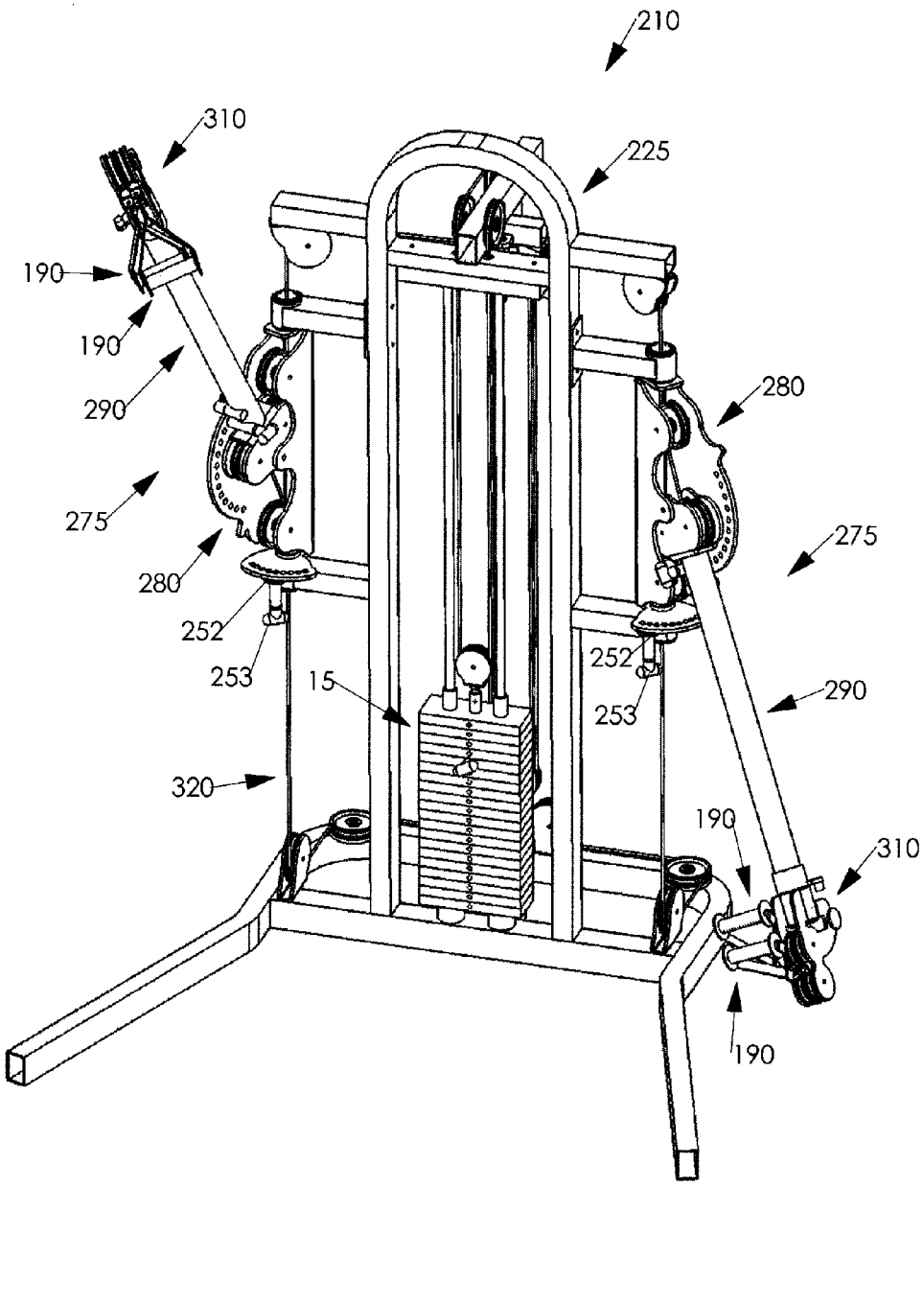
FIG. 8 is a perspective view illustrating an alternate embodiment multi resistance ratio exercise apparatus from the front left side.
Figure 9:
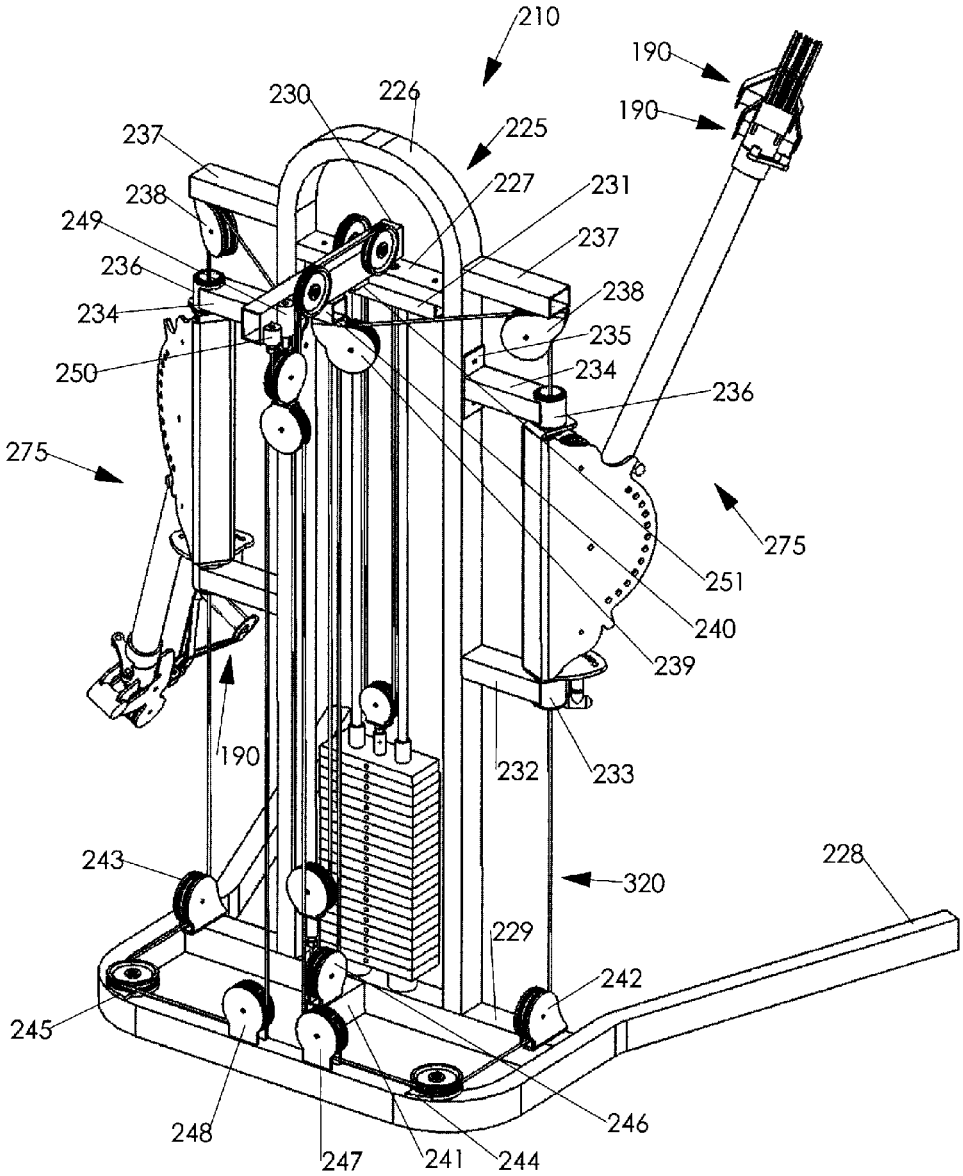
FIG. 9 is a perspective view illustrating an alternate embodiment multi resistance ratio exercise apparatus from the back right side.

FIGS. 8 and 9 illustrate an alternate embodiment of a multi resistance ratio exercise apparatus which is generally indicated by the numeral 210 and which comprises a weight stack 15 to provide resistance, a frame 225 to provide structural support and stability, two multi positionable arm assemblies 275, cable assembly 320, and handle assemblies 190. FIG. 8 illustrates multi resistance ratio exercise apparatus 210 from the front wherein one multi positionable arm assembly 275 is adjusted to an upper and generally middle width position and a second multi positional arm assembly 275 is adjusted to a lower and generally outer width position. FIG. 9 illustrates multi resistance ratio exercise apparatus 210 from the back.

The frame 225 may have a variety of configurations depending on the specific application. In one embodiment, as shown in FIGS. 8 and 9, the frame 225 includes a weight stack cage 226, which houses the weight stack 15, and sits on cage bottom 229, which secures the bottom of guide rods 20. Frame bottom 228 attaches to cage bottom 229 and provides stability to multi resistance ratio exercise apparatus 210. Cross member 227 is attached to near the top of weight stack cage 226 and secures guide rod tube 231 which secures the tops of guide rods 20. Respective side tubes 232 and respective bushing tubes 233 are attached to the outsides of weight stack cage 26 and provide a bottom resting and pivot point for respective multi positionable arm assemblies 275. Respective locking pin brackets 252 are attached to the front of respective side tubes 232 and secure respective locking pins 253 which secure respective multi positionable arm assemblies 275 into the desired position. This adjustment will be discussed in more detail later. Respective upper side tubes 234 along with respective end plates 235 and respective bushing tubes 236 are secured to the outsides of weight stack cage 226 and provide an upper attachment and pivot point for respective multi positionable arm assemblies 275. Respective upper pulley tubes 237 are attached to the outsides of weight stack cage 226 and provide an attachment point for respective pulley brackets 238.

Figure 10:
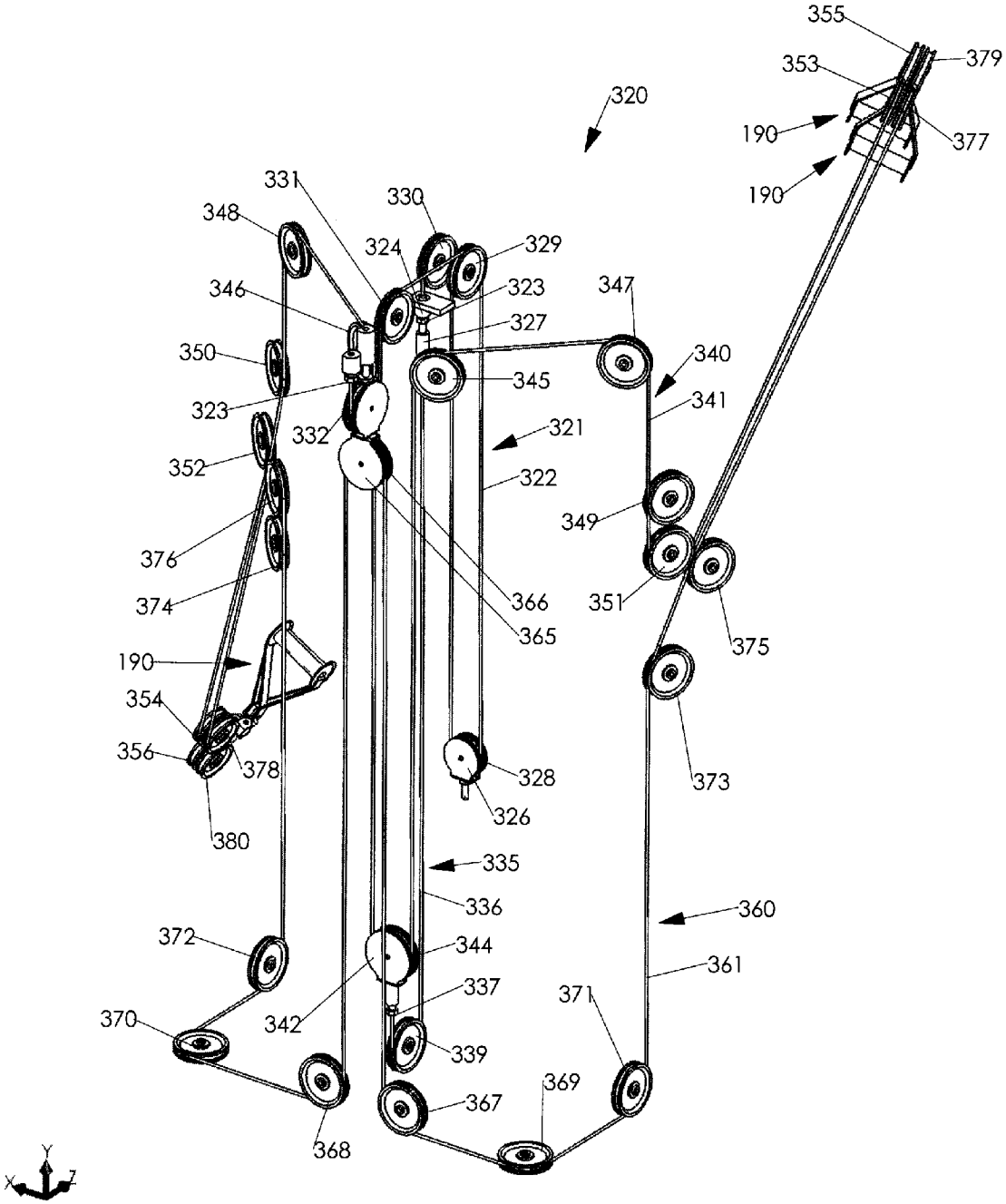
FIG. 10 is a perspective view illustrating the cable and pulley system of an alternate embodiment multi resistance ratio exercise apparatus from the back right side.

The frame 225 further includes extension tube 241 which is attached to the back of cage bottom 229. As illustrated in FIGS. 9 and 10, pulley plates 246 are attached on top of extension tube 241 and secures pulley 339. Pulley plates 247 and 248 are attached on top of frame bottom 228 and secure pulleys 367 and 368. Pulley horizontal plates 244 and 245 also are attached on top of frame bottom 228 and secure pulleys 369 and 370. Pulley brackets 242 and 243 are attached on top of cage bottom 229 and secure pulleys 371 and 372.

The frame 225 further includes frame top tube 230 which is attached on top of cross member 227 and secures pulleys 329, 330 and 331. Leveler lockout 249 is attached to the side of frame top tube 30 and prevents double free floater 365 from upwards travel. Cable retainer 250 is attached to the side of frame top tube 30 and secures one end of cable assembly 321. Stop member plate 251 is attached underneath frame top tube 30 and prevents stop member 324 from upwards travel. Cross member 240 is attached underneath frame top tube 30 and provides attachment points for respective pulley brackets 239 which secure pulleys 345 and 346.

Figure 11:
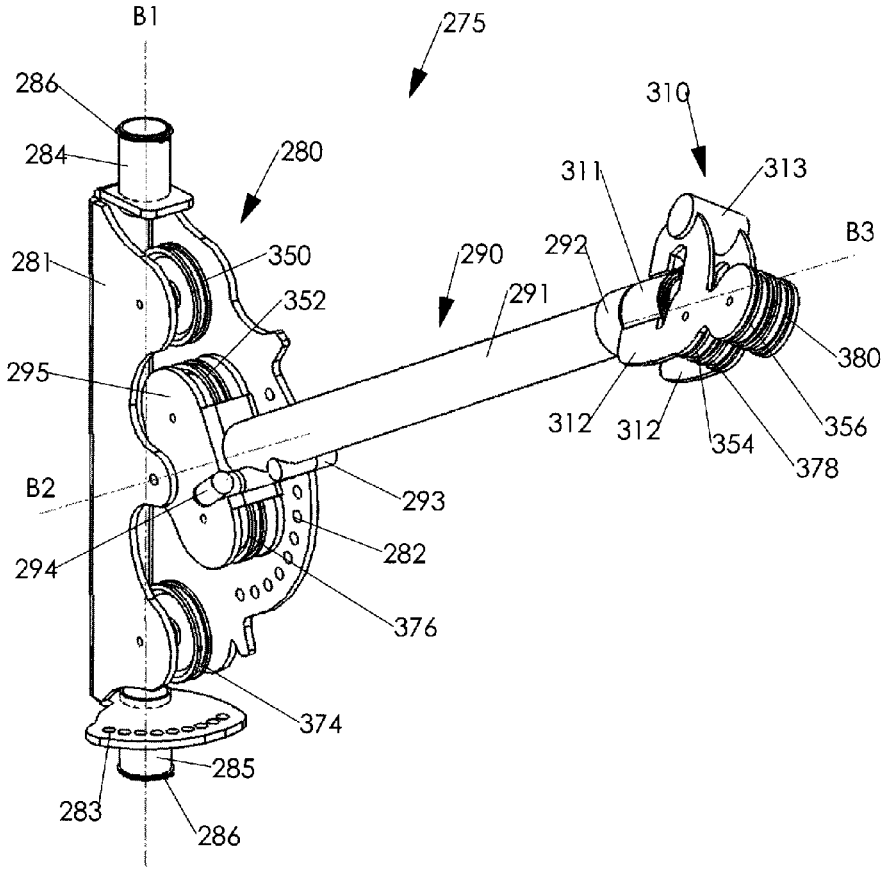
FIG. 11 is a perspective view illustrating an alternate embodiment multi positionable arm assembly from the front left side.
Figure 11:
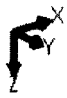
Figure 12:
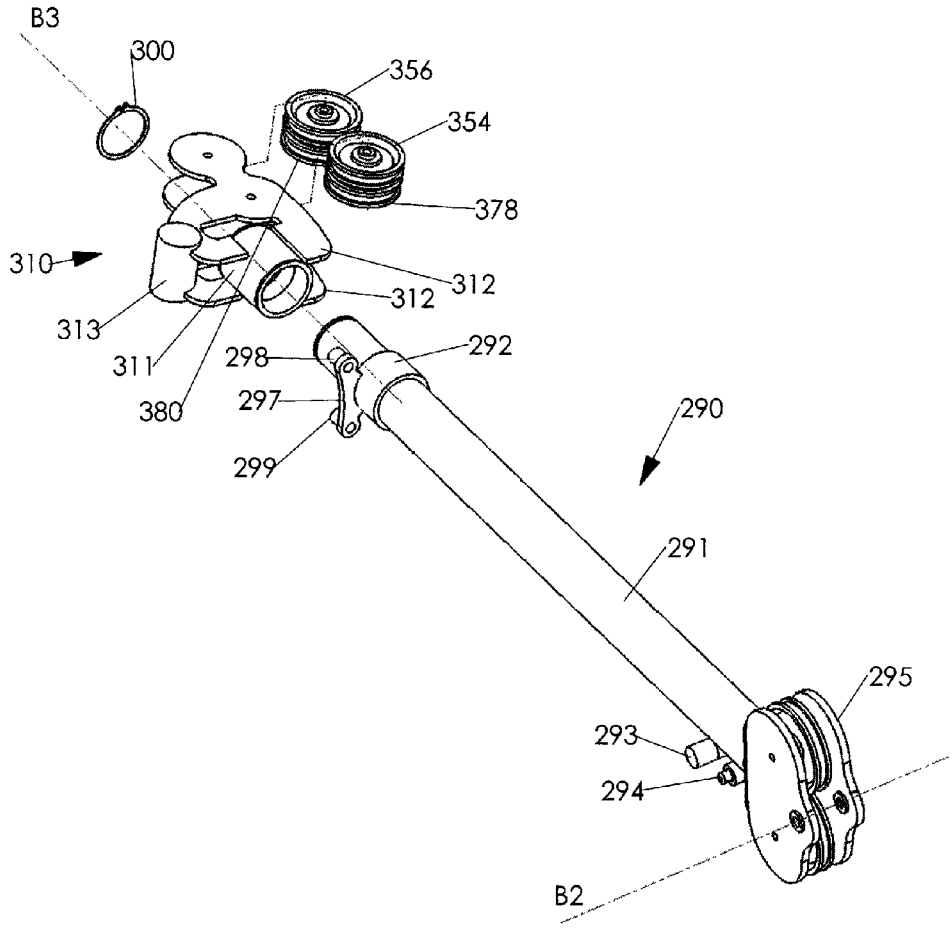
FIG. 12 is an exploded perspective view illustrating an alternate arm extension assembly and swivel pulley assembly.
Figure 12:
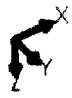

In this embodiment, the multi resistance ratio exercise apparatus 210 comprises two multi positional arm assemblies 275. The present invention could be made with only one multi positional arm assembly 275 or even three or more. In one embodiment, as shown in FIGS. 11 and 12, a respective multi positional arm assembly 275 comprises a swivel mount assembly 280, an arm extension assembly 290, and a swivel pulley assembly 310.

A respective swivel mount assembly 280 is pivotally attached to the frame 225 and is rotatable about an axis labeled B1. A respective swivel mount assembly 280 comprises bracket 281 which has apertures 282 formed therein as well as apertures 283 formed therein. Pivot sleeves 284 and 285 are attached to respective ends of bracket 281 and pivotally attach swivel mount assembly 280 to respective bushing tubes 233 and 236 of frame 225. Retaining rings 286 secure swivel mount assembly 280 to frame 225. Respective swivel mount assemblies 280 secure respective pulleys 350, 374, 349, and 373. Swivel mount assemblies 280 also provide a pivot point, with an axis of rotation labeled B2, for the arm extension assemblies 290.

A respective arm extension assembly 290 comprises extension tube 291 wherein bushing pulley bracket 295, with an axis of rotation labeled B2, is attached at one end and provides the pivot point for mounting onto the swivel mount assembly 280. Bushing pulley brackets 295 also secure respective pulleys 352, 376, 351, and 375. A respective arm extension assembly 290 further includes locking pin 294 which is attached to extension tube 291 near bushing pulley bracket 295 and secures arm extension assembly 290 into the desired position when engaged with one of the apertures 282 in swivel mount assembly 280. Bumper 293 is attached to extension tube 291 near locking pin 294 and engages bracket 281 of swivel mount assembly 280 at upper and lower points to prevent over rotation of extension arm assembly 290. Sleeve stop 292 is attached near the other end of extension tube 291 and prevents swivel pulley assembly 310 from sliding down extension tube 291. Bumpers 298 and 299 are attached to bumper plate 297 which is attached to sleeve stop 292. Retaining ring 300 secures the swivel pulley assembly 310 to the arm extension assembly 290.

A respective swivel pulley assembly 310 is pivotally attached to a respective arm extension assembly 290 and is rotatable about an axis labeled B3. A respective swivel pulley assembly 310 comprises bushing tube 311 which provides the pivot point for mounting onto extension tube 291. Swivel pulley assemblies 310 also include pulley plates 312, which are attached to respective bushing tubes 311, and also secure respective pulleys 354, 356, 378, 380, 353, 355, 377, and 379. Counter weight 313 is attached to pulley plates 312 and balances the weight of the swivel pulley assembly 310 about axis B3.

In this embodiment, as illustrated in FIG. 10, cable assembly 320 includes cable assembly 321, cable assembly 335, cable assembly 340, cable assembly 360, weight stack pulley bracket 326, single pulley free floater 342, and double pulley free floater 365. Cable assembly 321 is directly connected with the weight stack 15 and serves as a main cable sector wherein cable assemblies 335, 340, and 360 can tap into and interconnect with resistance.

Cable assembly 321 comprises cable 322 which includes stop member 324 and cable bolt 323 attached at one end and cable bolt 323 attached at the other end. Cable 322 is routed through stop member plate 251 then over fixed pulley 330, then downward and around pulley 328 in weight stack pulley bracket 326. Cable 322 is then routed upwards and over fixed pulleys 329 and 331, then downwards and around pulley 332 in double pulley free floater 365. This end of cable 322 is then retained by cable retainer 250. Stop member plate 251 prohibits upward travel of the other end of cable 322 by bracing against stop member 324.

Cable assembly 335 comprises cable 336 which includes respective cable bolts 337 attached on respective ends as well as cable connector 327 which connects one end of cable assembly 335 to cable assembly 321. Cable assembly 335 is then routed downward and around fixed pulley 339 then back upward and connects with single free floater 342 of cable assembly 340.

Cable assembly 340 comprises cable 341 which includes respective cable end assemblies 207 (shown in FIG. 32) attached at respective ends. Generally, the middle section of cable 341 is routed around pulley 344 in single pulley free floater 342. Respective sides of cable 341 are then routed upward and around fixed pulleys 345 and 346, then outward around fixed pulleys 347 and 348. Cable 341 is then routed downwards and guided by pulleys 350 and 349 in respective swivel mount assembly's 280. Cable 341 is then routed over pulleys 352 and 351 in respective arm extension assembly's 290, then outward and around pulleys 354 and 353 in respective swivel pulley assembly's 310. This is where respective ends of cable assembly 340 exit near a respective distal end of a respective multi positionable arm assembly 275. Respective stop members 208 provide a rest position to respective cable ends of cable 341 when not in use. A respective handle assembly 190 can be attached to one or both ends of cable assembly 340. Pulleys 356 and 355 in respective swivel pulley assembly's 310 serve as guide pulleys when cable assembly 340 is pressed or pulled. When one end of cable assembly 340 is pressed or pulled, single pulley free floater 342 is pulled upward which causes cable assembly 321 to lift weight stack 15 therefore providing a 4 to 1 mechanical advantage to the user. When both ends of cable assembly 340 is pressed or pulled, single pulley free floater 342 is pulled upward which causes cable assembly 321 to lift weight stack 15 therefore providing a 2 to 1 ratio of resistance to the user.

Cable assembly 360 comprises cable 361 which includes respective cable end assemblies 207 (shown in FIG. 32) attached at respective ends. Generally, the middle section of cable 361 is routed around pulley 366 in double pulley free floater 365. Respective sides of cable 361 are then routed downward and around fixed pulleys 367 and 368, then outward around fixed pulleys 369 and 370. Cable 361 is then routed around fixed pulleys 371 and 372, then upward and guided by pulleys 373 and 374 in respective swivel mount assembly's 280. Cable 361 is then routed over pulleys 375 and 376 in respective arm extension assembly's 290, then outward and around pulleys 377 and 378 in respective swivel pulley assembly's 310. This is where respective ends of cable assembly 360 exit near a respective distal end of a respective multi positionable arm assembly 275. Respective stop members 208 provide a rest position to respective cable ends of cable 361 when not in use. A respective handle assembly 190 can be attached to one or both ends of cable assembly 360. Pulleys 379 and 380 in respective swivel pulley assembly's 310 serve as guide pulleys when cable assembly 360 is pressed or pulled. When one end of cable assembly 360 is pressed or pulled, double pulley free floater 365 is pulled downward which causes cable assembly 321 to lift weight stack 15 therefore providing a 2 to 1 mechanical advantage to the user. When both ends of cable assembly 360 are pressed or pulled, double pulley free floater 365 is pulled downward which causes cable assembly 321 to lift weight stack 15 therefore providing a 1 to 1 ratio of resistance to the user.

Figure 32:
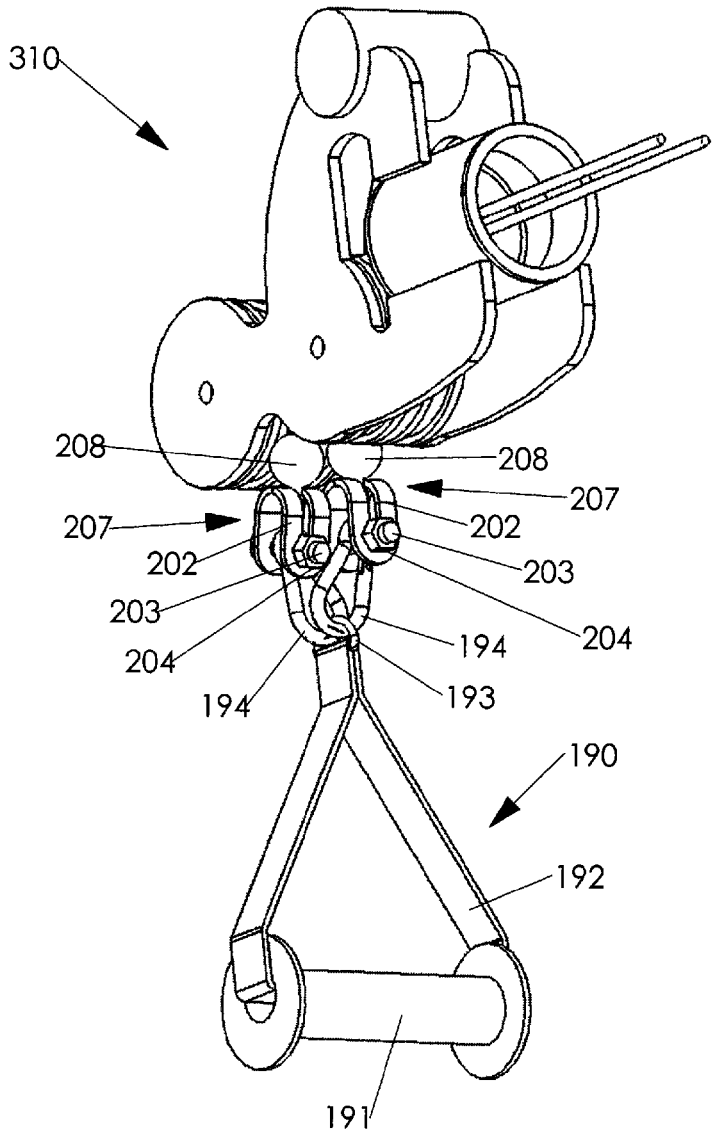
FIG. 32 is a perspective view illustrating one alternate swivel pulley assembly wherein two cable ends are connected to one exemplary handle.
Figure 32:
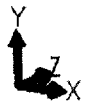

FIG. 32 illustrates how handle assembly 190 can be used to connect more than one cable end to one handle assembly to provide additional ratios of resistance when pressed or pulled.

To exercise with the multi resistance ratio exercise apparatus 210, the user will rotate the multi positional arm assemblies 275 about axes B1 into the desired width position. Respective portions of cable assemblies 340 and 360 are routed in line with a respective axis B1 and align with respective fixed pulleys 347, 371, 348, and 372 of frame 225 and respective moveable pulleys 349, 373, 350, and 374 of swivel mount assemblies 280 when the multi positional arm assemblies 275 are rotated. This will allow the cable assembly 320 to maintain a substantially constant tension. A respective multi positional arm assembly 275 can be secured into position by engaging the desired respective aperture 283 of a respective swivel mount assembly 280 with a respective locking pin 253 of frame 225. The user will then rotate the arm extension assemblies 290 about axes B2 into the desired height position. A point near the perimeter of moveable pulleys 351, 375, 352, and 376 of arm extension assemblies 290 pivots about a respective axis B2 which allows cable assembly 320 to maintain a substantially constant tension when the arm extension assemblies 290 are rotated. A respective arm extension assembly 290 can be secured into position by engaging the desired respective aperture 282 of a respective swivel mount assembly 280 with a respective locking pin 294 of a respective arm extension assembly 290.

The user will then select the desired resistance. The desired resistance will be selected from the weight stack 15 however the user can alter the ratio of resistance selected by attaching handle assembly 190 to the appropriate cable assembly end or ends. A lower ratio of resistance will allow more cable travel which is typically needed for functional training exercises. A higher ratio of resistance will provide more resistance for strength training movements wherein long cable travel is not required. In this embodiment, the user can attach one handle assembly 190 to one end of cable assembly 340 and receive a 4 to 1 mechanical advantage when the handle assembly 190 is pressed or pulled. If respective handle assemblies 190 are attached to respective ends of cable assembly 340 and both are pressed or pulled, the user will be exercising with a 2 to 1 ratio of resistance. The user can attach one handle assembly 190 to one end of cable assembly 360 and receive a 2 to 1 mechanical advantage when the handle assembly 190 is pressed or pulled. If respective handle assemblies 190 are attached to respective ends of cable assembly 360 and both are pressed or pulled, the user will be exercising with a 1 to 1 ratio of resistance. If more resistance is desired, as shown in FIG. 32, the user can attach handle assembly 190 to one end of cable assembly 340 as well as to one end of cable assembly 360 and press or pull both cable assembly ends at the same time with one handle assembly.

While exercising, swivel pulley assemblies 310 will rotate about axes B3 in the direction that the user is pressing or pulling the handle assemblies 190. Respective portions of cable assemblies 340 and 360 are routed along side of a respective axis B3 and self align with respective moveable pulleys 351, 375, 352, and 376 of arm extension assemblies 290 and respective moveable pulleys 353, 377, 354, and 378 of swivel pulley assemblies 310 when the swivel pulley assemblies 310 rotate during exercise. This will allow the cable assembly 320 to maintain a substantially constant tension.

Those skilled in the art will appreciate that modifications to this embodiment can be made without departing from the scope of the invention. An alternate frame configuration could be used. Different ratios of resistance other than those shown can be used. Also, an alternate configuration of cables and pulleys could be used. For example, more cable assemblies could be used to tap into the main cable sector to provide additional cable ends that exit near the distal end of a multi positional arm assembly 275. These cable assembly ends can be made to have alternate, identical, or a combination of ratios of resistance when pressed or pulled. Also, alternate handle assemblies could be used. Also, one or more multi positional arm assemblies 275 could be used. Also, more than one weight stack could be used. For example, each multi positional arm assembly 275 could have its own weight stack. Also, multiple cable ends that exit near the distal end of the same multi positional arm assembly can originate from multiple weight stacks or multiple resistance sources. Also, the arm assemblies could be in a fixed position, therefore not adjustable.

Figure 13:
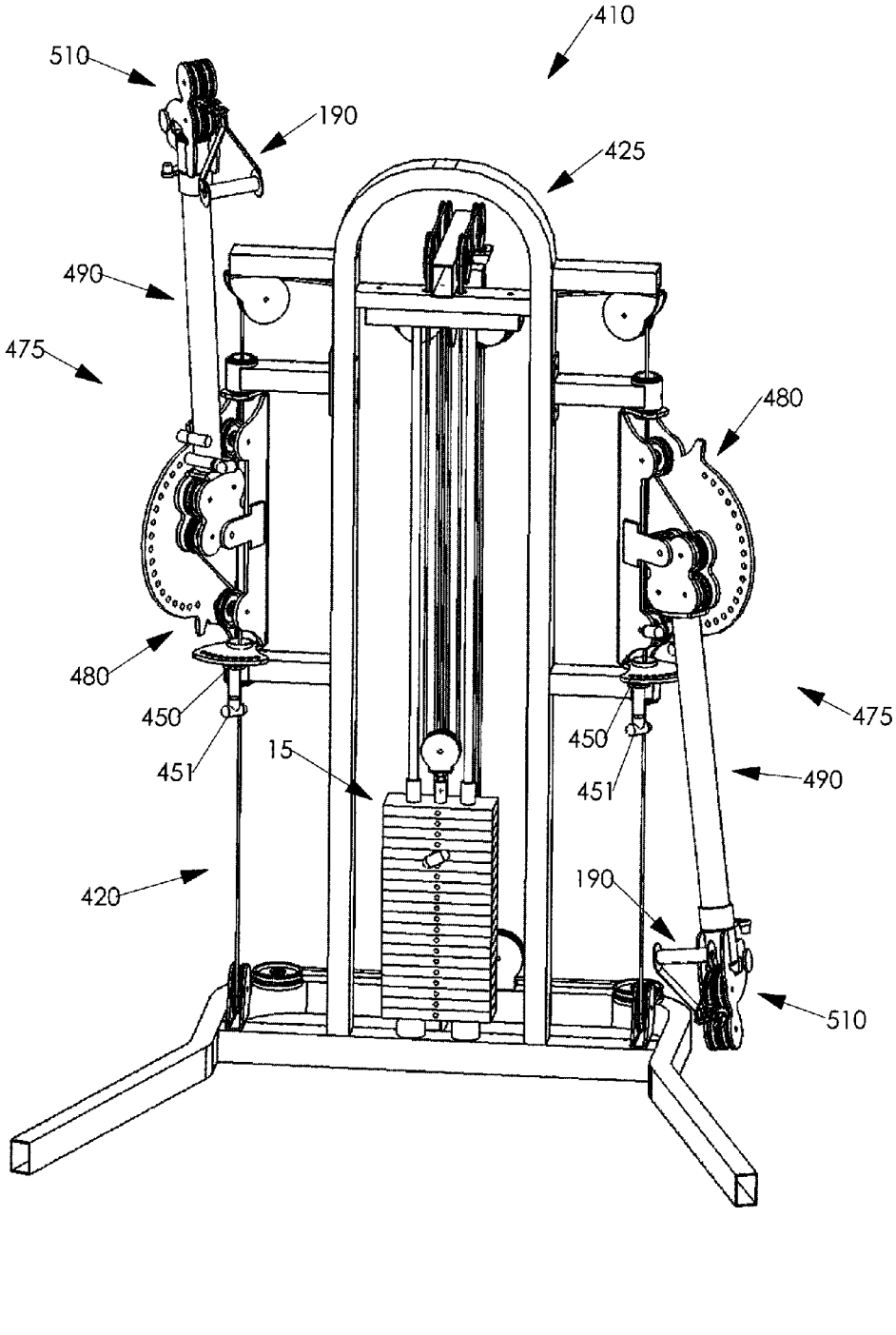
FIG. 13 is a perspective view illustrating an alternate embodiment multi resistance ratio exercise apparatus from the front left side.
Figure 14:
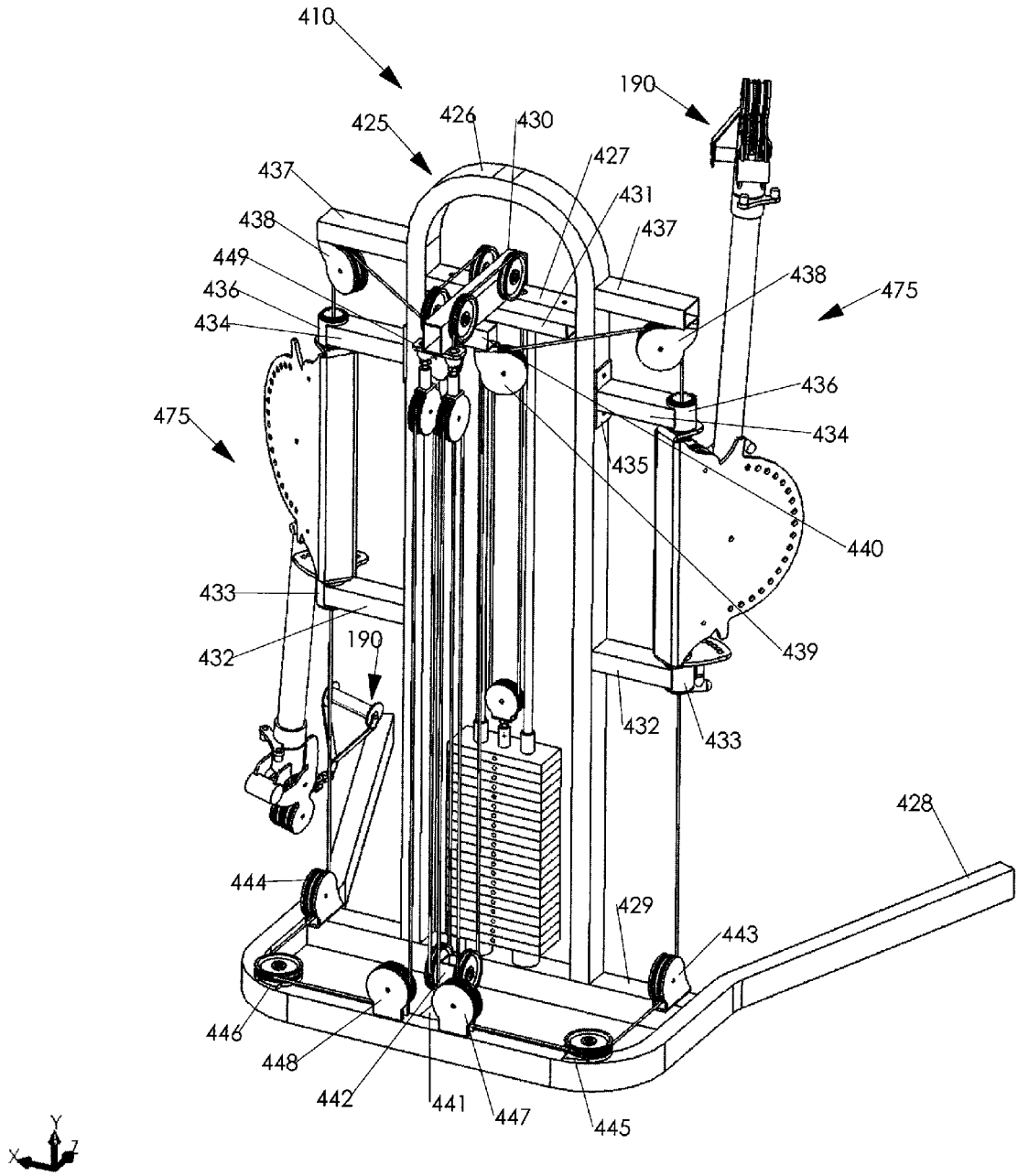
FIG. 14 is a perspective view illustrating an alternate embodiment multi resistance ratio exercise apparatus from the back right side.

FIGS. 13 and 14 illustrate an alternate embodiment of a multi resistance ratio exercise apparatus which is generally indicated by the numeral 410 and which comprises a weight stack 15 to provide resistance, a frame 425 to provide structural support and stability, two multi positionable arm assemblies 475, cable assembly 520, and handle assemblies 190. FIG. 13 illustrates multi resistance ratio exercise apparatus 410 from the front wherein one multi positionable arm assembly 475 is adjusted to an upper and generally middle width position and a second multi positional arm assembly 475 is adjusted to a lower and generally outer width position. FIG. 14 illustrates multi resistance ratio exercise apparatus 410 from the back.

The frame 425 may have a variety of configurations depending on the specific application. In one embodiment, as shown in FIGS. 13 and 14, the frame 425 includes a weight stack cage 426, which houses the weight stack 15, and sits on cage bottom 429, which secures the bottom of guide rods 20. Frame bottom 428 attaches to cage bottom 429 and provides stability to multi resistance ratio exercise apparatus 410. Cross member 427 is attached to near the top of weight stack cage 426 and secures guide rod tube 431 which secures the tops of guide rods 20. Respective side tubes 432 and respective bushing tubes 433 are attached to the outsides of weight stack cage 426 and provide a bottom resting and pivot point for respective multi positionable arm assemblies 475. Respective locking pin brackets 450 are attached to the front of respective side tubes 432 and secure respective locking pins 451 which secure respective multi positionable arm assemblies 475 into the desired position. This adjustment will be discussed in more detail later. Respective upper side tubes 434 along with respective end plates 435 and respective bushing tubes 436 are secured to the outsides of weight stack cage 426 and provide an upper attachment and pivot point for respective multi positionable arm assemblies 475. Respective upper pulley tubes 437 are attached to the outsides of weight stack cage 426 and provide an attachment point for respective pulley brackets 438.

Figure 15:
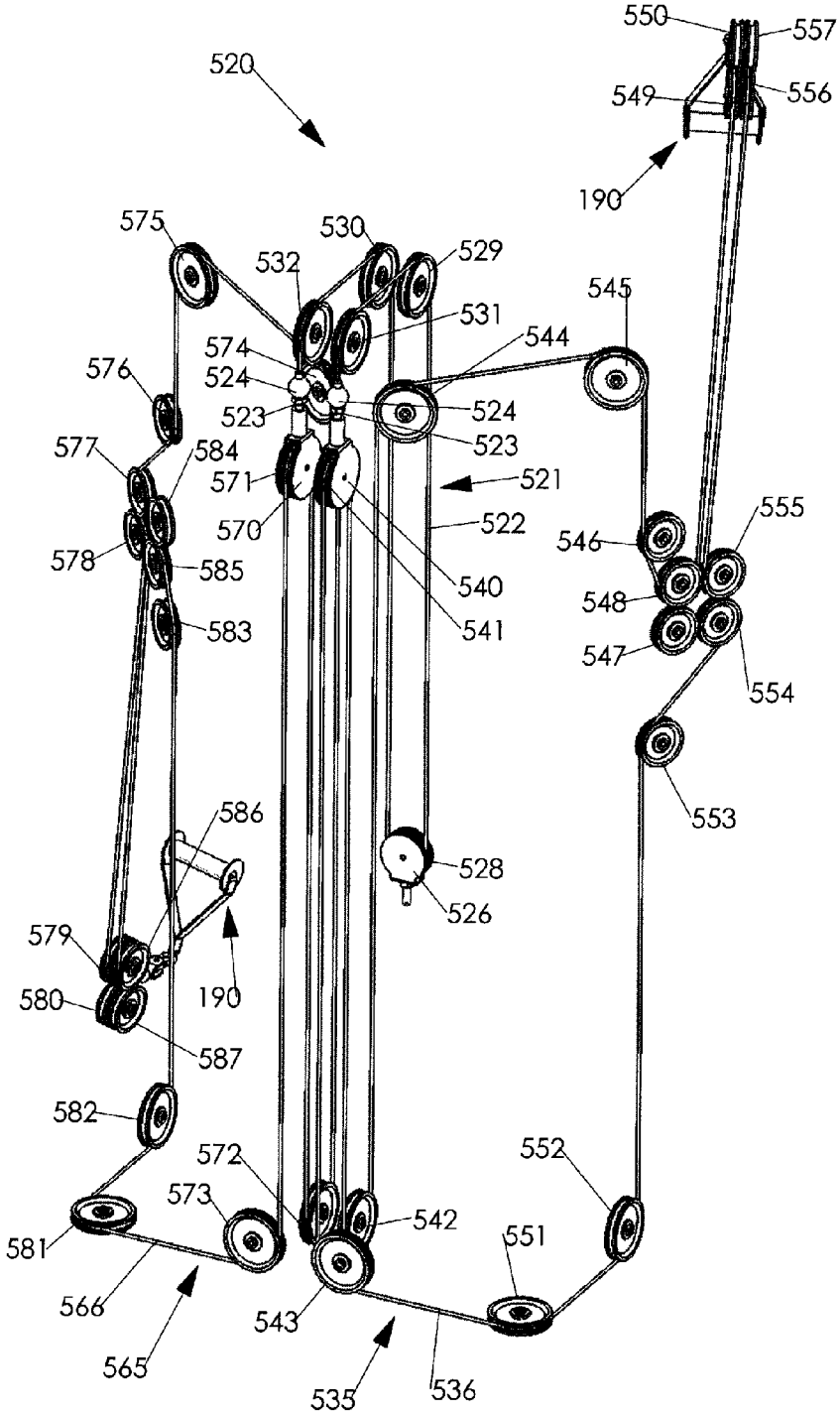
FIG. 15 is a perspective view illustrating the cable and pulley system of an alternate embodiment multi resistance ratio exercise apparatus from the back right side.

The frame 425 further includes extension tube 441 and pulley tube 442 which are attached to the inside of frame bottom 428. As illustrated in FIGS. 14 and 15, pulley tube 442 secures pulleys 542 and 572. Pulley plates 447 and 448 are attached on top of frame bottom 428 and secure pulleys 543 and 573. Pulley horizontal plates 445 and 446 also are attached on top of frame bottom 428 and secure pulleys 551 and 581. Pulley brackets 443 and 444 are attached on top of cage bottom 429 and secure pulleys 552 and 582.

The frame 425 further includes frame top tube 430 which is attached on top of cross member 427 and secures pulleys 529, 530, 531, and 532. Stop member plate 449 is attached underneath frame top tube 430 and prevent stop members 524 from upwards travel. Cross member 440 is attached underneath frame top tube 430 and provides attachment points for respective pulley brackets 438 which secure pulleys 544 and 574.

Figure 16:
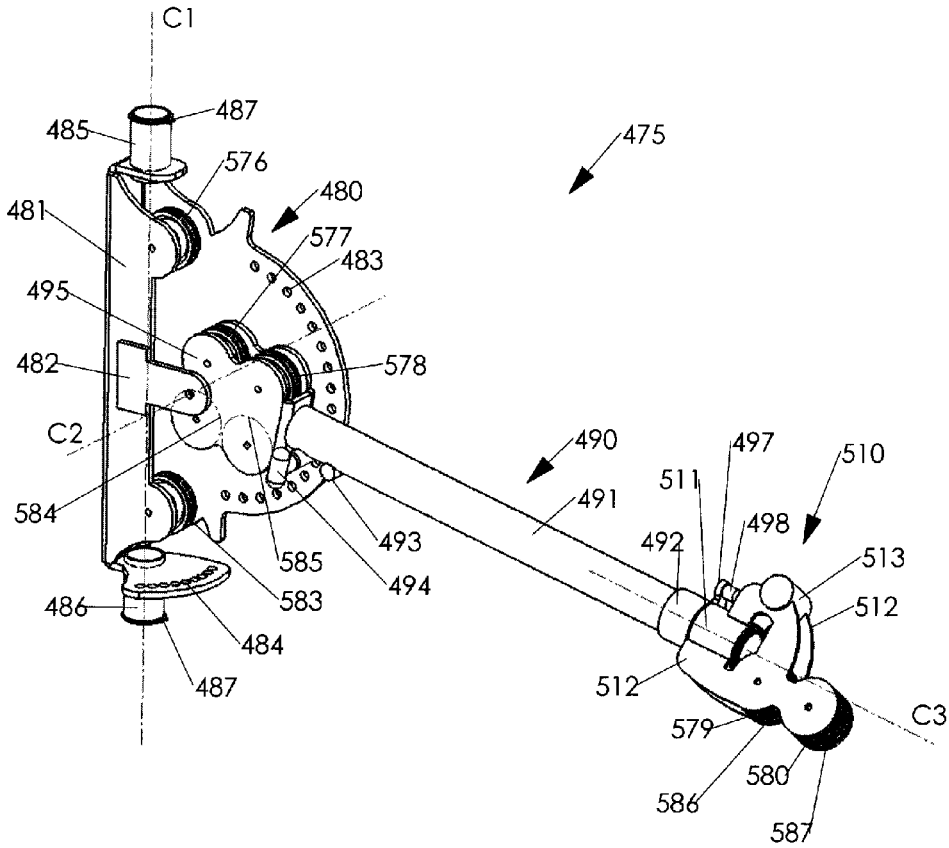
FIG. 16 is a perspective view illustrating an alternate embodiment multi positionable arm assembly from the front left side.
Figure 16:
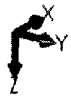

In this embodiment, the multi resistance ratio exercise apparatus 410 comprises two multi positional arm assemblies 475. The present invention could be made with only one multi positional arm assembly 475 or even three or more. In one embodiment, as shown in FIG. 16, a respective multi positional arm assembly 475 comprises a swivel mount assembly 480, an arm extension assembly 490, and a swivel pulley assembly 510.

A respective swivel mount assembly 480 is pivotally attached to the frame 425 and is rotatable about an axis labeled C1. A respective swivel mount assembly 480 comprises pivot plate 482 attached to one side of bracket 481 which has apertures 483 formed therein as well as apertures 484 formed therein. Pivot sleeves 485 and 486 are attached to respective ends of bracket 481 and pivotally attach swivel mount assembly 480 to respective bushing tubes 433 and 436 of frame 425. Retaining rings 487 secure swivel mount assembly 480 to frame 425. Respective swivel mount assemblies 480 secure respective pulleys 546, 553, 576, and 583. Swivel mount assemblies 480 also provide a pivot point, with an axis of rotation labeled C2, for the arm extension assemblies 490.

A respective arm extension assembly 490 comprises extension tube 491 wherein bushing pulley bracket 495, with an axis of rotation labeled C2, is attached at one end and provides the pivot point for mounting onto the swivel mount assembly 480. Bushing pulley brackets 495 also secure respective pulleys 547, 548, 554, 555, 584, 585, 577, and 578. A respective arm extension assembly 490 further includes locking pin 494 which is attached to extension tube 491 near bushing pulley bracket 495 and secures arm extension assembly 490 into the desired position when engaged with one of the apertures 483 in swivel mount assembly 480. Bumper 493 is attached to extension tube 491 near locking pin 494 and engages bracket 481 of swivel mount assembly 480 at upper and lower points to prevent over rotation of extension arm assembly 490. Sleeve stop 492 is attached near the other end of extension tube 491 and prevents swivel pulley assembly 510 from sliding down extension tube 491. Bumpers 498 and 499 (not shown) are attached to bumper plate 497 which is attached to sleeve stop 492. Retaining ring 500 (not shown) secures the swivel pulley assembly 510 to the arm extension assembly 490.

A respective swivel pulley assembly 510 is pivotally attached to a respective arm extension assembly 490 and is rotatable about an axis labeled C3. A respective swivel pulley assembly 510 comprises bushing tube 511 which provides the pivot point for mounting onto extension tube 491. Swivel pulley assemblies 510 also include pulley plates 512, which are attached to respective bushing tubes 511, and also secure respective pulleys 549, 550, 556, 557, 579, 580, 586, and 587. Counter weight 513 is attached to pulley plates 512 and balances the weight of the swivel pulley assembly 510 about axis C3.

In this embodiment, as illustrated in FIG. 15, cable assembly 520 includes cable assembly 521, cable assembly 535, cable assembly 565, weight stack pulley bracket 526, single pulley free floater 540 and single pulley free floater 570. Cable assembly 521 is directly connected with the weight stack 15 and serves as a main cable sector wherein cable assemblies 535 and 565 can tap into and interconnect with resistance.

Cable assembly 521 comprises cable 522 which include stop members 524 and cable bolts 523 attached at respective ends. Cable 522 is routed through stop member plate 449 then over fixed pulleys 532 and 530, then downward and around pulley 528 in weight stack pulley bracket 526. Cable 522 is then routed upwards and over fixed pulleys 529 and 531, then downwards and through stop member plate 449. Stop member plate 449 prohibits upward travel of both ends of cable 522 by bracing against stop members 524. Single pulley free floaters 540 and 570 attach to respective ends of cable assembly 521.

Cable assembly 535 comprises cable 536 which includes respective cable end assemblies 207 (shown in FIG. 32) attached at respective ends. Generally, the middle section of cable 536 is routed around pulley 541 in single pulley free floater 540. Respective sides of cable 536 are then routed downward and around fixed pulleys 542 and 543. After passing fixed pulley 543, this side of cable 536 is then routed around fixed pulleys 551 and 552, then upward and over pulley 553 in respective swivel mount assembly 480. Cable 536 is then routed around guide pulley 554 and pulley 555 in respective arm extension assembly 490. Cable 536 is then routed outward and around pulley 556 in respective swivel pulley assembly 510. This is where one end of cable assembly 535 exits near a respective distal end of a respective multi positionable arm assembly 475. After passing fixed pulley 542, the other side of cable 536 is then routed upward and around pulley 544 then outward around pulley 545 then downward and guided by pulley 546 in respective swivel mount assembly 480. Cable 536 then bypasses guide pulley 547 and is routed around pulley 548 in respective arm extension assembly 490. Cable 536 is then routed outward and around pulley 549 in respective swivel pulley assembly 510. This is where the second end of cable assembly 535 exits near a respective distal end of the same respective multi positionable arm assembly 475. Respective stop members 208 provide a rest position to respective cable ends of cable 536 when not in use. A respective handle assembly 190 can be attached to one or both ends of cable assembly 535. Pulleys 557 and 550 in respective swivel pulley assembly 510 serve as guide pulleys when cable assembly 535 is pressed or pulled. When each end of cable assembly 535 is pressed or pulled individually, single pulley free floater 540 is pulled downward which causes cable assembly 521 to lift weight stack 15 therefore providing a 4 to 1 mechanical advantage to the user. When both ends of cable assembly 535 are attached together to one handle assembly 190 as shown in FIG. 32, and handle assembly 190 is pressed or pulled, single pulley free floater 540 is pulled downward which causes cable assembly 521 to lift weight stack 15 therefore providing a 2 to 1 ratio of resistance to the user.

Cable assembly 565 comprises cable 566 which includes respective cable end assemblies 207 (shown in FIG. 32) attached at respective ends. Generally, the middle section of cable 566 is routed around pulley 571 in single pulley free floater 570. Respective sides of cable 566 are then routed downward and around fixed pulleys 572 and 573. After passing fixed pulley 573, this side of cable 566 is then routed around fixed pulleys 581 and 582, then upward and over pulley 583 in respective swivel mount assembly 480. Cable 566 then bypasses guide pulley 584 and is then routed around pulley 585 in respective arm extension assembly 490. Cable 566 is then routed outward and around pulley 586 in respective swivel pulley assembly 510. This is where one end of cable assembly 565 exits near a respective distal end of a respective multi positionable arm assembly 475. After passing fixed pulley 572, the other side of cable 566 is then routed upward and around pulley 574 then outward around pulley 575 then downward and guided by pulley 576 in respective swivel mount assembly 480. Cable 566 then is routed around guide pulley 577 and pulley 578 in respective arm extension assembly 490. Cable 566 is then routed outward and around pulley 579 in respective swivel pulley assembly 510. This is where the second end of cable assembly 565 exits near a respective distal end of the same respective multi positionable arm assembly 475. Respective stop members 208 provide a rest position to respective cable ends of cable 566 when not in use. A respective handle assembly 190 can be attached to one or both ends of cable assembly 565. Pulleys 587 and 580 in respective swivel pulley assembly 510 serve as guide pulleys when cable assembly 565 is pressed or pulled. When each end of cable assembly 565 is pressed or pulled individually, single pulley free floater 570 is pulled downward which causes cable assembly 521 to lift weight stack 15 therefore providing a 4 to 1 mechanical advantage to the user. When both ends of cable assembly 565 are attached together to one handle assembly 190 as shown in FIG. 32, and handle assembly 190 is pressed or pulled, single pulley free floater 570 is pulled downward which causes cable assembly 521 to lift weight stack 15 therefore providing a 2 to 1 ratio of resistance to the user.

Figure 17:
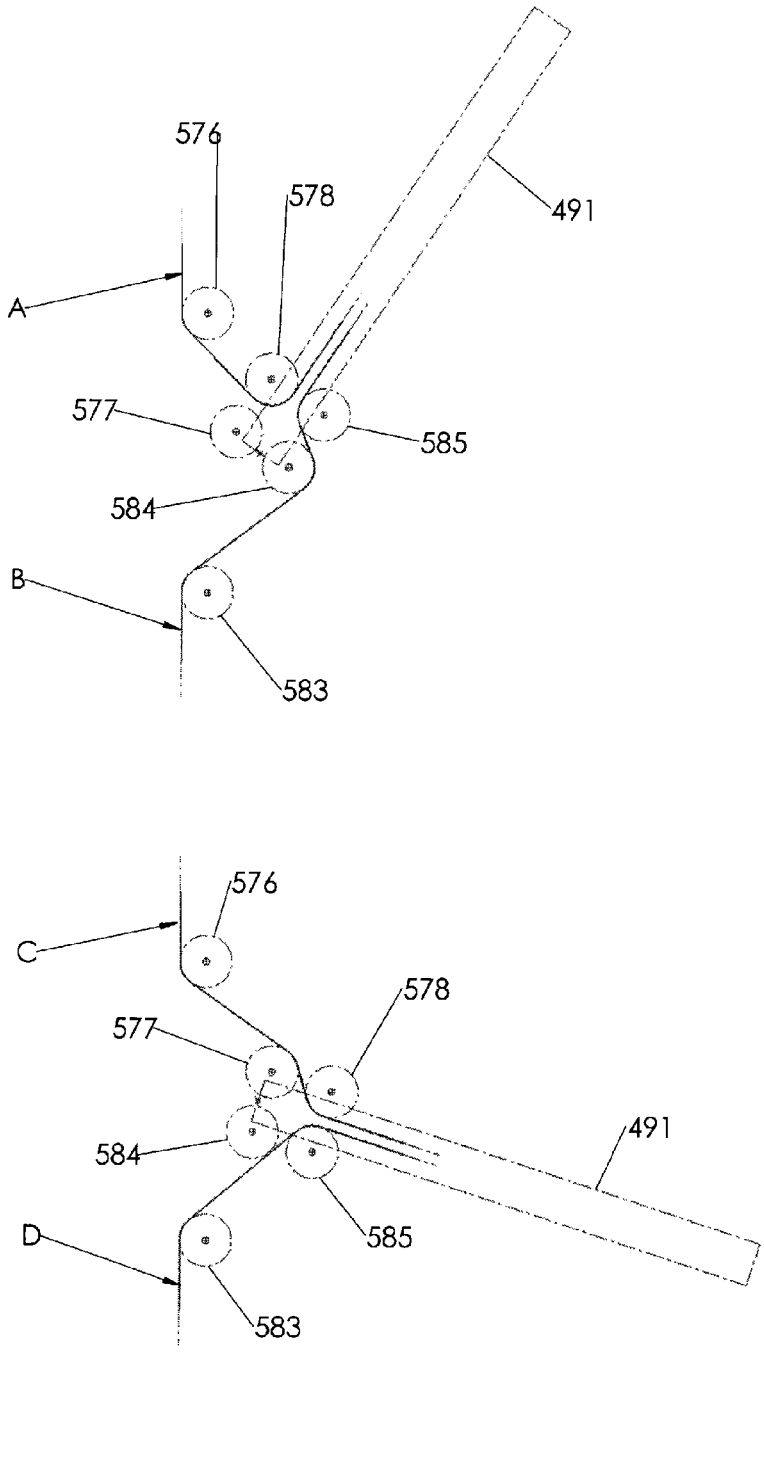
FIG. 17 is a sketch of pulleys and a portion of cables of an alternate swivel mounting assembly and arm extension assembly.

To exercise with the multi resistance ratio exercise apparatus 410, the user will rotate the multi positional arm assemblies 475 about axes C1 into the desired width position. Respective portions of cable assemblies 535 and 565 are routed in line with a respective axis C1 and align with respective fixed pulleys 545, 552, 575, and 582 of frame 425 and respective moveable pulleys 546, 553, 576, and 583 of swivel mount assemblies 480 when the multi positional arm assemblies 475 are rotated. This will allow the cable assembly 520 to maintain a substantially constant tension. A respective multi positional arm assembly 475 can be secured into position by engaging the desired respective aperture 484 of a respective swivel mount assembly 480 with a respective locking pin 451 of frame 425. The user will then rotate the arm extension assemblies 490 about axes C2 into the desired height position. Cable assembly 535 and cable assembly 565 both are separate closed loops within cable assembly 520. As shown in FIG. 17, A+B=C+D. As arm extension assemblies 490 are rotated for adjustment, the changing length of cable portion on the top side of a respective arm extension assembly 490 will offset the changing length of cable portion on the bottom side of a respective arm extension assembly 490 because of this closed loop. This will allow cable assembly 520 to maintain a substantially constant tension when the arm extension assemblies 490 are rotated. A respective arm extension assembly 490 can be secured into position by engaging the desired respective aperture 483 of a respective swivel mount assembly 480 with a respective locking pin 494 of a respective arm extension assembly 490.

The user will then select the desired resistance. The desired resistance will be selected from the weight stack 15 however the user can alter the ratio of resistance selected by attaching handle assembly 190 to either one or to multiple cable assembly ends. A lower ratio of resistance will allow more cable travel which is typically needed for functional training exercises. A higher ratio of resistance will provide more resistance for strength training movements wherein long cable travel is not required. In this embodiment, the user can attach one handle assembly 190 to one end of cable assembly 535 and receive a 4 to 1 mechanical advantage when the handle assembly 190 is pressed or pulled. The user can also attach the other end of cable assembly 535 to the same handle assembly 190 and receive a 2 to 1 mechanical advantage when the handle assembly 190 is pressed or pulled. The user can attach one handle assembly 190 to one end of cable assembly 565 and receive a 4 to 1 mechanical advantage when the handle assembly 190 is pressed or pulled. The user can also attach the other end of cable assembly 565 to the same handle assembly 190 and receive a 2 to 1 mechanical advantage when the handle assembly 190 is pressed or pulled. If respective handle assemblies 190 are attached to one end of cable assembly 535 and to one end of cable assembly 565, the user will receive a 2 to 1 mechanical advantage when the handle assemblies 190 are pressed or pulled. If one handle assembly 190 is attached to both ends of cable assembly 535 and a second handle assembly 190 is attached to both ends of cable assembly 565, the user will receive a 1 to 1 ratio of resistance when both handle assemblies 190 are pressed or pulled.

While exercising, swivel pulley assemblies 510 will rotate about axes C3 in the direction that the user is pressing or pulling the handle assemblies 190. Respective portions of cable assemblies 535 and 565 are routed along side of a respective axis C3 and self align with respective moveable pulleys 548, 555, 578, and 585 of arm extension assemblies 490 and respective moveable pulleys 549, 556, 579, and 586 of swivel pulley assemblies 510 when the swivel pulley assemblies 510 rotate during exercise. This will allow the cable assembly 520 to maintain a substantially constant tension.

Those skilled in the art will appreciate that modifications to this embodiment can be made without departing from the scope of the invention. An alternate frame configuration could be used. Different ratios of resistance other than those shown can be used. Also, an alternate configuration of cables and pulleys could be used. For example, more cable assemblies could be used to tap into the main cable sector to provide additional cable ends that exit near the distal end of a multi positional arm assembly 475. These cable assembly ends can be made to have alternate, identical, or a combination of ratios of resistance when pressed or pulled. Also, alternate handle assemblies could be used. Also, one or more multi positional arm assemblies 475 could be used. Also, more than one weight stack could be used. For example, each multi positional arm assembly 475 could have its own weight stack. Also, multiple cable ends that exit near the distal end of the same multi positional arm assembly can originate from multiple weight stacks or multiple resistance sources. Also, the arm assemblies could be in a fixed position, therefore not adjustable.

Figure 18:
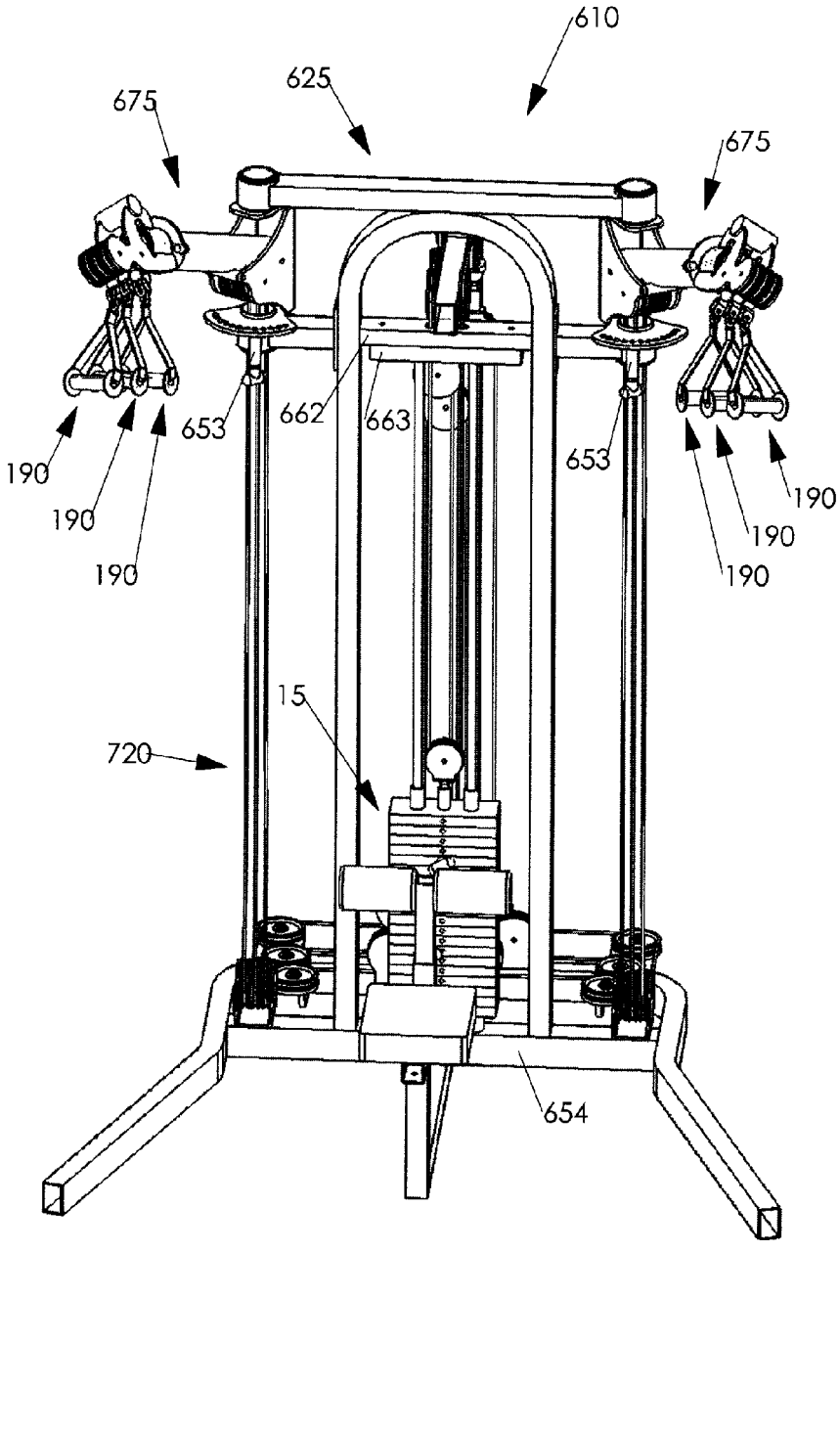
FIG. 18 is a perspective view illustrating a multi resistance ratio high pull exercise apparatus from the front right side.
Figure 19:
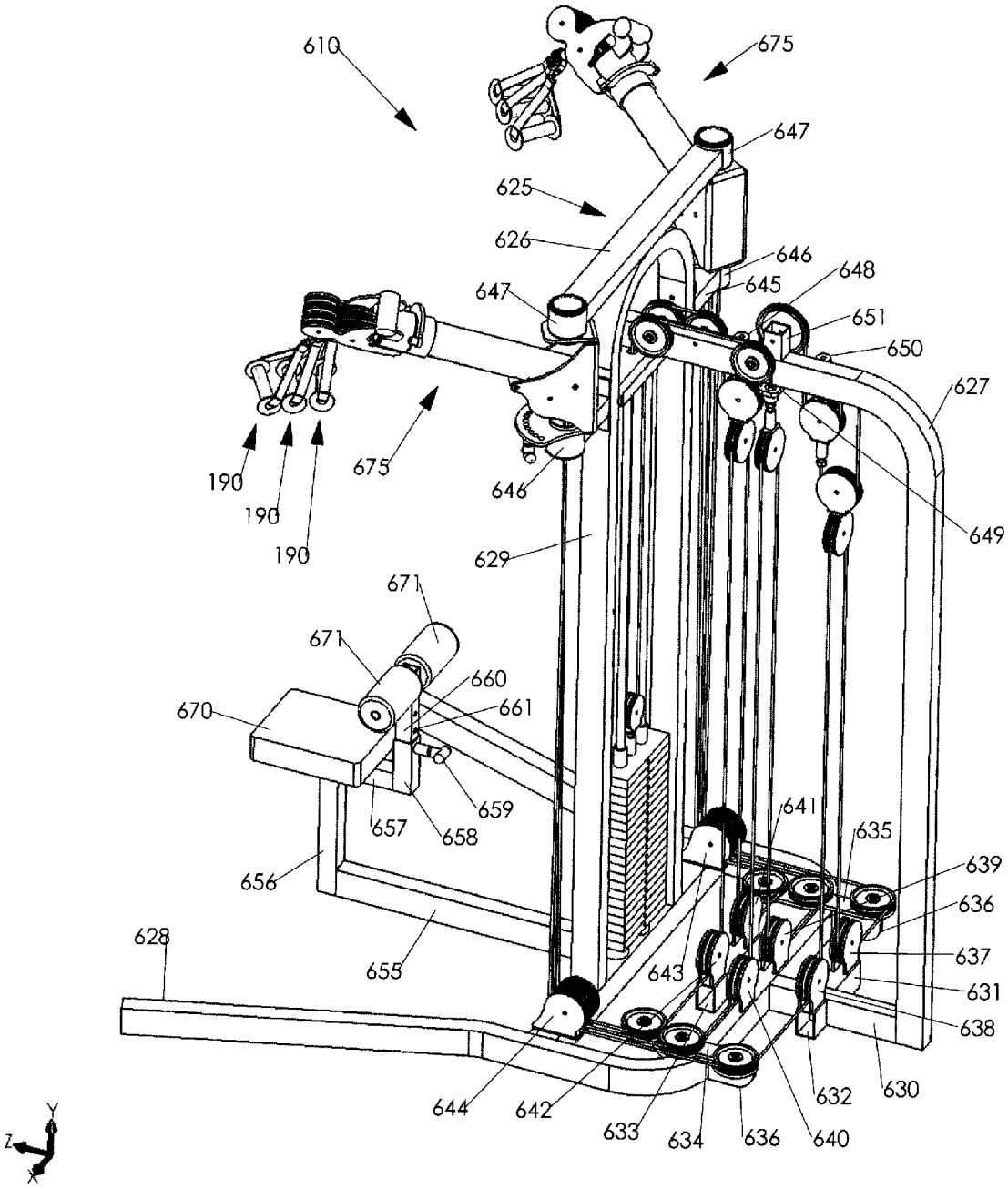
FIG. 19 is a perspective view illustrating a multi resistance ratio high pull exercise apparatus from the back left side.

FIGS. 18 and 19 illustrate an alternate embodiment of a multi resistance ratio exercise apparatus designed for high pull down functional and strength training exercises which is generally indicated by the numeral 610 and which comprises a weight stack 15 to provide resistance, a frame 625 to provide structural support and stability, two multi positionable arm assemblies 675, cable assembly 720, and handle assemblies 190. FIG. 18 illustrates multi resistance ratio exercise apparatus 610 from the front wherein both multi positionable arm assemblies 675 are adjusted to a generally outer position. FIG. 19 illustrates multi resistance ratio exercise apparatus 610 from the back.

The frame 625 may have a variety of configurations depending on the specific application. In one embodiment, as shown in FIGS. 18 and 19, the frame 625 includes a weight stack cage 629, which houses the weight stack 15, and sits on cage bottom 654, which secures the bottom of guide rods 20. Frame bottom 628 attaches to cage bottom 654 and provides stability to multi resistance ratio exercise apparatus 610. Cross member 662 is attached to near the top of weight stack cage 629 and secures guide rod tube 663 which secures the tops of guide rods 20. Respective side tubes 645 and respective bushing tubes 646 are attached to the outsides of weight stack cage 629 and provide a bottom resting and pivot point for respective multi positionable arm assemblies 675. Respective locking pin brackets 652 (not shown) are attached to the front of respective bushing tubes 646 and secure respective locking pins 653 which secure respective multi positionable arm assemblies 675 into the desired position. This adjustment will be discussed in more detail later. Respective upper cross tube 626 along with respective bushing tubes 647 are secured to the top and outsides of weight stack cage 629 and provide an upper attachment and pivot point for respective multi positionable arm assemblies 675.

Figure 20:
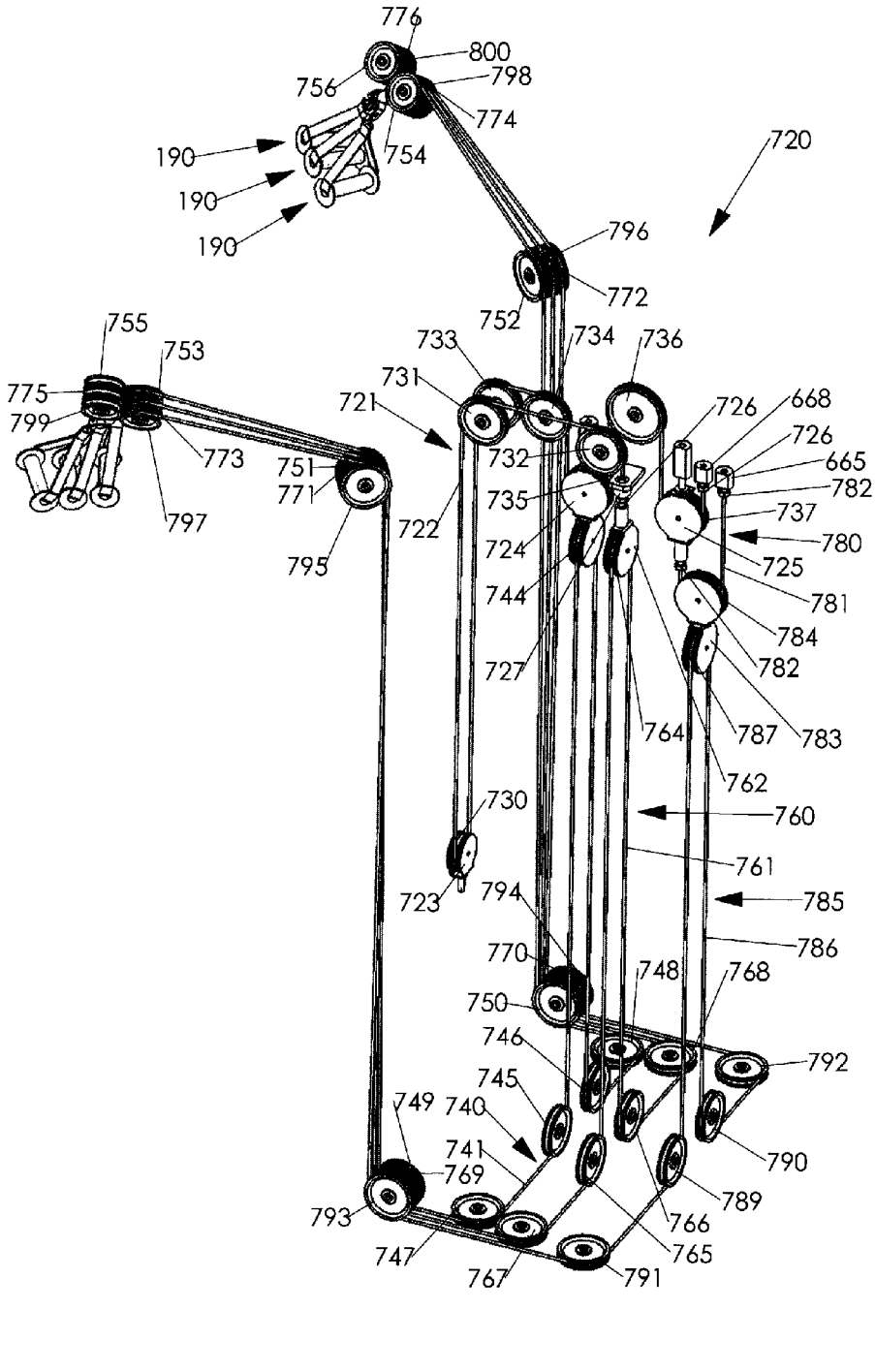
FIG. 20 is a perspective view illustrating the cable and pulley system of a multi resistance ratio high pull exercise apparatus from the back left side.

The frame 625 further includes extension tube 630 which is attached between frame bottom 628 and back frame 627. Cross tubes 631 and 632 are attached to respective sides of extension tube 630. Cross tube 633 and extension tube 664 (not shown) are attached to the front of frame bottom 628. As illustrated in FIGS. 19 and 20, pulley plates 637 and 638 are attached on top of respective cross tubes 631 and 632 and secure pulleys 790 and 789. Pulley plates 639 and 640 are attached on top of frame bottom 628 and secure pulleys 766 and 765. Pulley plates 641 and 642 are attached on top of cross tube 633 and secure pulleys 746 and 745. Pulley horizontal plates 634 and 635 are attached on top of frame bottom 628 and secure pulleys 747, 748, 767, and 768, 791, and 792. Braces 636 support pulley horizontal plates 634 and 635. Pulley brackets 643 and 644 are attached on top of cage bottom 654 and secure pulleys 749, 750, 769, 770, 793, and 794.

The frame 625 further includes top pulley tube 651 which is attached on top of back frame 627 and secures pulley 736. Leveler lockout 648 is attached to the side of back frame 627 and prevents double pulley free floater 724 from upwards travel. Leveler lockout 650 is attached to the side of back frame 627 and prevents single pulley free floater 725 from upwards travel. Cable retainer 668 is attached to the side of back frame 627 and secures one end of cable assembly 721. Cable retainer 665 is attached to the side of back frame 627 and secures one end of cable assembly 780. Stop member plate 649 is attached underneath back frame 627 and prevents stop member 727 from upwards travel.

The frame 625 further includes a seat and hold down assembly for performing seated high pull down exercises. This embodiment can be made with or without this seat and hold down assembly. Extension tube 655 is attached to the front of cage bottom 654. Upright tube 656 is attached at the end of extension tube 655. Seat tube 657 is attached on top of upright tube 656 and provides an attachment point for seat 670. Sleeve 658 is attached at the end of seat tube 657 wherein hold down tube 660 is slidingly adjustable. Hold down pads 671 are attached near the top of hold down tube 660 and hold the user in a seated position during exercise. The user can adjust the height of hold down pads 671 by unlocking locking pin 659 attached on sleeve 658, adjusting hold down tube 660 to the desired position, and by reengaging locking pin 659 with the desired aperture 661 in hold down tube 660.

Figure 21:
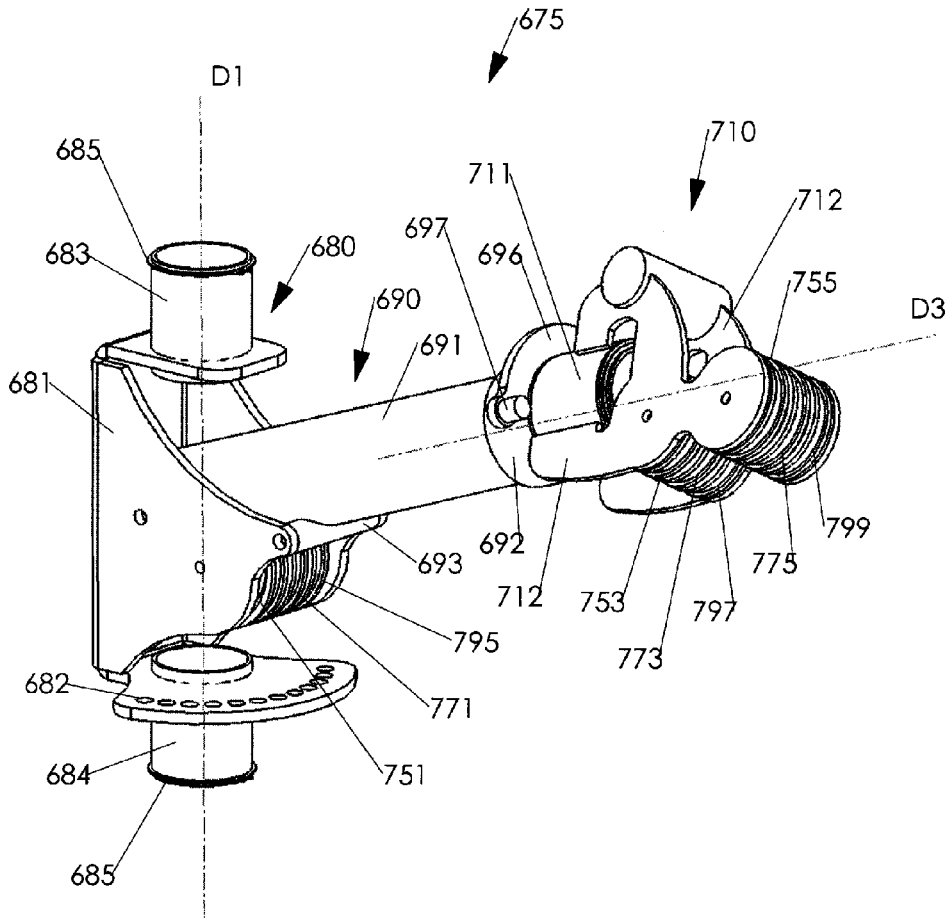
FIG. 21 is a perspective view illustrating a high pull multi positionable arm assembly from the front right side.
Figure 21:
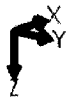
Figure 22:
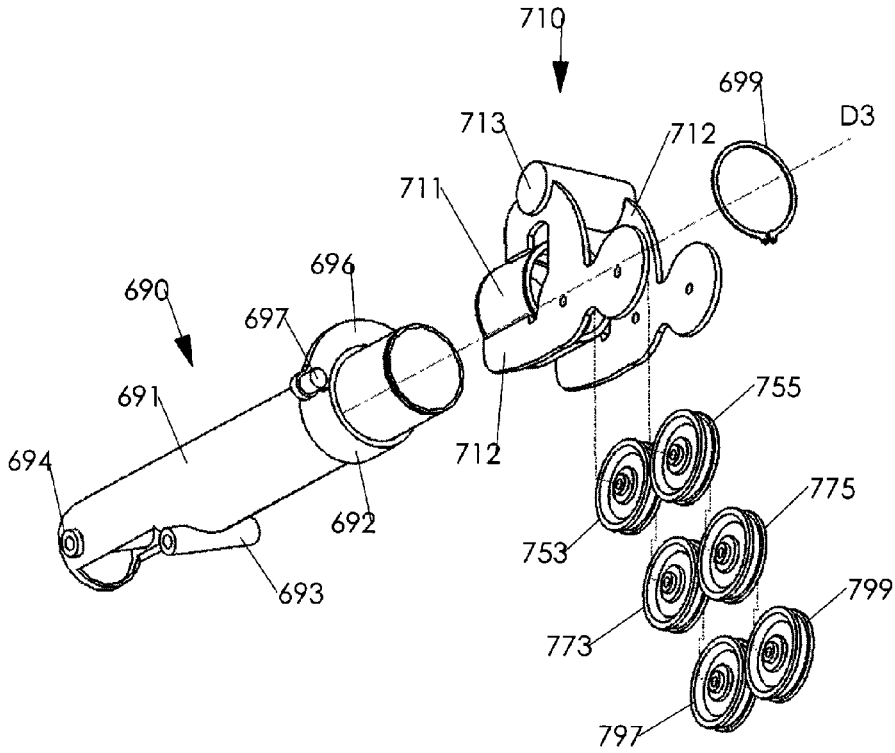
FIG. 22 is an exploded view illustrating a high pull arm extension assembly and swivel pulley assembly.
Figure 22:
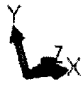

In this embodiment, the multi resistance ratio exercise apparatus 610 comprises two multi positional arm assemblies 675. The present invention could be made with only one multi positional arm assembly 675 or even three or more. In one embodiment, as shown in FIGS. 21 and 22, a respective multi positional arm assembly 675 comprises a swivel mount assembly 680, an arm extension assembly 690, and a swivel pulley assembly 710.

A respective swivel mount assembly 680 is pivotally attached to the frame 625 and is rotatable about an axis labeled D1. A respective swivel mount assembly 680 comprises bracket 681 which has apertures 682 formed therein. Pivot sleeves 683 and 684 are attached to respective ends of bracket 681 and pivotally attach swivel mount assembly 680 to respective bushing tubes 646 and 647 of frame 625. Retaining rings 685 secure swivel mount assembly 680 to frame 625. Respective swivel mount assemblies 680 secure respective pulleys 751, 771, 795, 752, 772, and 796. Swivel mount assemblies 680 also provide mounting points for the arm extension assemblies 690.

A respective arm extension assembly 690 comprises extension tube 691 wherein mounting tubes 693 and 694 are attached near one end and provide the mounting points for mounting onto the swivel mount assembly 680. Sleeve stop 692 is attached near the other end of extension tube 691 and prevents swivel pulley assembly 710 from sliding down extension tube 691. Bumpers 697 and 698 (not shown) are attached to bumper plate 696 which is attached to sleeve stop 692. Retaining ring 699 secures the swivel pulley assembly 710 to the arm extension assembly 690.

A respective swivel pulley assembly 710 is pivotally attached to a respective arm extension assembly 690 and is rotatable about an axis labeled D3. A respective swivel pulley assembly 710 comprises bushing tube 711 which provides the pivot point for mounting onto extension tube 691. Swivel pulley assemblies 710 also include pulley plates 712, which are attached to respective bushing tubes 711, and also secure respective pulleys 753, 755, 773, 775, 797, 799, 754, 756, 774, 776, 798, and 800. Counter weight 713 is attached to pulley plates 712 and balances the weight of the swivel pulley assembly 710 about axis D3.

In this embodiment, as illustrated in FIG. 20, cable assembly 720 includes cable assembly 721, cable assembly 740, cable assembly 760, cable assembly 785, cable assembly 780, weight stack pulley bracket 723, double pulley free floater 724, single pulley free floater 725, single pulley free floater 762, double pulley free floater 783. Cable assembly 721 is directly connected with the weight stack 15 and serves as a main cable sector wherein cable assemblies 740, 760, and 785 along with 780 can tap into and interconnect with resistance.

Cable assembly 721 comprises cable 722 which includes stop member 727 and cable bolt 726 attached at one end and cable bolt 726 attached at the other end. Cable 722 is routed through stop member plate 649 then over fixed pulleys 732 and 731, then downward and around pulley 730 in weight stack pulley bracket 723. Cable 722 is then routed upwards and over fixed pulleys 733 and 734, then downwards and around pulley 735 in double pulley free floater 724. Cable 722 is then routed upwards and around pulley 736, then downwards and around pulley 737 in single pulley free floater 725. This end of cable 722 is then retained by cable retainer 668. Stop member plate 649 prohibits upward travel of the other end of cable 722 by bracing against stop member 727.

Cable assembly 740 comprises cable 741 which includes respective cable end assemblies 207 (shown in FIG. 32) attached at respective ends. Generally, the middle section of cable 741 is routed around pulley 744 in double pulley free floater 724. Respective sides of cable 741 are then routed downward and around fixed pulleys 745 and 746, then outward around fixed pulleys 747 and 748. Cable 741 is then routed around fixed pulleys 749 and 750, then upward and over pulleys 751 and 752 in respective swivel mount assembly's 680. Cable 741 is then routed outward and around pulleys 753 and 754 in respective swivel pulley assembly's 710. This is where respective ends of cable assembly 740 exit near a respective distal end of a respective multi positionable arm assembly 675. Respective stop members 208 provide a rest position to respective cable ends of cable 741 when not in use. A respective handle assembly 190 can be attached to one or both ends of cable assembly 740. Pulleys 755 and 756 in respective swivel pulley assembly's 710 serve as guide pulleys when cable assembly 740 is pressed or pulled. When one end of cable assembly 740 is pressed or pulled, double pulley free floater 724 is pulled downward which causes cable assembly 721 to lift weight stack 15 therefore providing a 2 to 1 mechanical advantage to the user. When both ends of cable assembly 740 is pressed or pulled, double pulley free floater 724 is pulled downward which causes cable assembly 721 to lift weight stack 15 therefore providing a 1 to 1 ratio of resistance to the user.

Cable assembly 760 comprises cable 761 which includes respective cable end assemblies 207 (shown in FIG. 32) attached at respective ends. Generally, the middle section of cable 761 is routed around pulley 764 in single pulley free floater 762. Respective sides of cable 761 are then routed downward and around fixed pulleys 765 and 766, then outward around fixed pulleys 767 and 768. Cable 761 is then routed around fixed pulleys 769 and 770, then upward and over pulleys 771 and 772 in respective swivel mount assembly's 680. Cable 761 is then routed outward and around pulleys 773 and 774 in respective swivel pulley assembly's 710. This is where respective ends of cable assembly 760 exit near a respective distal end of a respective multi positionable arm assembly 675. Respective stop members 208 provide a rest position to respective cable ends of cable 761 when not in use. A respective handle assembly 190 can be attached to one or both ends of cable assembly 760. Pulleys 775 and 776 in respective swivel pulley assembly's 710 serve as guide pulleys when cable assembly 760 is pressed or pulled. When one end of cable assembly 760 is pressed or pulled, single pulley free floater 762 is pulled downward which causes cable assembly 721 to lift weight stack 15 therefore providing a 4 to 1 mechanical advantage to the user. When both ends of cable assembly 760 are pressed or pulled, single pulley free floater 762 is pulled downward which causes cable assembly 721 to lift weight stack 15 therefore providing a 2 to 1 mechanical advantage to the user.

Cable assembly 780 comprises cable 781 which includes respective cable bolts 782 attached at respective ends. Cable 781 is routed around pulley 784 in double pulley free floater 783 wherein both sides of cable 781 are then routed upwards. One end is retained in single pulley free floater 725 and the other end is retained in cable retainer 665. Cable assembly 780 interconnects cable assembly 785 to the main cable sector, cable assembly 721.

Cable assembly 785 comprises cable 786 which includes respective cable end assemblies 207 (shown in FIG. 32) attached at respective ends. Generally, the middle section of cable 786 is routed around pulley 787 in double pulley free floater 783. Respective sides of cable 786 are then routed downward and around fixed pulleys 789 and 790, then outward around fixed pulleys 791 and 792. Cable 786 is then routed around fixed pulleys 793 and 794, then upward and over pulleys 795 and 796 in respective swivel mount assembly's 680. Cable 786 is then routed outward and around pulleys 797 and 798 in respective swivel pulley assembly's 710. This is where respective ends of cable assembly 785 exit near a respective distal end of a respective multi positionable arm assembly 675. Respective stop members 208 provide a rest position to respective cable ends of cable 786 when not in use. A respective handle assembly 190 can be attached to one or both ends of cable assembly 785. Pulleys 799 and 800 in respective swivel pulley assembly's 710 serve as guide pulleys when cable assembly 785 is pressed or pulled. When one end of cable assembly 785 is pressed or pulled, double pulley free floater 783 is pulled downward which pulls single pulley free floater 725 downward which causes cable assembly 721 to lift weight stack 15 therefore providing a 1 to 1 ratio of resistance to the user. When both ends of cable assembly 785 is pressed or pulled, double pulley free floater 783 is pulled downward which pulls single pulley free floater 725 downward which causes cable assembly 721 to lift weight stack 15 therefore providing a 1 to 2 ratio of resistance to the user.

In this embodiment, one handle assembly 190 can also be connected to more than one cable end assembly to provide other alternate ratios of resistance.

To exercise with the multi resistance ratio exercise apparatus 610, the user will rotate the multi positional arm assemblies 675 about axes D1 into the desired width position. A respective portion of cable assembly 760 is routed in line with a respective axis D1 and aligns with respective fixed pulleys 769 and 770 of frame 625 and respective moveable pulleys 771 and 772 of swivel mount assemblies 680 when the multi positional arm assemblies 675 are rotated. Respective portions of cable assemblies 740 and 785 are routed along side of a respective axis D1 and self align with respective fixed pulleys 749, 793, 750, and 794 of frame 625 and respective moveable pulleys 751, 795, 752, and 796 of swivel mount assemblies 680 when the multi positional arm assemblies 675 are rotated. This will allow the cable assembly 720 to maintain a substantially constant tension. A respective multi positional arm assembly 675 can be secured into position by engaging the desired respective aperture 682 of a respective swivel mount assembly 680 with a respective locking pin 653 of frame 625.

The user will then select one or more desired handle assemblies to press or pull and also select the desired resistance. The desired resistance will be selected from the weight stack 15 however the user can alter the ratio of resistance selected by attaching the desired handle assembly to the appropriate cable assembly end or ends. A lower ratio of resistance will allow more cable travel which is typically needed for functional training exercises. A higher ratio of resistance will provide more resistance for strength training movements wherein long cable travel is not required. In this embodiment, if handle assembly 190 is selected, the user can attach one handle assembly 190 to one end of cable assembly 740 and receive a 2 to 1 mechanical advantage when the handle assembly 190 is pressed or pulled. If respective handle assemblies 190 are attached to respective ends of cable assembly 740 and both are pressed or pulled, the user will be exercising with a 1 to 1 ratio of resistance. The user can attach one handle assembly 190 to one end of cable assembly 760 and receive a 4 to 1 mechanical advantage when the handle assembly 190 is pressed or pulled. If respective handle assemblies 190 are attached to respective ends of cable assembly 760 and both are pressed or pulled, the user will be exercising with a 2 to 1 ratio of resistance. The user can attach one handle assembly 190 to one end of cable assembly 785 and receive a 1 to 1 ratio of resistance when the handle assembly 190 is pressed or pulled. If respective handle assemblies 190 are attached to respective ends of cable assembly 785 and both are pressed or pulled, the user will be exercising with a 1 to 2 ratio of resistance. If alternate ratios of resistance are desired, the user can attach one handle assembly 190 to multiple cable ends and press or pull these multiple ends at the same time with one handle assembly.

While exercising, swivel pulley assemblies 710 will rotate about axes D3 in the direction that the user is pressing or pulling the selected handle assemblies. A respective portion of cable assembly 760 is routed in line with a respective axis D3 and aligns with respective moveable pulleys 771 and 772 of swivel mount assemblies 680 and respective moveable pulleys 773 and 774 of swivel pulley assemblies 710 when the swivel pulley assemblies 710 rotate during exercise. Respective portions of cable assemblies 740 and 785 are routed along side of a respective axis D3 and self align with respective moveable pulleys 751, 795, 752, and 796 of swivel mount assemblies 680 and respective moveable pulleys 753, 797, 754, and 798 of swivel pulley assemblies 710 when the swivel pulley assemblies 710 rotate during exercise. This will allow the cable assembly 720 to maintain a substantially constant tension.

Those skilled in the art will appreciate that modifications to this embodiment can be made without departing from the scope of the invention. An alternate frame configuration could be used. Different ratios of resistance other than those shown can be used. Also, an alternate configuration of cables and pulleys could be used. For example, more cable assemblies could be used to tap into the main cable sector to provide additional cable ends that exit near the distal end of a multi positional arm assembly 675. These cable assembly ends can be made to have alternate, identical, or a combination of ratios of resistance when pressed or pulled. Also, alternate handle assemblies could be used. Also, one or more multi positional arm assemblies 675 could be used. Also, more than one weight stack could be used. For example, each multi positional arm assembly 675 could have its own weight stack. Also, multiple cable ends that exit near the distal end of the same multi positional arm assembly can originate from multiple weight stacks or multiple resistance sources. Also, the arm assemblies could be in a fixed position, therefore not adjustable.

Figure 23:
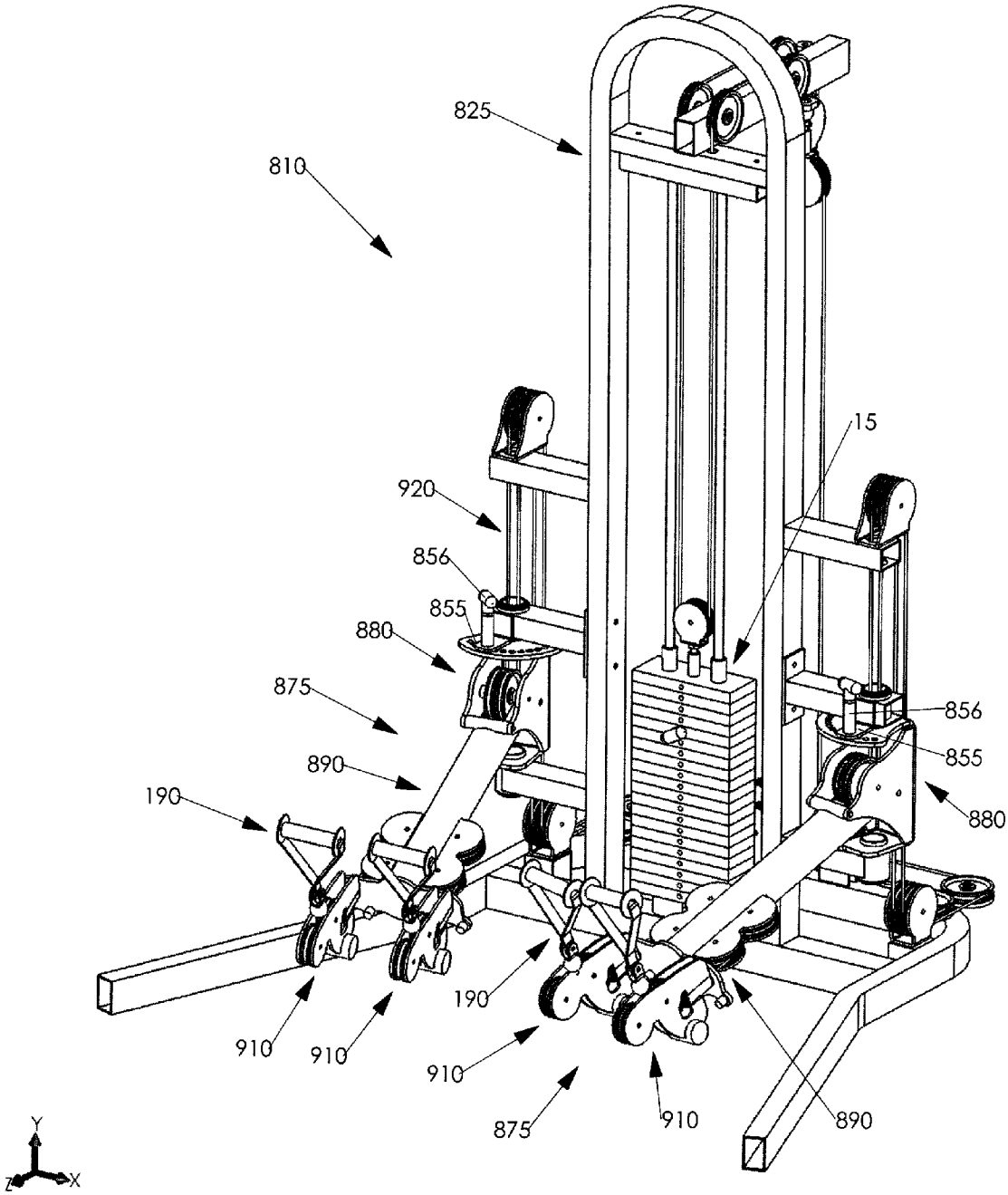
FIG. 23 is a perspective view illustrating a multi resistance ratio low pull exercise apparatus from the front right side.
Figure 24:
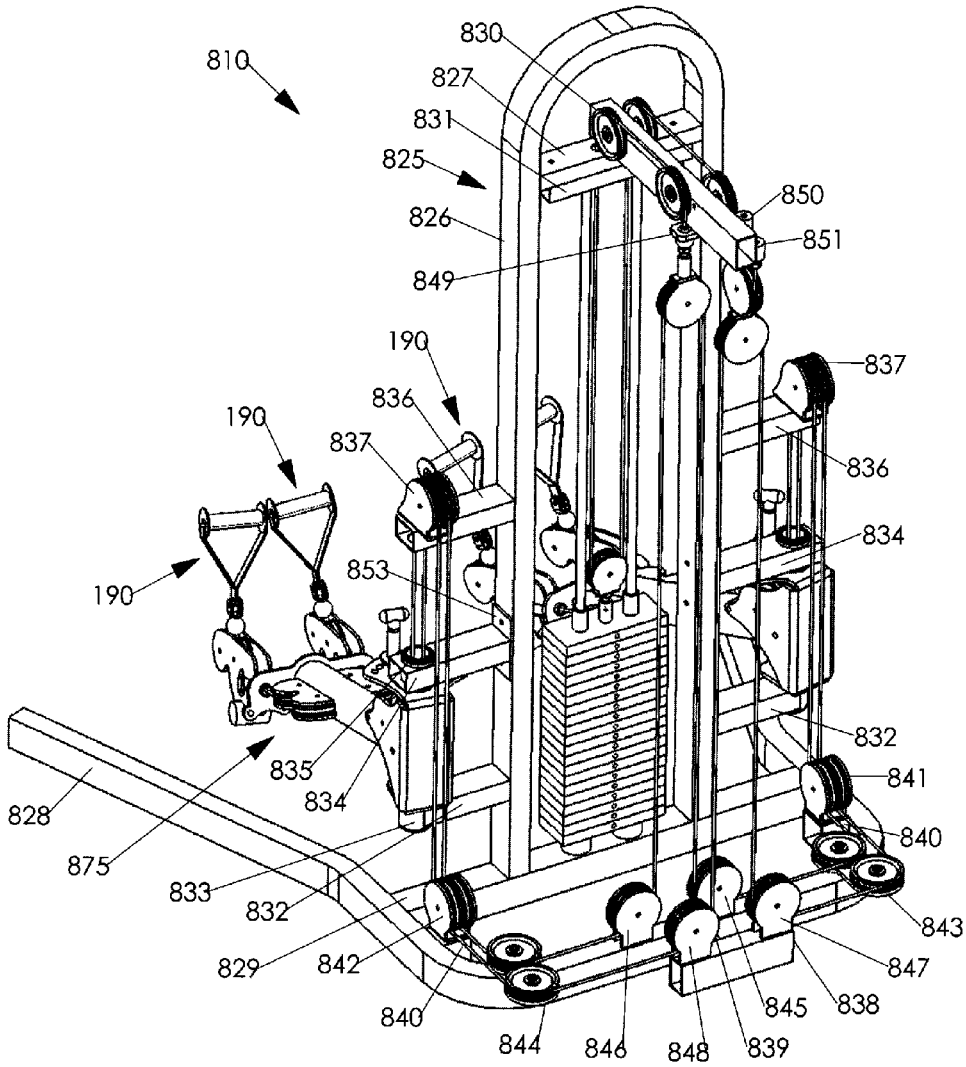
FIG. 24 is a perspective view illustrating a multi resistance ratio low pull exercise apparatus from the back left side.
Figure 24:
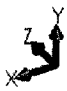

FIGS. 23 and 24 illustrate an alternate embodiment of a multi resistance ratio exercise apparatus designed for low pull functional and strength training exercises which is generally indicated by the numeral 810 and which comprises a weight stack 15 to provide resistance, a frame 825 to provide structural support and stability, two multi positionable arm assemblies 875, cable assembly 920, and handle assemblies 190. FIG. 23 illustrates multi resistance ratio exercise apparatus 810 from the front wherein both multi positionable arm assemblies 875 are adjusted to a generally inner position. FIG. 24 illustrates multi resistance ratio exercise apparatus 810 from the back.

The frame 825 may have a variety of configurations depending on the specific application. In one embodiment, as shown in FIGS. 23 and 24, the frame 825 includes a weight stack cage 826, which houses the weight stack 15, and sits on cage bottom 829, which secures the bottom of guide rods 20. Frame bottom 828 attaches to cage bottom 829 and provides stability to multi resistance ratio exercise apparatus 810. Cross member 827 is attached to near the top of weight stack cage 826 and secures guide rod tube 831 which secures the tops of guide rods 20. Respective side tubes 832 and respective bushing tubes 833 are attached to the outsides of weight stack cage 826 and provide a bottom resting and pivot point for respective multi positionable arm assemblies 875. Respective upper side tubes 834 along with respective end plates 853 and respective bushing tubes 835 are secured to the outsides of weight stack cage 826 and provide an upper attachment and pivot point for respective multi positionable arm assemblies 875. Respective locking pin brackets 855 are attached to the front of respective upper side tubes 834 and secure respective locking pins 856 which secure respective multi positionable arm assemblies 875 into the desired position. This adjustment will be discussed in more detail later. Respective upper pulley tubes 836 are attached to the outsides of weight stack cage 826 and provide an attachment point for respective pulley brackets 837.

Figure 25:
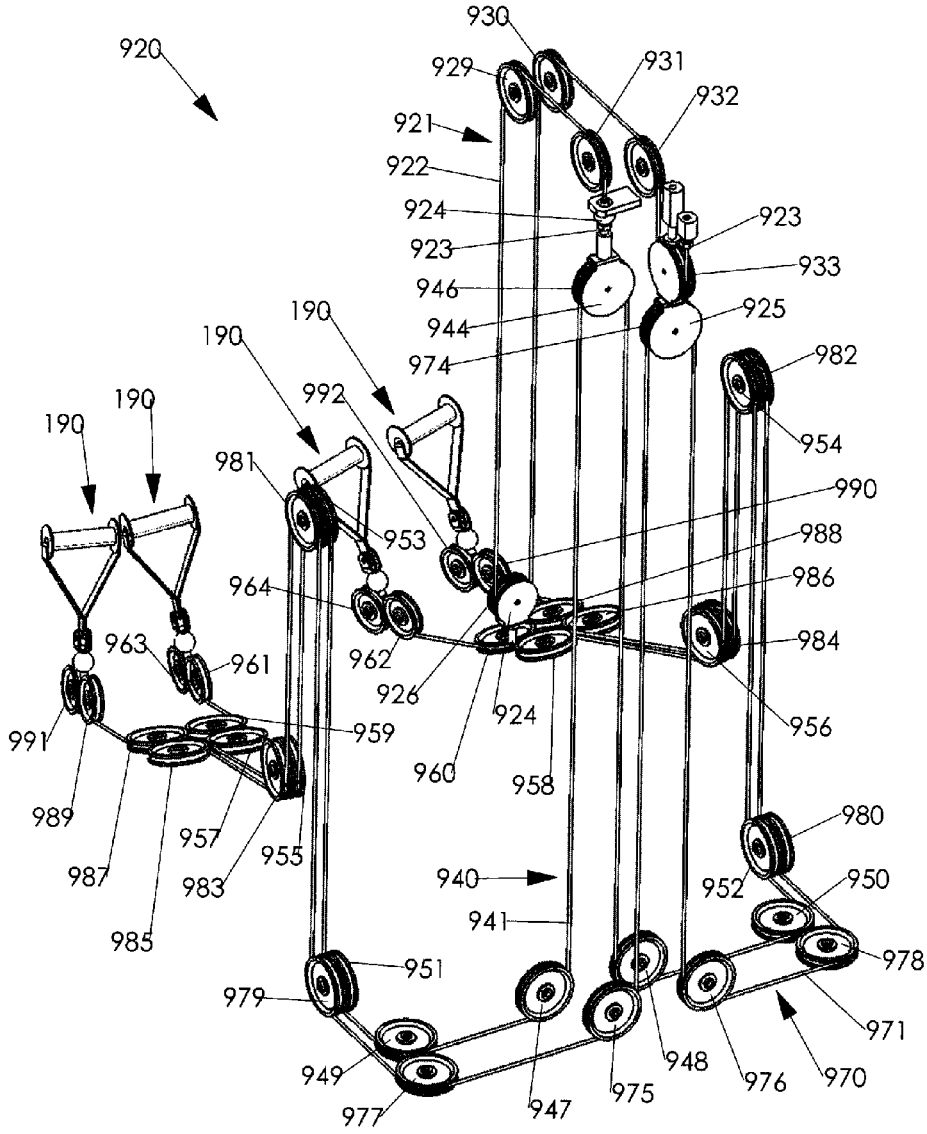
FIG. 25 is a perspective view illustrating the cable and pulley system of a multi resistance ratio low pull exercise apparatus from the back left side.

The frame 825 further includes extension tube 839 which is attached to the back of frame bottom 828. Cross tube 838 is attached to the end of extension tube 839. Pulley tubes 840 are attached on the inside of frame bottom 828. As illustrated in FIGS. 24 and 25, pulley plates 845 and 846 are attached on top of frame bottom 828 and secure pulleys 948 and 947. Pulley plates 847 and 848 are attached on top of cross tube 838 and secure pulleys 976 and 975. Pulley horizontal plates 843 and 844 also are attached on top of frame bottom 828 and secure pulleys 950, 978, 949, and 977. Pulley brackets 841 and 842 are attached on top of pulley tubes 840 and secure pulleys 952, 980, 951, and 979.

The frame 225 further includes frame top tube 830 which is attached on top of cross member 827 and secures pulleys 929, 930, 931, and 932. Leveler lockout 850 is attached to the side of frame top tube 830 and prevents double free floater 925 from upwards travel. Cable retainer 851 is attached to the side of frame top tube 830 and secures one end of cable assembly 921. Stop member plate 849 is attached underneath frame top tube 830 and prevents stop member 924 from upwards travel.

Figure 26:
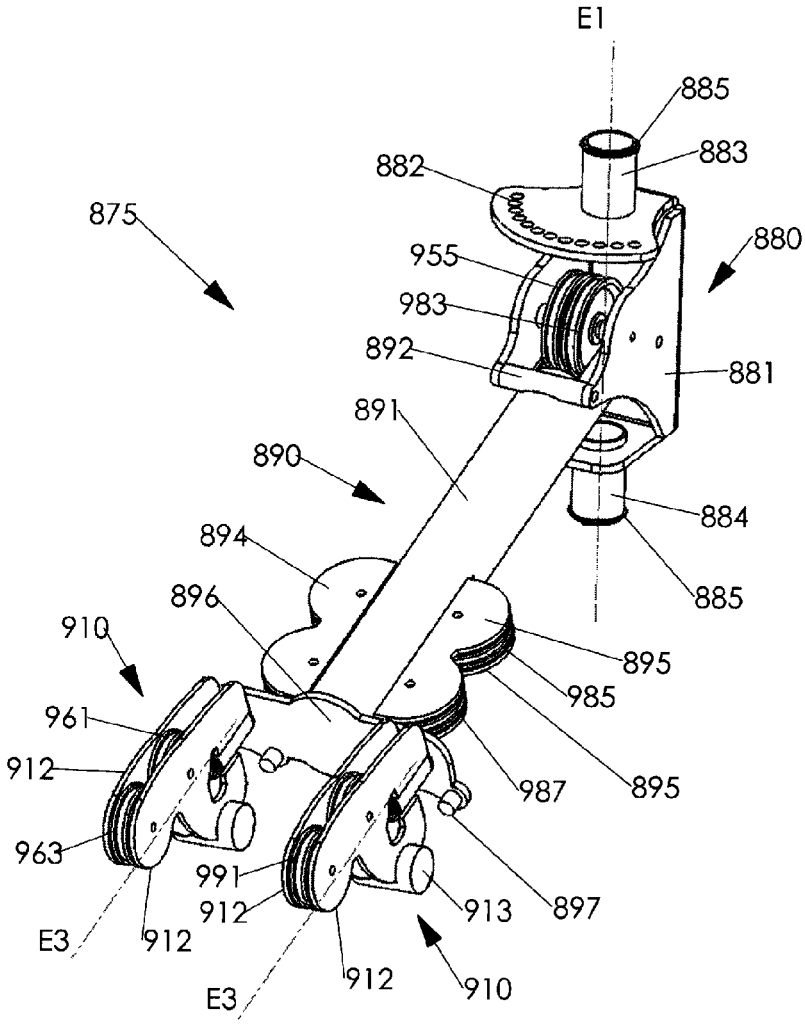
FIG. 26 is a perspective view illustrating a low pull multi positionable arm assembly from the front left side.
Figure 26:
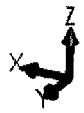
Figure 27:
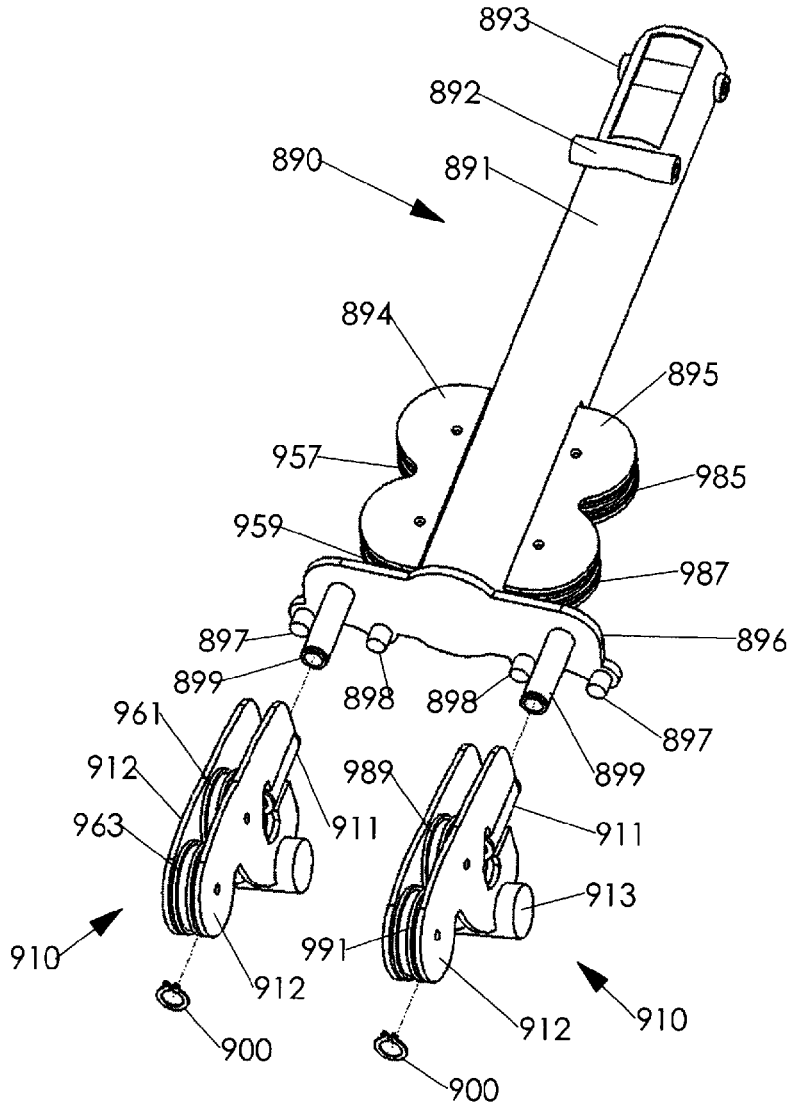
FIG. 27 is an exploded view illustrating a low pull arm extension assembly and two swivel pulley assemblies.
Figure 27:
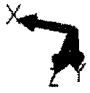

In this embodiment, the multi resistance ratio exercise apparatus 810 comprises two multi positional arm assemblies 875. The present invention could be made with only one multi positional arm assembly 875 or even three or more. In one embodiment, as shown in FIGS. 26 and 27, a respective multi positional arm assembly 875 comprises a swivel mount assembly 880, an arm extension assembly 890, and a swivel pulley assembly 910.

A respective swivel mount assembly 880 is pivotally attached to the frame 825 and is rotatable about an axis labeled E1. A respective swivel mount assembly 880 comprises bracket 881 which has apertures 882 formed therein. Pivot sleeves 883 and 884 are attached to respective ends of bracket 881 and pivotally attach swivel mount assembly 880 to respective bushing tubes 833 and 835 of frame 825. Retaining rings 885 secure swivel mount assembly 880 to frame 825. Respective swivel mount assemblies 880 secure respective pulleys 956, 984, 955, and 983.

A respective arm extension assembly 890 comprises extension tube 891 wherein mounting tubes 892 and 893 are attached near one end and provide mounting points for mounting onto the swivel mount assembly 880. Pulley plates 895 and 894 are attached near the other end of extension tubes 891 and secure pulleys 958, 960, 986, 988, 957, 959, 985, and 987. End plate 896 is attached on this end of a respective extension tube 891. Two pivot sleeves 899 are attached on one respective end plate 896 and are labeled with an axis of rotation E3 wherein two swivel pulley assemblies 910 are pivotally attached. Bumpers 897 and 898 are attached to end plate 896 and prevent swivel pulley assemblies 910 from over rotating. A respective retaining ring 900 secures a respective swivel pulley assembly 910 to the arm extension assembly 890.

Two swivel pulley assemblies 910 are pivotally attached to a respective arm extension assembly 890 and are rotatable about respective axes labeled E3. A respective swivel pulley assembly 910 comprises bushing tube 911 which provides the pivot point for mounting onto a respective pivot sleeve 899 of arm extension assembly 890. Swivel pulley assemblies 910 also include pulley plates 912, which are attached to respective bushing tubes 911, and also secure respective pulleys 962, 964, 990, 992, 961, 963, 989, and 991. A respective counter weight 913 is attached to pulley plates 912 and balances the weight of the swivel pulley assembly 910 about axis E3.

In this embodiment, as illustrated in FIG. 25, cable assembly 920 includes cable assembly 921, cable assembly 940, cable assembly 970, weight stack pulley bracket 924, single pulley free floater 944 and double pulley free floater 925. Cable assembly 921 is directly connected with the weight stack 15 and serves as a main cable sector wherein cable assemblies 940 and 970 can tap into and interconnect with resistance.

Cable assembly 921 comprises cable 922 which includes stop member 924 and cable bolt 923 attached at one end and cable bolt 923 attached at the other end. Cable 922 is routed through stop member plate 849 then over fixed pulleys 931 and 929, then downward and around pulley 926 in weight stack pulley bracket 924. Cable 922 is then routed upwards and over fixed pulleys 930 and 932, then downwards and around pulley 933 in double pulley free floater 925. This end of cable 922 is then retained by cable retainer 851. Stop member plate 849 prohibits upward travel of the other end of cable 922 by bracing against stop member 924.

Cable assembly 940 comprises cable 941 which includes respective cable end assemblies 200 (shown in FIG. 33) attached at respective ends. Generally, the middle section of cable 941 is routed around pulley 946 in single pulley free floater 944. Respective sides of cable 941 are then routed downward and around fixed pulleys 948 and 947, then outward around fixed pulleys 950 and 949. Cable 941 is then routed around fixed pulleys 952 and 951, then upward and over pulleys 954 and 953. Cable 941 is then routed downward and around pulleys 956 and 955 in respective swivel mount assembly's 880. Cable 941 is then routed outward and around pulleys 958, 957, 960, and 959 in respective arm extension assembly's 890, then outward and around pulleys 962 and 961 in respective swivel pulley assembly's 910. This is where respective ends of cable assembly 940 exit near a respective distal end of a respective multi positionable arm assembly 875. Respective stop members 201 provide a rest position to respective cable ends of cable 941 when not in use. A respective handle assembly 190 can be attached to one or both ends of cable assembly 940. Pulleys 964 and 963 in respective swivel pulley assembly's 910 serve as guide pulleys when cable assembly 940 is pressed or pulled. When one end of cable assembly 940 is pressed or pulled, single pulley free floater 944 is pulled downward which causes cable assembly 921 to lift weight stack 15 therefore providing a 4 to 1 mechanical advantage to the user. When both ends of cable assembly 940 are pressed or pulled, single pulley free floater 944 is pulled downward which causes cable assembly 921 to lift weight stack 15 therefore providing a 2 to 1 ratio of resistance to the user.

Cable assembly 970 comprises cable 971 which includes respective cable end assemblies 200 (shown in FIG. 33) attached at respective ends. Generally, the middle section of cable 971 is routed around pulley 974 in double pulley free floater 925. Respective sides of cable 971 are then routed downward and around fixed pulleys 976 and 975, then outward around fixed pulleys 978 and 977. Cable 971 is then routed around fixed pulleys 980 and 979, then upward and over pulleys 982 and 981. Cable 971 is then routed downward and around pulleys 984 and 983 in respective swivel mount assembly's 880. Cable 971 is then routed outward and around pulleys 986, 985, 988, and 987 in respective arm extension assembly's 890, then outward and around pulleys 990 and 989 in respective swivel pulley assembly's 910. This is where respective ends of cable assembly 970 exit near a respective distal end of a respective multi positionable arm assembly 875. Respective stop members 201 provide a rest position to respective cable ends of cable 971 when not in use. A respective handle assembly 190 can be attached to one or both ends of cable assembly 970. Pulleys 992 and 991 in respective swivel pulley assembly's 910 serve as guide pulleys when cable assembly 970 is pressed or pulled. When one end of cable assembly 970 is pressed or pulled, double pulley free floater 925 is pulled downward which causes cable assembly 921 to lift weight stack 15 therefore providing a 2 to 1 mechanical advantage to the user. When both ends of cable assembly 970 are pressed or pulled, double pulley free floater 925 is pulled downward which causes cable assembly 921 to lift weight stack 15 therefore providing a 1 to 1 ratio of resistance to the user.

To exercise with the multi resistance ratio exercise apparatus 810, the user will rotate the multi positional arm assemblies 875 about axes E1 into the desired width position. Respective portions of cable assemblies 940 and 970 are routed along side of a respective axis E1 and self align with respective fixed pulleys 954, 953, 982, and 981 of frame 825 and respective moveable pulleys 956, 955, 984, and 983 of swivel mount assemblies 880 when the multi positional arm assemblies 875 are rotated. This will allow the cable assembly 120 to maintain a substantially constant tension. A respective multi positional arm assembly 875 can be secured into position by engaging the desired respective aperture 882 of a respective swivel mount assembly 880 with a respective locking pin 856 of frame 825.

The user will then select one or more desired handle assemblies to press or pull and also select the desired resistance. The desired resistance will be selected from the weight stack 15 however the user can alter the ratio of resistance selected by attaching the desired handle assembly to the appropriate cable assembly end or ends. A lower ratio of resistance will allow more cable travel which is typically needed for functional training exercises. A higher ratio of resistance will provide more resistance for strength training movements wherein long cable travel is not required. In this embodiment, if handle assembly 190 is selected, the user can attach one handle assembly 190 to one end of cable assembly 940 and receive a 4 to 1 mechanical advantage when the handle assembly 190 is pressed or pulled. If respective handle assemblies 190 are attached to respective ends of cable assembly 940 and both are pressed or pulled, the user will be exercising with a 2 to 1 ratio of resistance. The user can attach one handle assembly 190 to one end of cable assembly 970 and receive a 2 to 1 mechanical advantage when the handle assembly 190 is pressed or pulled. If respective handle assemblies 190 are attached to respective ends of cable assembly 970 and both are pressed or pulled, the user will be exercising with a 1 to 1 ratio of resistance. If more resistance is desired, the user can select handle assembly 195 and attach it to one end of cable assembly 940 as well as to one end of cable assembly 970 and press or pull both cable assembly ends at the same time with one handle assembly.

While exercising, swivel pulley assemblies 910 will rotate about axes E3 in the direction that the user is pressing or pulling the selected handle assemblies. Respective portions of cable assemblies 940 and 970 are routed in line with a respective axis E3 and align with respective moveable pulleys 960, 959, 988, and 987 of arm extension assemblies 890 and respective moveable pulleys 962, 961, 990, and 989 of swivel pulley assemblies 910 when the swivel pulley assemblies 910 rotate during exercise. This will allow the cable assembly 920 to maintain a substantially constant tension.

Those skilled in the art will appreciate that modifications to this embodiment can be made without departing from the scope of the invention. An alternate frame configuration could be used. Different ratios of resistance other than those shown can be used. Also, an alternate configuration of cables and pulleys could be used. For example, more cable assemblies could be used to tap into the main cable sector to provide additional cable ends that exit near the distal end of a multi positional arm assembly 875. These cable assembly ends can be made to have alternate, identical, or a combination of ratios of resistance when pressed or pulled. Also, alternate handle assemblies could be used. Also, one or more multi positional arm assemblies 875 could be used. Also, more than one weight stack could be used. For example, each multi positional arm assembly 75 could have its own weight stack. Also, multiple cable ends that exit near the distal end of the same multi positional arm assembly can originate from multiple weight stacks or multiple resistance sources. Also, the arm assemblies could be in a fixed position, therefore not adjustable.

Figure 28:
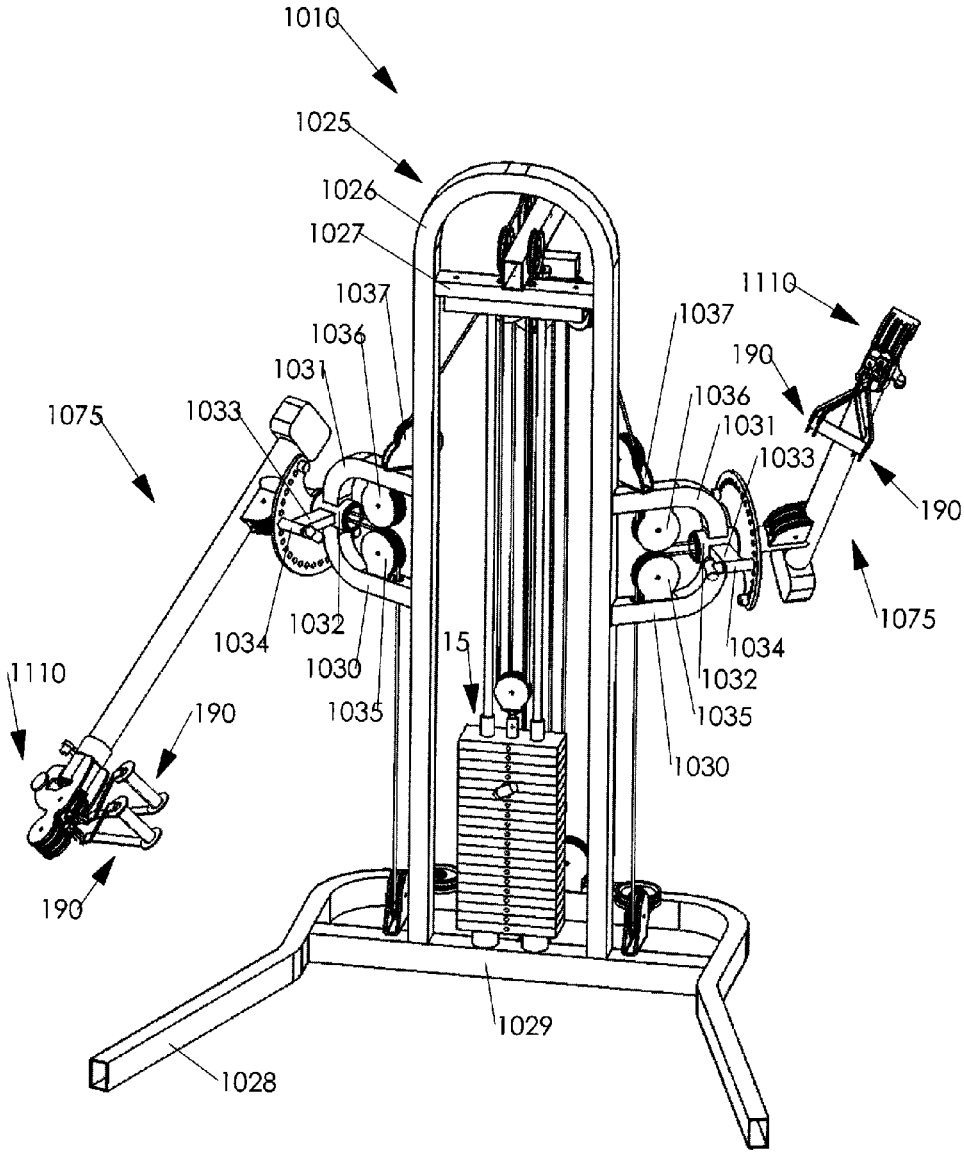
FIG. 28 is a perspective view illustrating an alternate embodiment multi resistance ratio exercise apparatus from the front left side.
Figure 28:
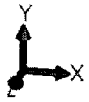
Figure 29:
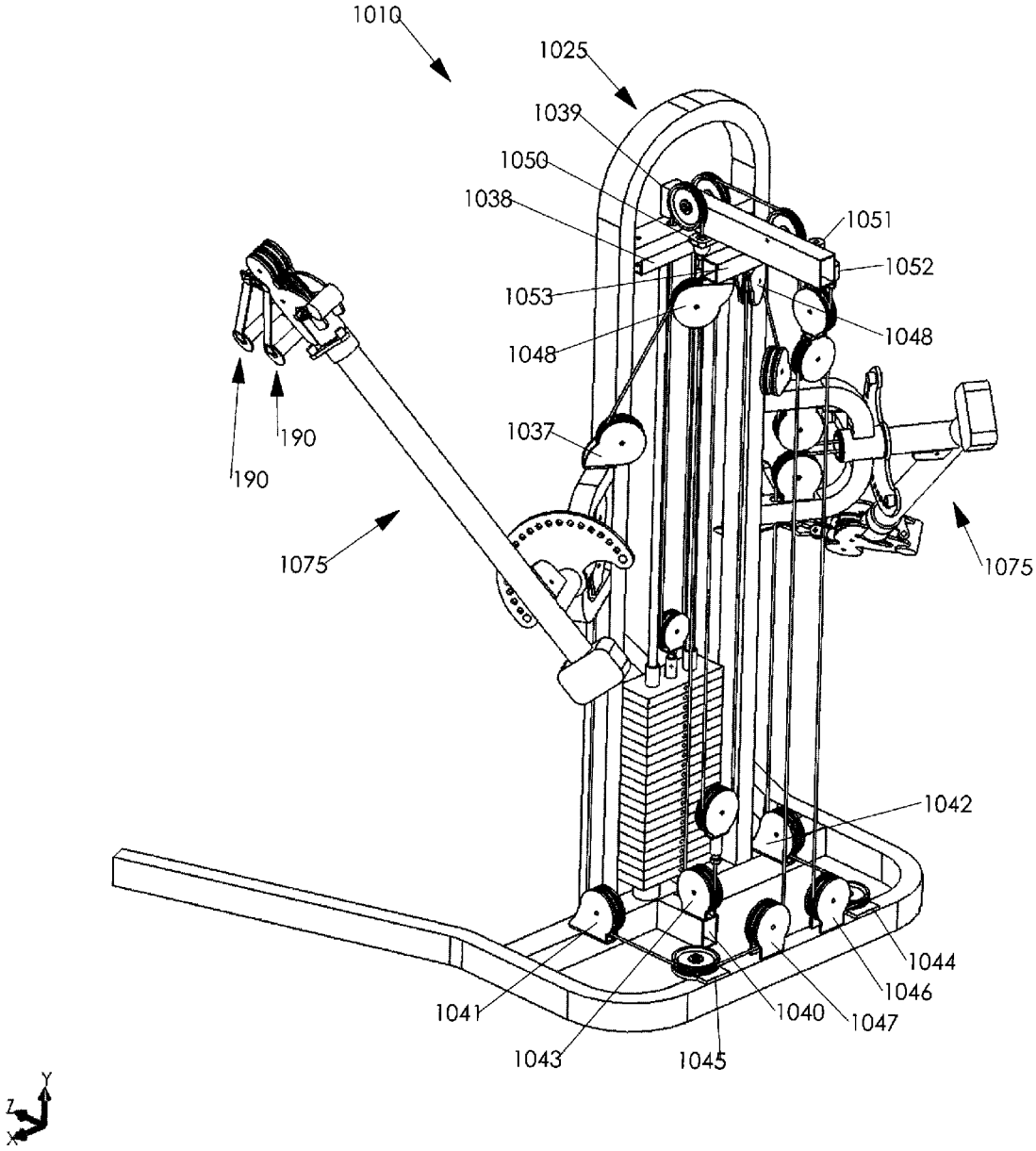
FIG. 29 is a perspective view illustrating an alternate embodiment multi resistance ratio exercise apparatus from the back left side.

FIGS. 28 and 29 illustrate an alternate embodiment of a multi resistance ratio exercise apparatus which is generally indicated by the numeral 1010 and which comprises a weight stack 15 to provide resistance, a frame 1025 to provide structural support and stability, two multi positionable arm assemblies 1075, cable assembly 1120, and handle assemblies 190. FIG. 28 illustrates multi resistance ratio exercise apparatus 1010 from the front wherein one multi positionable arm assembly 1075 is adjusted to a generally lower position and a second multi positional arm assembly 1075 is adjusted to a generally upper position. FIG. 29 illustrates multi resistance ratio exercise apparatus 1010 from the back.

The frame 1025 may have a variety of configurations depending on the specific application. In one embodiment, as shown in FIGS. 28 and 29, the frame 1025 includes a weight stack cage 1026, which houses the weight stack 15, and sits on cage bottom 229, which secures the bottom of guide rods 20. Frame bottom 228 attaches to cage bottom 1029 and provides stability to multi resistance ratio exercise apparatus 1010. Cross member 1027 is attached to near the top of weight stack cage 1026 and secures guide rod tube 1038 which secures the tops of guide rods 20. Respective lower support tubes 1030 and respective upper support tubes 1031 are attached to the outsides of weight stack cage 1026 and provide an attachment point for respective bushing tubes 1032. Bushing tubes 1032 provide pivot points for respective multi positionable arm assemblies 1075. Respective locking pin tubes 1033 are attached to the front of respective bushing tubes 1032 and secure respective locking pins 1034 which secure respective multi positionable arm assemblies 1075 into the desired position. This adjustment will be discussed in more detail later.

Figure 30:
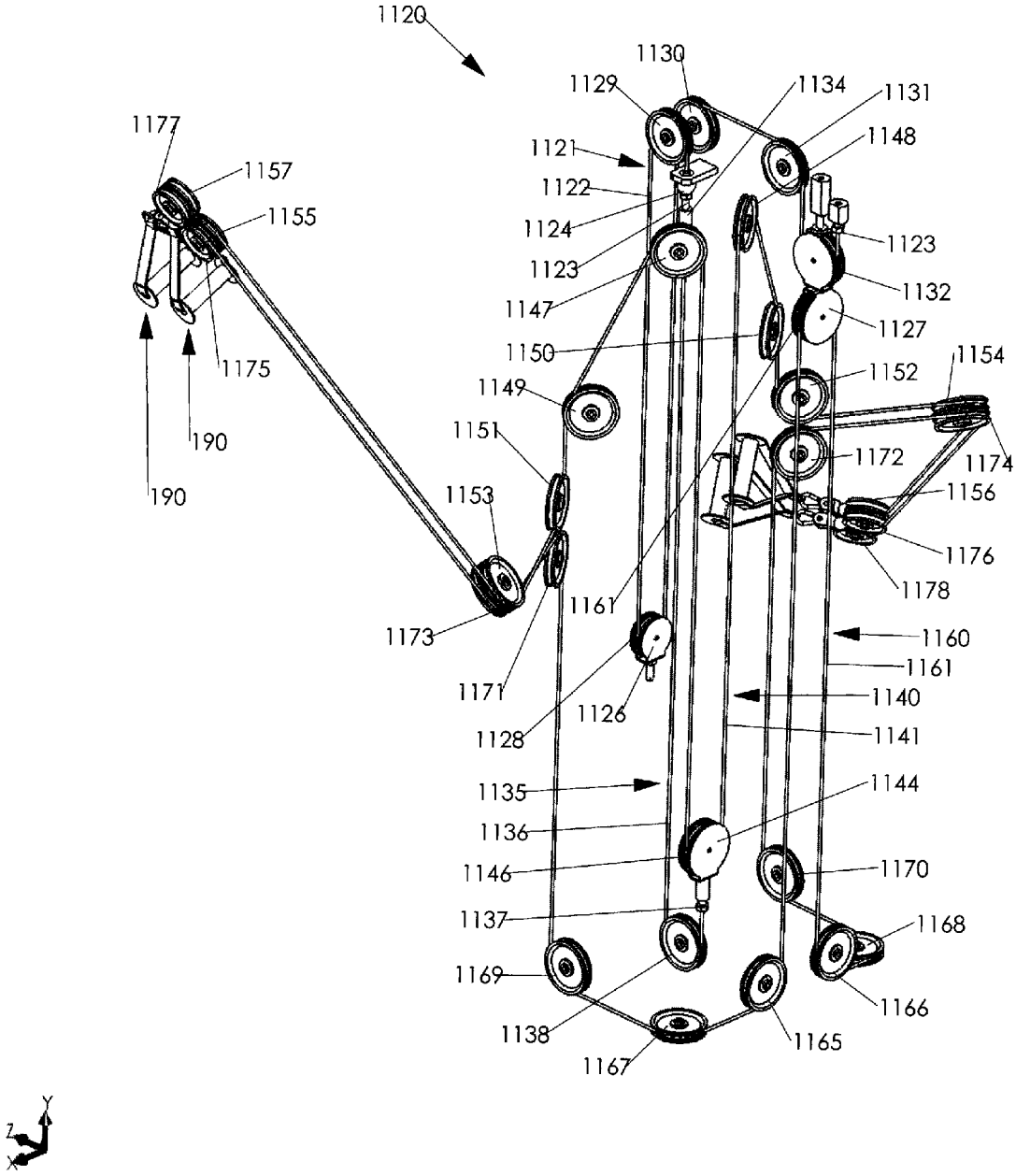
FIG. 30 is a perspective view illustrating the cable and pulley system of an alternate embodiment multi resistance ratio exercise apparatus from the back left side.

The frame 1025 further includes extension tube 1040 which is attached to the back of cage bottom 1029. As illustrated in FIGS. 29 and 30, pulley plates 1043 are attached on top of extension tube 1040 and secures pulley 1138. Pulley plates 1046 and 1047 are attached on top of frame bottom 1028 and secure pulleys 1166 and 1165. Pulley horizontal plates 1044 and 1045 also are attached on top of frame bottom 1028 and secure pulleys 1168 and 1167. Pulley brackets 1042 and 1041 are attached on top of cage bottom 1029 and secure pulleys 1170 and 1169.

The frame 1025 further includes frame top tube 1039 which is attached on top of cross member 1027 and secures pulleys 1129, 1130 and 1131. Leveler lockout 1051 is attached to the side of frame top tube 1039 and prevents double free floater 1127 from upwards travel. Cable retainer 1052 is attached to the side of frame top tube 1039 and secures one end of cable assembly 1121. Stop member plate 1050 is attached underneath frame top tube 1039 and prevents stop member 1124 from upwards travel. Cross member 1053 is attached underneath frame top tube 1039 and provides attachment points for respective pulley brackets 1048 which secure pulleys 1148 and 1147. Respective pulley brackets 1037 are attached on top of respective upper support tubes 1031. Respective pulley plates 1035 are attached on lower support tubes 1030 and respective pulley plates 1036 are attached on upper support tubes 1031.

Figure 31:
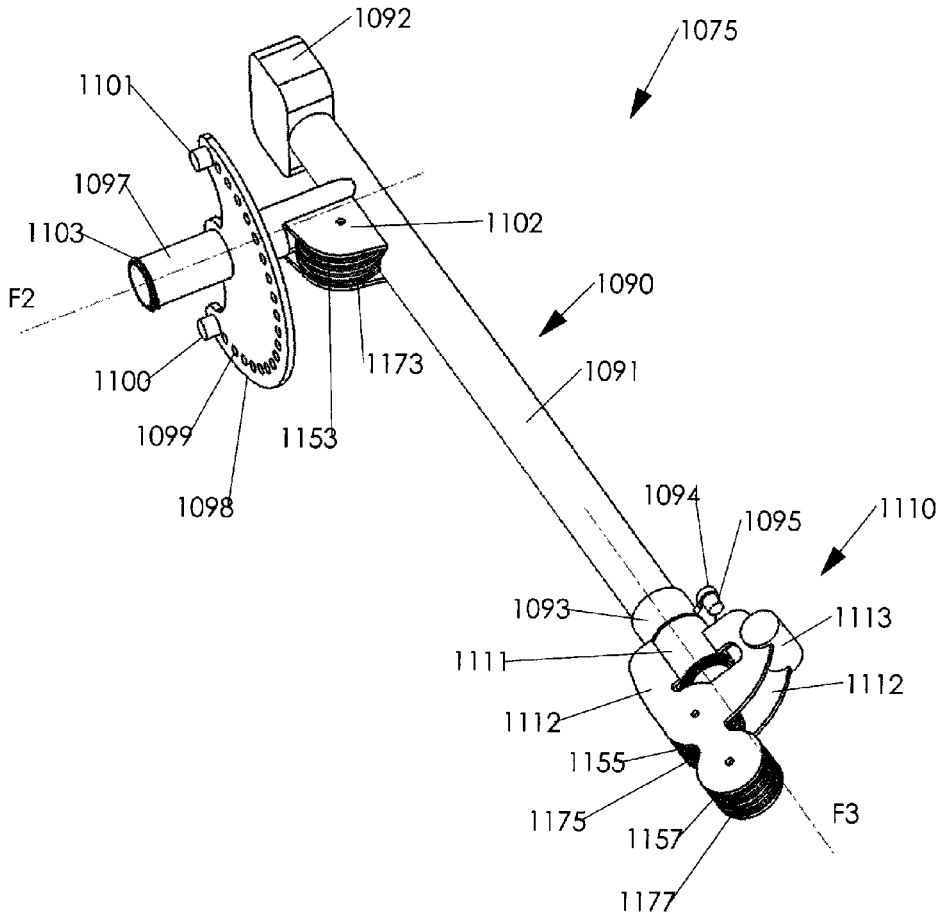
FIG. 31 is a perspective view illustrating an alternate multi positionable arm assembly from the front left side.
Figure 31:
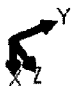

In this embodiment, the multi resistance ratio exercise apparatus 1010 comprises two multi positional arm assemblies 1075. The present invention could be made with only one multi positional arm assembly 1075 or even three or more. In one embodiment, as shown in FIG. 31, a respective multi positional arm assembly 1075 comprises an arm extension assembly 1090, and a swivel pulley assembly 1110.

A respective arm extension assembly 1090 comprises extension tube 1091 wherein side pivot tube 1097, with an axis of rotation labeled F2, is attached near one end and provides the pivot point for mounting onto bushing tube 1032 of frame 1025. Pulley plates 1102 are attached in the corner where extension tube 1091 and side pivot tube 1097 meet. Pulley plates 1102 secure respective pulleys 1174, 1154, 1173, and 1153. A locking plate 1098, with apertures 1099 formed therein, is attached near the middle of side pivot tube 1097. Locking pin 1034 of frame 1025 engages the desired aperture 1099 of locking plate 1098 to secure the multi positional arm assembly 1075 into the desired position. Bumpers 1100 and 1101 are attached generally at opposite sides of locking plate 1098 and bumper against locking pin 1034 of frame 1025 to prevent over rotation of multi positional arm assembly 1075. Counter weight 1092 is attached at one end of extension tube 1091 and balances the weight of multi positional arm assembly 1075 about axis F2. Sleeve stop 1093 is attached near the other end of extension tube 1091 and prevents swivel pulley assembly 1110 from sliding down extension tube 1091. Bumpers 1095 and 1096 (not shown) are attached to bumper plate 1094 which is attached to sleeve stop 1093 and prevent over rotation of swivel pulley assembly 1110. Retaining ring 1104 (not shown) secures the swivel pulley assembly 1110 to the arm extension assembly 1090. Retaining ring 1103 secures multi positional arm assembly 1075 onto bushing tube 1032 of frame 1025.

A respective swivel pulley assembly 1110 is pivotally attached to a respective arm extension assembly 1090 and is rotatable about an axis labeled F3. A respective swivel pulley assembly 1110 comprises bushing tube 1111 which provides the pivot point for mounting onto extension tube 1091. Swivel pulley assemblies 1110 also include pulley plates 1112, which are attached to respective bushing tubes 1111, and also secure respective pulleys 1156, 1155, 1176, 1175, 1158 (not shown), 1157, 1178, and 1177. Counter weight 1113 is attached to pulley plates 1112 and balances the weight of the swivel pulley assembly 1110 about axis F3.

In this embodiment, as illustrated in FIG. 30, cable assembly 1120 includes cable assembly 1121, cable assembly 1135, cable assembly 1140, cable assembly 1160, weight stack pulley bracket 1126, single pulley free floater 1144, and double pulley free floater 1127. Cable assembly 1121 is directly connected with the weight stack 15 and serves as a main cable sector wherein cable assemblies 1135, 1140, and 1160 can tap into and interconnect with resistance.

Cable assembly 1121 comprises cable 1122 which includes stop member 1124 and cable bolt 1123 attached at one end and cable bolt 1123 attached at the other end. Cable 1122 is routed through stop member plate 1050 then over fixed pulley 1129, then downward and around pulley 1128 in weight stack pulley bracket 1126. Cable 1122 is then routed upwards and over fixed pulleys 1130 and 1131, then downwards and around pulley 1132 in double pulley free floater 1127. This end of cable 1122 is then retained by cable retainer 1052. Stop member plate 1050 prohibits upward travel of the other end of cable 1122 by bracing against stop member 1124.

Cable assembly 1135 comprises cable 136 which includes respective cable bolts 1137 attached on respective ends as well as cable connector 1134 which connects one end of cable assembly 1135 to cable assembly 1121. Cable assembly 1135 is then routed downward and around fixed pulley 1146 then back upward and connects with single free floater 1144 of cable assembly 1140.

Cable assembly 1140 comprises cable 1141 which includes respective cable end assemblies 207 (shown in FIG. 32) attached at respective ends. Generally, the middle section of cable 1141 is routed around pulley 1146 in single pulley free floater 1144. Respective sides of cable 1141 are then routed upward and around fixed pulleys 1148 and 1147, then outward around fixed pulleys 1150 and 1149. Cable 1141 is then routed downwards and guided by pulleys 1152 and 1151. Cable 1141 is then routed outward and around pulleys 1154 and 1153 in respective arm extension assembly's 1090, then outward and around pulleys 1156 and 1155 in respective swivel pulley assembly's 1110. This is where respective ends of cable assembly 1140 exit near a respective distal end of a respective multi positionable arm assembly 1075. Respective stop members 208 provide a rest position to respective cable ends of cable 1141 when not in use. A respective handle assembly 190 can be attached to one or both ends of cable assembly 1140. Pulleys 1158 (not shown) and 1157 in respective swivel pulley assembly's 1110 serve as guide pulleys when cable assembly 1140 is pressed or pulled. When one end of cable assembly 1140 is pressed or pulled, single pulley free floater 1144 is pulled upward which causes cable assembly 1121 to lift weight stack 15 therefore providing a 4 to 1 mechanical advantage to the user. When both ends of cable assembly 1140 is pressed or pulled, single pulley free floater 1144 is pulled upward which causes cable assembly 1121 to lift weight stack 15 therefore providing a 2 to 1 ratio of resistance to the user.

Cable assembly 1160 comprises cable 1161 which includes respective cable end assemblies 207 (shown in FIG. 32) attached at respective ends. Generally, the middle section of cable 1161 is routed around pulley 1161 in double pulley free floater 1127. Respective sides of cable 1161 are then routed downward and around fixed pulleys 1166 and 1165, then outward around fixed pulleys 1168 and 1167. Cable 1161 is then routed around fixed pulleys 1170 and 1169, then upward and guided by pulleys 1172 and 1171. Cable 1161 is then routed over pulleys 1174 and 1173 in respective arm extension assembly's 1090, then outward and around pulleys 1176 and 1175 in respective swivel pulley assembly's 1110. This is where respective ends of cable assembly 1160 exit near a respective distal end of a respective multi positionable arm assembly 1075. Respective stop members 208 provide a rest position to respective cable ends of cable 1161 when not in use. A respective handle assembly 190 can be attached to one or both ends of cable assembly 1160. Pulleys 1178 and 1177 in respective swivel pulley assembly's 1110 serve as guide pulleys when cable assembly 1160 is pressed or pulled. When one end of cable assembly 1160 is pressed or pulled, double pulley free floater 1127 is pulled downward which causes cable assembly 1121 to lift weight stack 15 therefore providing a 2 to 1 mechanical advantage to the user. When both ends of cable assembly 1160 are pressed or pulled, double pulley free floater 1127 is pulled downward which causes cable assembly 1121 to lift weight stack 15 therefore providing a 1 to 1 ratio of resistance to the user.

To exercise with the multi resistance ratio exercise apparatus 1010, the user will rotate the multi positional arm assemblies 1075 about axes F2 into the desired height position. Respective portions of cable assemblies 1140 and 1160 are routed along side a respective axis F2 and self align with respective fixed pulleys 1152, 1151, 1172, and 1171 of frame 1025 and respective moveable pulleys 1154, 1153, 1174, and 1173 of arm extension assemblies 1090 when the multi positional arm assemblies 1075 are rotated. This will allow the cable assembly 1120 to maintain a substantially constant tension. A respective multi positional arm assembly 1075 can be secured into position by engaging the desired respective aperture 1099 of a respective arm extension assembly 1090 with a respective locking pin 1034 of frame 1025.

The user will then select the desired resistance. The desired resistance will be selected from the weight stack 15 however the user can alter the ratio of resistance selected by attaching handle assembly 190 to the appropriate cable assembly end or ends. A lower ratio of resistance will allow more cable travel which is typically needed for functional training exercises. A higher ratio of resistance will provide more resistance for strength training movements wherein long cable travel is not required. In this embodiment, the user can attach one handle assembly 190 to one end of cable assembly 1140 and receive a 4 to 1 mechanical advantage when the handle assembly 190 is pressed or pulled. If respective handle assemblies 190 are attached to respective ends of cable assembly 1140 and both are pressed or pulled, the user will be exercising with a 2 to 1 ratio of resistance. The user can attach one handle assembly 190 to one end of cable assembly 1160 and receive a 2 to 1 mechanical advantage when the handle assembly 190 is pressed or pulled. If respective handle assemblies 190 are attached to respective ends of cable assembly 1160 and both are pressed or pulled, the user will be exercising with a 1 to 1 ratio of resistance. If more resistance is desired, as shown in FIG. 32, the user can attach handle assembly 190 to one end of cable assembly 1140 as well as to one end of cable assembly 1160 and press or pull both cable assembly ends at the same time with one handle assembly.

While exercising, swivel pulley assemblies 1110 will rotate about axes F3 in the direction that the user is pressing or pulling the handle assemblies 190. Respective portions of cable assemblies 1140 and 1160 are routed along side of a respective axis F3 and self align with respective moveable pulleys 1154, 1153, 1174, and 1173 of arm extension assemblies 1090 and respective moveable pulleys 1156, 1155, 1176, and 1175 of swivel pulley assemblies 1110 when the swivel pulley assemblies 1110 rotate during exercise. This will allow the cable assembly 1120 to maintain a substantially constant tension.

Those skilled in the art will appreciate that modifications to this embodiment can be made without departing from the scope of the invention. An alternate frame configuration could be used. Different ratios of resistance other than those shown can be used. Also, an alternate configuration of cables and pulleys could be used. For example, more cable assemblies could be used to tap into the main cable sector to provide additional cable ends that exit near the distal end of a multi positional arm assembly 1075. These cable assembly ends can be made to have alternate, identical, or a combination of ratios of resistance when pressed or pulled. Also, alternate handle assemblies could be used. Also, one or more multi positional arm assemblies 1075 could be used. Also, more than one weight stack could be used. For example, each multi positional arm assembly 1075 could have its own weight stack. Also, multiple cable ends that exit near the distal end of the same multi positional arm assembly can originate from multiple weight stacks or multiple resistance sources. Also, the arm assemblies could be in a fixed position, therefore not adjustable.

Figure 34:
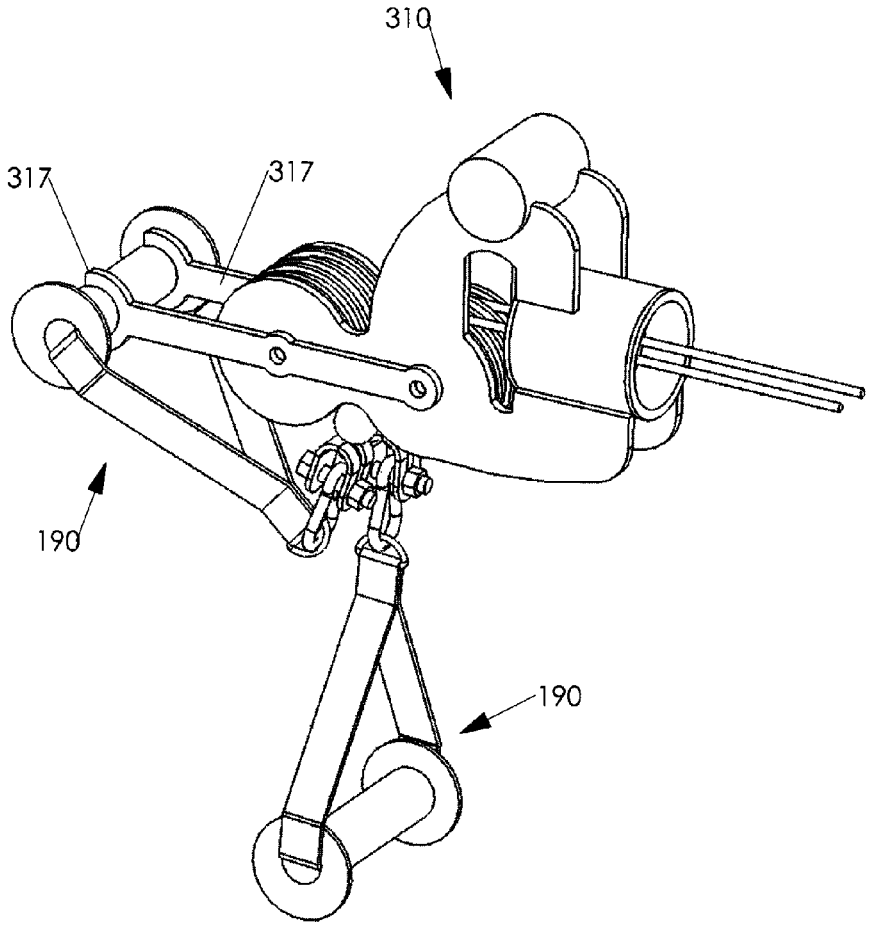
FIG. 34 is a perspective view illustrating an alternate swivel pulley assembly wherein one exemplary handle is in a ready for use position and a second exemplary handle is in a storage position.
Figure 34:
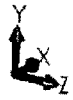

FIG. 34 illustrates a swivel pulley assembly 310 wherein two handle assemblies 190 are attached to two cable assembly ends. Handle assembly holders 317 are attached to swivel pulley assembly 310 and hold one handle assembly 190 in a storage position. Those skilled in the art will appreciate that many different embodiments could be made to store one or more handle assemblies at different locations on the swivel pulley assembly 310.

Those skilled in the art will appreciate that some aspects of some of the above mentioned embodiments can be combined within one another. Also, the present invention can be carried out whether an arm assembly is in a fixed position or is adjustable in one or more planes. The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise apparatus comprising:

a frame;

a resistance element to provide resistance for performing exercise;

an arm attached to and extending from said frame, said arm including at least two pulleys;

a flexible connector system coupled to said resistance element and comprising two or more flexible lines, said flexible connector system including a first flexible line end and a second flexible line end partially wrapping around and extending beyond respective said pulleys;

one or more handles; and wherein said flexible connector system is configured to provide a first ratio of resistance when one of said one or more handles is attached to said first flexible line end and pulled by a user, and to provide a second ratio of resistance greater than said first ratio of resistance when one of said one or more handles is attached to said second flexible line end and pulled by said user.

2. The exercise apparatus of claim 1 further including one or more swivel pulley assemblies for mounting said pulleys to said arm, each of said one or more swivel pulley assemblies is pivotally attached to said arm.

3. The exercise apparatus of claim 2 wherein said arm is pivotally attached to said frame.

4. The exercise apparatus of claim 3 wherein said frame includes a hollow axle wherein said arm is pivotally mounted to said frame and rotatable about said frame hollow axle and wherein said first and second flexible line ends pass through said frame hollow axle and are directed towards respective said pulleys by at least two respective deflecting pulleys.

5. The exercise apparatus of claim 4 wherein said arm includes a hollow axle for pivotally attaching one of said one or more swivel pulley assemblies to said arm and wherein said first and second flexible line ends pass through said arm hollow axle and partially wrap around and extend beyond respective said pulleys.

6. The exercise apparatus of claim 3 wherein said arm includes a hollow axle for pivotally attaching one of said one or more swivel pulley assemblies to said arm and wherein said first and second flexible line ends pass through said arm hollow axle and partially wrap around and extend beyond respective said pulleys.

7. The exercise apparatus of claim 2 wherein said arm includes a hollow axle for pivotally attaching one of said one or more swivel pulley assemblies to said arm and wherein said first and second flexible line ends pass through said arm hollow axle and partially wrap around and extend beyond respective said pulleys.

8. The exercise apparatus of claim 1 wherein said first flexible line end has more travel distance capability than said second flexible line end when pulled.

9. The exercise apparatus of claim 1 wherein a third ratio of resistance, that provides more resistance than said second ratio of resistance, is obtained when one of said one or more handles is attached to said first and second flexible line ends together and pulled by said user.

10. The exercise apparatus of claim 1 wherein a first flexible line includes said first flexible line end and wherein a second flexible line includes said second flexible line end.

11. The exercise apparatus of claim 1 further including a second arm attached to and extending from said frame.

12. The exercise apparatus of claim 1 wherein said arm is pivotally attached to said frame.

13. An exercise apparatus comprising:

a frame;

a resistance element to provide resistance for performing exercise;

an arm attached to and extending from said frame, said arm including at least two pulleys;

a swivel pulley assembly for mounting said pulleys to said arm, said swivel pulley assembly pivotally mounted to said arm such that said pulleys pivot about said arm on a common axis;

a flexible connector system coupled to said resistance element and comprising one or more flexible lines, said flexible connector system including a first flexible line end and a second flexible line end partially wrapping around and extending beyond respective said pulleys;

one or more handles; and wherein said flexible connector system is configured to provide a first ratio of resistance when one of said one or more handles is coupled to said first flexible line end and pulled by a user, and to provide a second ratio of resistance greater than said first ratio of resistance when one of said one or more handles is coupled to said first and second flexible line ends together and pulled by said user, and wherein said swivel pulley assembly pivots in the general direction said first or second flexible line end is pulled during exercise.

14. The exercise apparatus of claim 13 wherein said arm is pivotally attached to said frame.

15. The exercise apparatus of claim 13 further including a second arm attached to and extending from said frame.

16. An exercise apparatus comprising:

a frame;

a resistance element to provide resistance for performing exercise;

a first arm attached to and extending from said frame, said first arm including a first and a second pulley;

a second arm attached to and extending from said frame, said second arm including a third and a fourth pulley;

a flexible connector system coupled to said resistance element and comprising two or more flexible lines, said flexible connector system including a first flexible line end that partially wraps around and extends beyond said first pulley on said first arm, a second flexible line end that partially wraps around and extends beyond said second pulley on said first arm, a third flexible line end that partially wraps around and extends beyond said third pulley on said second arm, and a fourth flexible line end that partially wraps around and extends beyond said fourth pulley on said second arm;

at least two handles; and wherein said flexible connector system is configured to provide a first ratio of resistance when first and second handles are attached to said first and third flexible line ends respectively and pulled together by said user, and to provide a second ratio of resistance greater than said first ratio of resistance when said first and second handles are attached to said second and fourth flexible line ends respectively and pulled together by said user.

17. The exercise apparatus of claim 16 further including two or more swivel pulley assemblies for mounting said first and second pulleys to said first arm, and third and fourth pulleys to said second arm, each of said two or more swivel pulley assemblies is pivotally attached to a respective said arm.

18. The exercise apparatus of claim 16 wherein said first and third flexible line ends have more travel distance capability than said second and fourth flexible line ends when pulled individually.

19. The exercise apparatus of claim 16 wherein said flexible connector system is configured to provide a third ratio of resistance greater than said second ratio of resistance when one of said handles is coupled to said first and second flexible line ends together and another of said handles is coupled to said third and fourth flexible line ends together, and said first, second, third, and fourth flexible line ends are pulled together as a group by said user.

20. The exercise apparatus of claim 16 wherein said arms are pivotally attached to said frame.

21. An exercise apparatus comprising:

a frame;

a resistance element to provide resistance for performing exercise;

a first arm attached to and extending from said frame, said first arm including a first and a second pulley;

a first swivel pulley assembly for mounting said first and second pulleys to said first arm, said first swivel pulley assembly pivotally mounted to said first arm such that said first and second pulleys pivot about said first arm on a common axis;

a second arm attached to and extending from said frame, said second arm including a third and a fourth pulley;

a second swivel pulley assembly for mounting said third and fourth pulleys to said second arm, said second swivel pulley assembly pivotally mounted to said second arm such that said third and fourth pulleys pivot about said second arm on a common axis;

a flexible connector system coupled to said resistance element and comprising two or more flexible lines, said flexible connector system including a first flexible line end that partially wraps around and extends beyond said first pulley on said first arm, a second flexible line end that partially wraps around and extends beyond said second pulley on said first arm, a third flexible line end that partially wraps around and extends beyond said third pulley on said second arm, and a fourth flexible line end that partially wraps around and extends beyond said fourth pulley on said second arm;

a first handle for selectively coupling to one or both said first and second flexible line ends on said first arm;

a second handle for selectively coupling to one or both of said third and fourth flexible line ends on said second arm; and wherein said flexible connector system is configured to provide a first ratio of resistance when said first and second handles are coupled to one of said flexible line ends on respective arms and pulled by a user, and to provide a second ratio of resistance greater than said first ratio of resistance when said first and second handles are coupled to both said flexible line ends on respective arms and pulled by said user, and wherein said first swivel pulley assembly pivots in the general direction said first or second flexible line end is pulled during exercise and wherein said second swivel pulley assembly pivots in the general direction said third or fourth flexible line end is pulled during exercise.

22. The exercise apparatus of claim 21 wherein said arms are pivotally attached to said frame.

* * * * *